US009496644B2

(12) United States Patent
Bragg

(10) Patent No.: US 9,496,644 B2
(45) Date of Patent: Nov. 15, 2016

(54) COMMUNICATION OUTLET WITH SHUTTER MECHANISM AND WIRE MANAGER

(71) Applicant: Leviton Manufacturing Co., Inc., Melville, NY (US)

(72) Inventor: Charles R. Bragg, Bothell, WA (US)

(73) Assignee: LEVITON MANUFACTURING CO., LTD., Melville, NY (US)

( * ) Notice: Subject to any disclaimer, the term of this patent is extended or adjusted under 35 U.S.C. 154(b) by 0 days.

(21) Appl. No.: 14/685,379

(22) Filed: Apr. 13, 2015

(65) Prior Publication Data

US 2015/0295350 A1 Oct. 15, 2015

Related U.S. Application Data

(60) Provisional application No. 61/979,426, filed on Apr. 14, 2014.

(51) Int. Cl.

*H01R 13/627* (2006.01)
*H01R 13/453* (2006.01)
*H01R 4/24* (2006.01)

(Continued)

(52) U.S. Cl.

CPC ..... *H01R 13/627* (2013.01); *H01R 13/4536* (2013.01); *H01R 4/2433* (2013.01); *H01R 13/6583* (2013.01); *H01R 24/64* (2013.01)

(58) Field of Classification Search

CPC ..... H01R 13/4536; H01R 13/4534; H01R 13/447; H01R 13/4532; H01R 13/648; H01R 13/652

See application file for complete search history.

(56) References Cited

U.S. PATENT DOCUMENTS 3,636,500 A 1/1972 Sedlacek
3,763,461 A * 10/1973 Kotski ..... H01H 33/06 174/73.1
3,845,455 A 10/1974 Shoemaker (Continued)

FOREIGN PATENT DOCUMENTS

JP 2006-318801 11/2006
WO 2011-087480 7/2011

OTHER PUBLICATIONS

English Abstract of Japanese Patent Publication No. 2006-318801, published Nov. 24, 2006.

(Continued)

*Primary Examiner* — Gary Paumen
(74) *Attorney, Agent, or Firm* — Davis Wright Tremaine LLP; George C. Rondeau, Jr.; Heather M. Colburn

(57) ABSTRACT

A communication outlet for use with a communication plug. The outlet includes a shutter door biased by at least one biasing member toward a closed position in which the shutter door substantially obstructs the opening. Insertion of the communication plug into the opening transitions the shutter door from the closed position to an open position. Optionally, the outlet includes a shutter lock member adjacent the shutter door. The shutter lock member prevents the shutter door from transitioning from the closed position to the open position when the shutter lock member is in a locked position. The shutter lock member is transitionable from the locked position to an unlocked position by the insertion of the communication plug into the opening. Optionally, the outlet includes a wire manager configured to position a plurality of wires to engage a plurality of wire contacts inside the outlet.

46 Claims, 48 Drawing Sheets

(51) Int. Cl.
*H01R 13/6583* (2011.01)
*H01R 24/64* (2011.01)

(56) References Cited

U.S. PATENT DOCUMENTS

| | | | | |
|---|---|---|---|---|
| 3,975,076 | A | 8/1976 | Shida et al. | |
| 4,682,835 | A | 7/1987 | Aujla et al. | |
| 4,749,366 | A | 6/1988 | McCaffery | |
| 4,847,711 | A * | 7/1989 | Inoue | G11B 23/502 360/137 |
| 4,870,227 | A | 9/1989 | Saen et al. | |
| 4,897,040 | A | 1/1990 | Gerke et al. | |
| 4,909,754 | A | 3/1990 | Paradis | |
| 4,973,258 | A | 11/1990 | Fusselman | |
| 4,973,261 | A | 11/1990 | Hatagishi | |
| 5,131,863 | A | 7/1992 | Gerke et al. | |
| 5,230,632 | A | 7/1993 | Baumberger et al. | |
| 5,281,176 | A | 1/1994 | Yahagi et al. | |
| 5,501,607 | A * | 3/1996 | Yoshioka | B60K 1/04 220/259.2 |
| 5,533,910 | A | 7/1996 | Korner et al. | |
| 5,836,782 | A | 11/1998 | Odley et al. | |
| 5,848,911 | A | 12/1998 | Garcin | |
| 6,142,817 | A | 11/2000 | Lee | |
| 6,431,903 | B1 | 8/2002 | Dittmann et al. | |
| 6,595,696 | B1 * | 7/2003 | Zellak | G02B 6/3825 385/72 |
| 6,764,222 | B1 * | 7/2004 | Szilagyi | G02B 6/3849 385/55 |
| 6,786,776 | B2 | 9/2004 | Itano et al. | |
| 6,957,970 | B2 * | 10/2005 | Weigel | H01R 13/622 439/277 |
| 7,077,670 | B2 * | 7/2006 | Suwa | G06K 13/0875 361/679.34 |
| 7,249,974 | B2 | 7/2007 | Gordon et al. | |
| D565,443 | S | 4/2008 | Frake | |
| D587,201 | S | 2/2009 | Allwood | |
| 7,597,568 | B1 * | 10/2009 | Lu | H05K 5/0239 439/137 |
| D603,341 | S | 11/2009 | Kawakami | |
| 7,686,642 | B2 | 3/2010 | Pearson et al. | |
| 7,704,093 | B2 | 4/2010 | Turkekole et al. | |
| 7,713,094 | B1 | 5/2010 | Sparrowhawk | |
| 7,736,173 | B2 | 6/2010 | Chen | |
| 7,736,195 | B1 | 6/2010 | Poulsen et al. | |
| RE41,699 | E | 9/2010 | Itano et al. | |
| 7,821,370 | B1 * | 10/2010 | Shu | G02B 6/4292 336/107 |
| 7,824,231 | B2 | 11/2010 | Marti et al. | |
| 7,857,655 | B2 | 12/2010 | Gyagang et al. | |
| 7,909,656 | B1 | 3/2011 | Erickson et al. | |
| 7,967,645 | B2 | 6/2011 | Marti et al. | |
| 7,976,334 | B2 | 7/2011 | Bishop | |
| 8,038,482 | B2 | 10/2011 | Erickson et al. | |
| D649,971 | S | 12/2011 | Lyford | |
| D663,273 | S | 7/2012 | Lyford | |
| D668,226 | S | 10/2012 | Lyford | |
| 8,475,201 | B2 | 7/2013 | Pirlo | |
| 8,690,459 | B2 * | 4/2014 | Lin | G02B 6/3849 385/92 |
| D714,293 | S | 9/2014 | Kelly | |
| D721,036 | S | 1/2015 | Kreitzer | |
| D729,806 | S | 5/2015 | Park | |
| D731,489 | S | 6/2015 | Langhammer | |
| D732,536 | S | 6/2015 | Kang | |
| D733,142 | S | 6/2015 | Solomon | |
| 9,147,977 | B2 | 9/2015 | Poulsen et al. | |
| D743,398 | S | 11/2015 | Smith | |
| D745,523 | S | 12/2015 | Magi | |
| D746,291 | S | 12/2015 | Solomon | |
| D752,590 | S | 3/2016 | Bragg et al. | |
| 2004/0142589 | A1 * | 7/2004 | Caveney | H01R 13/4536 439/138 |
| 2005/0277340 | A1 | 12/2005 | Gordon et al. | |
| 2006/0030184 | A1 | 2/2006 | Sasaki | |
| 2006/0094273 | A1 * | 5/2006 | Mine | G02B 6/3849 439/137 |
| 2010/0009567 | A1 | 1/2010 | Gyagang et al. | |
| 2010/0035471 | A1 | 2/2010 | Gaidosch | |
| 2010/0041527 | A1 * | 2/2010 | Miller | A63B 21/0552 482/124 |
| 2012/0015536 | A1 * | 1/2012 | Huang | H01R 13/4536 439/138 |
| 2012/0184118 | A1 * | 7/2012 | Lee | H01R 24/64 439/137 |
| 2013/0164967 | A1 | 6/2013 | Lu | |
| 2014/0057485 | A1 | 2/2014 | Huang | |
| 2014/0273626 | A1 | 9/2014 | Sparrowhawk | |
| 2015/0229078 | A1 * | 8/2015 | Caveney | H05K 1/0228 439/676 |
| 2016/0036179 | A1 | 2/2016 | Bragg et al. | |
| 2016/0172794 | A1 | 6/2016 | Sparrowhawk et al. | |

OTHER PUBLICATIONS

PCT International Search Report and Written Opinion in corresponding International application No. PCT/US2015/025621, mailed Aug. 10, 2015.
Non-Final Office Action, dated Apr. 13, 2016, received in U.S. Appl. No. 14/883,267.
Information Disclosure Statement Transmittal filed herewith.

* cited by examiner

COMMUNICATION OUTLET WITH SHUTTER MECHANISM AND WIRE MANAGER

CROSS REFERENCE TO RELATED APPLICATION(S)

This application claims the benefit of U.S. Provisional Application No. 61/979,426, filed on Apr. 14, 2014, which is incorporated herein by reference in its entirety.

BACKGROUND OF THE INVENTION

Field of the Invention

The present invention is directed generally to communication outlets.

Description of the Related Art

Conventional RJ-45 type outlets have several drawbacks. For example, such outlets each include an opening configured to receive a conventional RJ-45 type plug. Unfortunately, debris and/or foreign objects (e.g., tools, fingers, etc.) may be received and/or inserted into that opening. Further, a conventional RJ-45 type outlet includes a carrier or terminal block with slots into which wires are pressed to terminate a cable. Unfortunately, it is difficult and time consuming for users to press the individual wires into each of the slots. Therefore, a need exists for improved RJ-45 type outlet designs. Outlets and devices configured to prevent debris and objects other than a plug from being inserted into or otherwise entering the plug-receiving opening are particularly desirable. Outlets to which cables may be more readily terminated are also desirable. The present application provides these and other advantages as will be apparent from the following detailed description and accompanying figures.

SUMMARY OF THE INVENTION

An embodiment includes a communication outlet for use with a communication plug. The outlet has a plug receiving opening, a shutter door, and a biasing member. The plug receiving opening is configured to allow at least a portion of the communication plug to pass therethrough. The shutter door is configured to block entry into the communication outlet through the plug receiving opening when in a closed position. The shutter door is rotatable about a first axis from the closed position to an open position to allow the portion of the communication plug to be inserted inside the communication outlet through the plug receiving opening. The biasing member includes at least one biasing portion that extends along a second axis spaced apart from and substantially parallel with the first axis. The biasing member biases the shutter door toward the closed position.

The insertion of the portion of the communication plug into the plug receiving opening may rotate the shutter door from the closed position to the open position and compress the biasing member. In such embodiments, removal of the communication plug from the plug receiving opening allows the biasing member to become uncompressed and return the shutter door to the closed position.

The communication outlet may include a housing that has a portion adjacent the biasing member. In such embodiments, the at least one biasing portion of the biasing member may include first and second coil springs. The first coil spring may be connected to the second coil spring by a connecting portion. The first and second coil springs may have first and second free end portions, respectively. In such embodiments, the first and second free end portions are positioned adjacent to the shutter door and press against the shutter door, and the connecting portion presses against the housing. Optionally, the shutter door may have first and second pins extending along the second axis, and the first and second coil springs may be mounted on the first and second pins, respectively.

The communication outlet may be configured for use with a communication plug having an electrically conductive plug housing connected to a first ground. In such embodiments, the communication outlet may include an electrically conductive outlet housing connected to a second ground, and at least one electrically conductive ground spring attached to the outlet housing. The shutter door is housed inside the outlet housing, and the at least one ground spring contacts the plug housing of the communication plug when the portion of the communication plug is inserted into the plug receiving opening thereby connecting the first and second grounds.

Optionally, the communication outlet includes a door lock having a switch portion that extends forwardly from the shutter door. The door lock allows the shutter door to be rotated from the closed position to the open position when the switch portion is pressed upon by a forward extending portion of the communication plug. The door lock prevents the shutter door from being rotated from the closed position to the open position when the switch portion is not pressed upon.

Optionally, the communication outlet includes a shutter lock member adjacent the shutter door. The shutter lock member is transitionable from a locked position to an unlocked position by the insertion of the portion of the communication plug into the plug receiving opening. The shutter lock member prevents the shutter door from transitioning from the closed position to the open position when the shutter lock member is in the locked position. The biasing member may be rotatable about the second axis. In such embodiments, the biasing member may abut a portion of the shutter door and prevent the shutter door from rotating about the first axis when the shutter lock member is in the locked position. When the shutter lock member is transitioned from the locked position to the unlocked position, the shutter lock member rotates the biasing member about the second axis and away from the portion of the shutter door thereby allowing the shutter door to be rotated about the first axis.

Optionally, the communication outlet includes a plurality of wire contacts and a wire manager. The wire manager has an open-ended passageway and a plurality of wire channels adjacent one end of the passageway. The passageway is configured to receive therein a communication cable having a plurality of wires. The plurality of wire channels are configured to receive the plurality of wires and position the plurality of wires to form electrical connections with the plurality of wire contacts. Optionally, the communication outlet may include an electrically conductive outlet housing. In such embodiments, the wire manager is positionable inside the outlet housing and includes at least one conductive member at least partially positioned inside the passageway. The at least one conductive member electrically connects the cable shield with the outlet housing when the cable is received inside the passageway. Optionally, the communication outlet may also include at least one electrically conductive ground spring attached to the outlet housing. The outlet housing is connected to a second ground, and the at least one ground spring contacts an electrically conductive plug housing of the communication plug when the portion of the communication plug is inserted into the plug receiving opening. The electrically conductive plug housing is connected to a first ground. Thus, when the portion of the communication plug is inserted into the plug receiving opening the first and second grounds are connected.

An embodiment includes a communication outlet for terminating a communication cable that includes a plurality of wires and a cable shield. The communication outlet includes a plurality of wire contacts, and a wire manager having an open-ended passageway and a plurality of wire channels adjacent one end of the passageway. The passageway is configured to receive the communication cable therein. The plurality of wire channels are configured to receive the plurality of wires and position the plurality of wires to form electrical connections with the plurality of wire contacts.

Optionally, the communication outlet includes a guide sleeve configured to determine an orientation of the wire manager with respect to the plurality of wire contacts. The wire manager may include one of a keyway and a key member, and the guide sleeve may include a different one of the keyway and the key member. In such embodiments, the key member is configured to be received by the keyway, and the keyway and the key member determine the orientation of the wire manager with respect to the plurality of wire contacts.

Optionally, the communication outlet includes an electrically conductive housing. In such embodiments, the wire manager is positionable inside the housing and includes at least one conductive member at least partially positioned inside the passageway. The at least one conductive member electrically connects the cable shield with the housing when the wire manager is positioned inside the housing and the cable is received inside the passageway. Optionally, the at least one conductive member electrically connects a drain wire of the cable to the housing when the communication cable is received inside the passageway.

Optionally, the housing includes at least one housing door and the wire manager is positionable inside the housing when the at least one housing door is in an open position. The at least one housing door presses the wire manager toward the plurality of wire contacts when the wire manager is inside the housing and the at least one housing door is transitioned from the open position to a closed position. Optionally, the wire manager engages with the at least one housing door when the wire manager is inside the housing and the at least one housing door is transitioned from the open position to a closed position, the engagement between the wire manager and the at least one housing door maintaining the at least one housing door in the closed position. Optionally, the wire manager includes a release lever that, when actuated, disengages the wire manager from the at least one housing door to thereby allow the at least one housing door to be transitioned from the closed position to the open position.

Optionally, the housing includes a first housing door having a first opening and a second housing door having a second opening. In such embodiments, the wire manager is positionable inside the housing when the first and second housing doors are open. The wire manager has a first anchor projection positioned inside the first opening when the wire manager is inside the housing and the first housing door is closed. Engagement between the first anchor projection and the first opening prevents the first housing door from being opened. The wire manager has a second anchor projection positioned inside the second opening when the wire manager is inside the housing and the second housing door is closed. Engagement between the second anchor projection and the second opening prevents the second housing door from being opened. Optionally, the wire manager has a first release lever that when actuated, disengages the first and second anchor projections from the first and second openings, respectively.

Optionally, the first housing door has a third opening, and the second housing door has a fourth opening. The wire manager has a third anchor projection positioned inside the third opening when the wire manager is inside the housing and the first housing door is closed. Engagement between the third anchor projection and the third opening prevents the first housing door from being opened. The wire manager has a fourth anchor projection positioned inside the fourth opening when the wire manager is inside the housing and the second housing door is closed. Engagement between the fourth anchor projection and the fourth opening preventing the second housing door from being opened. Optionally, the wire manager has a second release lever that when actuated, disengages the third and fourth anchor projections from the third and fourth openings, respectively.

The communication outlet may include a housing, a plurality of wire contacts positioned inside the housing, and a plurality of outlet contacts electrically connected to the plurality of wire contacts. In such embodiments, the communication outlet also includes a plug receiving opening configured to allow at least a portion of the communication plug to pass therethrough into the housing and position a plurality of plug contacts in physical contact with the plurality of outlet contacts. Optionally, the communication outlet includes a shutter assembly positioned adjacent the plug receiving opening. The shutter assembly includes a shutter door and at least one biasing member that biases the shutter door toward a closed position in which the shutter door substantially obstructs the plug receiving opening. The shutter door is selectively transitionable from the closed position to an open position by insertion of the portion of the communication plug into the housing through the plug receiving opening.

An embodiment includes a method of terminating a communication cable including a cable jacket protecting a plurality of wires and a cable shield. The method includes removing an end portion of the cable jacket to expose the plurality of wires and the cable shield, and folding the exposed cable shield back over the cable jacket to define a folded back shield portion. The folded back shield portion is positioned inside a wire manager with the exposed wires extending outwardly from the wire manager. The folded back shield portion contacts and forms an electrical connection with an electrically conductive member inside the wire manager. The method also includes bending each of the exposed wires extending outwardly from the wire manager and positioning each of the bent wires into a different one of a plurality of wire channels formed in the wire manager, and inserting the wire manager into an opening of a communication outlet. The plurality of wire channels position the bent wires to engage a plurality of wire contacts inside the communication outlet when the wire manager is inserted into the opening. Optionally, the method also includes closing the opening of the communication outlet when the wire manager is inside the communication outlet.

The communication outlet used in the method may include a housing. In such embodiments, the opening is formed in the housing. A housing door may be pivotably connected to the housing, and closing the opening of the communication outlet may include closing the housing door. The housing door contacts and forms an electrical connection with the electrically conductive member when the housing door is closed. The housing door pushes the wire manager forwardly as the housing door is closed. The bent wires engage the plurality of wire contacts as the wire manager is pushed forwardly by the housing door.

Removing the end portion of the cable jacket may expose a drain wire. In such embodiments, the method may also include positioning the drain wire in a drain wire channel formed in the wire manager so that the drain wire contacts and forms an electrical connection with the electrically conductive member inside the drain wire channel.

The wire manager used in the method may include a first portion pivotably connected to a second portion, the first portion being selectively pivotable with respect to the second portion to place the wire manager in an open configuration or a closed configuration. A passageway is defined between the first and second portions when the wire manager in the closed configuration. In such embodiments, positioning the folded back shield portion inside the wire manager includes pivoting the first portion with respect to the second portion to place the wire manager in the open configuration, and positioning the folded back shield portion adjacent at least one of the first and second portions when the wire manager is in the open configuration. The folded back shield portion is positioned with respect to the first and second portions such that the folded back shield portion will be inside the passageway when the wire manager is in the closed configuration. Positioning the folded back shield portion inside the wire manager also includes pivoting the first portion with respect to the second portion to place the wire manager in the closed configuration with the folded back shield portion inside the passageway.

An embodiment includes a wire manager for use with a communication outlet and a communication cable. The communication outlet includes an electrically conductive outlet housing and a plurality of wire contacts positioned inside the outlet housing. The communication cable includes a plurality of wires and a cable shield. The wire manager includes a wire manager housing and at least one conductive member. The wire manager housing is configured to clamp onto an end portion of the communication cable. The wire manager housing includes a plurality of wire channels positioned to be adjacent to the end portion of the communication cable when the wire manager housing is clamped onto the communication cable. The plurality of wire channels are configured to receive the plurality of wires and position the plurality of wires to contact the plurality of wire contacts and form electrical connections therewith when the wire manager housing is received inside the outlet housing. The at least one conductive member is connected to the wire manager housing. The at least one conductive member is positioned to contact and form an electrical connection with the cable shield when the wire manager housing is clamped onto the communication cable. The at least one conductive member is configured to contact and form an electrical connection with the outlet housing when the wire manager housing is received inside the outlet housing. The wire manager housing may include first and second portions pivotably connected to one another and configured to be pivoted to clamp onto the end portion of the communication cable. The wire manager housing may also include a drain wire channel configured to receive the drain wire. The at least one conductive member may contact and form an electrical connection with the drain wire when the drain wire is received inside the drain wire channel. The outlet housing may include at least one housing door. In such embodiments, the wire manager housing is configured to be received inside the outlet housing when the at least one housing door is in an open position. Further, the at least one conductive member contacts and forms the electrical connection with the at least one housing door when the wire manager housing is received inside the outlet housing and the at least one housing door is in a closed position. The at least one housing door may press the wire manager housing toward the plurality of wire contacts when the wire manager housing is inside the outlet housing and the at least one housing door is transitioned from the open position to the closed position.

BRIEF DESCRIPTION OF THE SEVERAL VIEWS OF THE DRAWING(S)

DETAILED DESCRIPTION OF THE INVENTION

Figure 1:
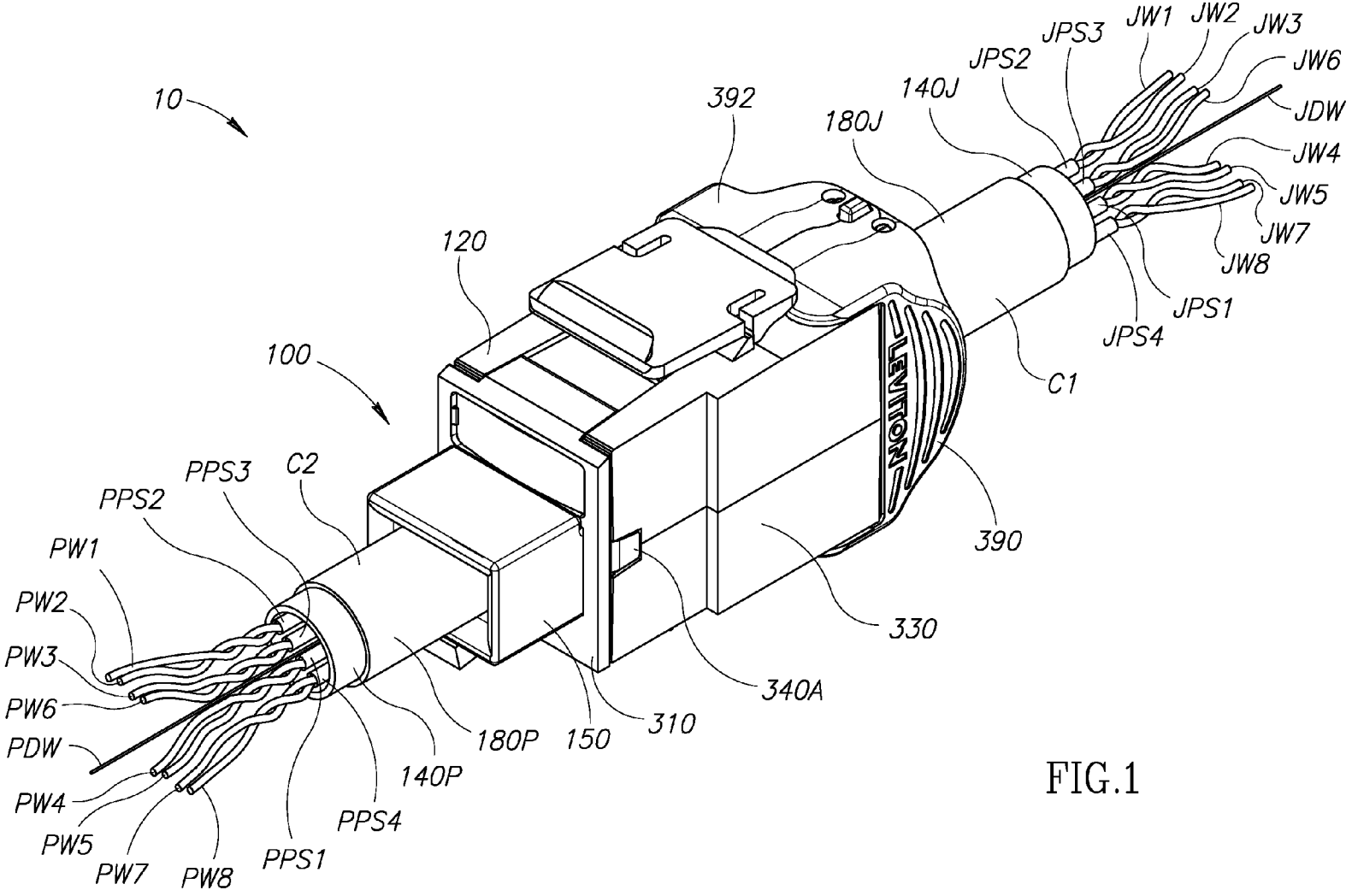
FIG. 1 is a perspective view of a connection that includes a communication outlet mated with a conventional RJ-45 type plug.

FIG. 1 is a perspective view of an assembly or connection 10 that includes a conventional RJ-45 type plug 100 mated with a communication outlet 120. For ease of illustration, the plug receiving side of the outlet 120 will be referred to as the front of the outlet 120. Similarly, the portion of the plug 100 inserted into the outlet 120 will be referred to as the front of the plug 100. The outlet 120 terminates a communication cable C1 and the plug 100 terminates a communication cable C2. Thus, the connection 10 connects the cables C1 and C2 together.

Cables

The cables C1 and C2 may be substantially identical to one another. For the sake of brevity, only the structure of the cable C1 will be described in detail. The cable C1 includes a drain wire JDW and a plurality of wires JW1-JW8. The wires JW1-JW8 are arranged in four twisted-wire pairs (also known as "twisted pairs"). The first twisted pair includes the wires JW4 and JW5. The second twisted pair includes the wires JW1 and JW2. The third twisted pair includes the wires JW3 and JW6. The fourth twisted pair includes the wires JW7 and JW8.

Optionally, each of the twisted pairs may be housed inside a pair shield. In the embodiment illustrated, the first twisted pair (wires JW4 and JW5) is housed inside a first pair shield JPS1, the second twisted pair (wires JW1 and JW2) is housed inside a second pair shield JPS2, the third twisted pair (wires JW3 and JW6) is housed inside a third pair shield JPS3, the fourth twisted pair (wires JW7 and JW8) is housed inside a fourth pair shield JPS4. For ease of illustration, the optional pair shields JPS1-JPS4 have been omitted from the other figures.

The drain wire JDW, the wires JW1-JW8, and the optional pair shields JPS1-JPS4 are housed inside a cable shield 140J. The drain wire JDW, the wires JW1-JW8, and the optional pair shields JPS1-JPS4 are each constructed from one or more electrically conductive materials.

The drain wire JDW, the wires JW1-JW8, the optional pair shields JPS1-JPS4, and the cable shield 140J are housed inside a protective outer cable sheath or jacket 180J typically constructed from an electrically insulating material.

Optionally, the cable C1 may include additional conventional cable components (not shown) such as additional shielding, dividers, and the like.

Figure 2:
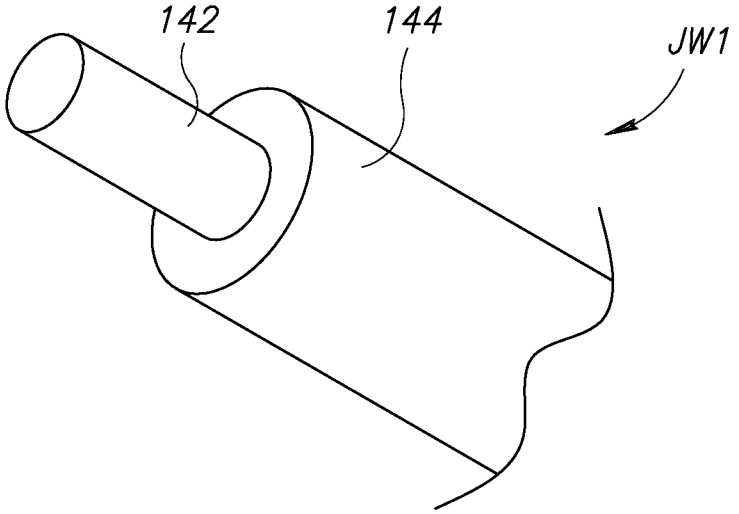
FIG. 2 is an enlarged perspective view of a wire of a cable connected to the outlet of FIG. 1.

Turning to FIG. 2, each of the wires JW1-JW8 (see FIG. 1) is substantially identical to one another. For the sake of brevity, only the structure of the wire JW1 will be described. As is appreciated by those of ordinary skill in the art, the wire JW1 as well as the wires JW2-JW8 each includes an electrical conductor 142 (e.g., a conventional copper wire) surrounded by an outer layer of insulation 144 (e.g., a conventional insulating flexible plastic jacket).

Returning to FIG. 1, each of the twisted pairs serves as a conductor of a differential signaling pair wherein signals are transmitted thereupon and expressed as voltage and/or current differences between the wires of the twisted pair. A twisted pair can be susceptible to electromagnetic sources including another nearby cable of similar construction. Signals received by the twisted pair from such electromagnetic sources external to the cable's jacket (e.g., the jacket 180J) are referred to as alien crosstalk. The twisted pair can also receive signals from one or more wires of the three other twisted pairs within the cable's jacket, which is referred to as "local crosstalk" or "internal crosstalk."

As mentioned above, the cables C1 and C2 may be substantially identical to one another. In the embodiment illustrated, the cable C2 includes a drain wire PDW, wires PW1-PW8, optional pair shields PPS1-PPS4, a cable shield 140P, and a cable jacket 180P that are substantially identical to the drain wire JDW, the wires JW1-JW8, the optional pair shields JPS1-JPS4, the cable shield 140J, and the cable jacket 180J, respectively, of the cable C1.

Plug

Figure 3:
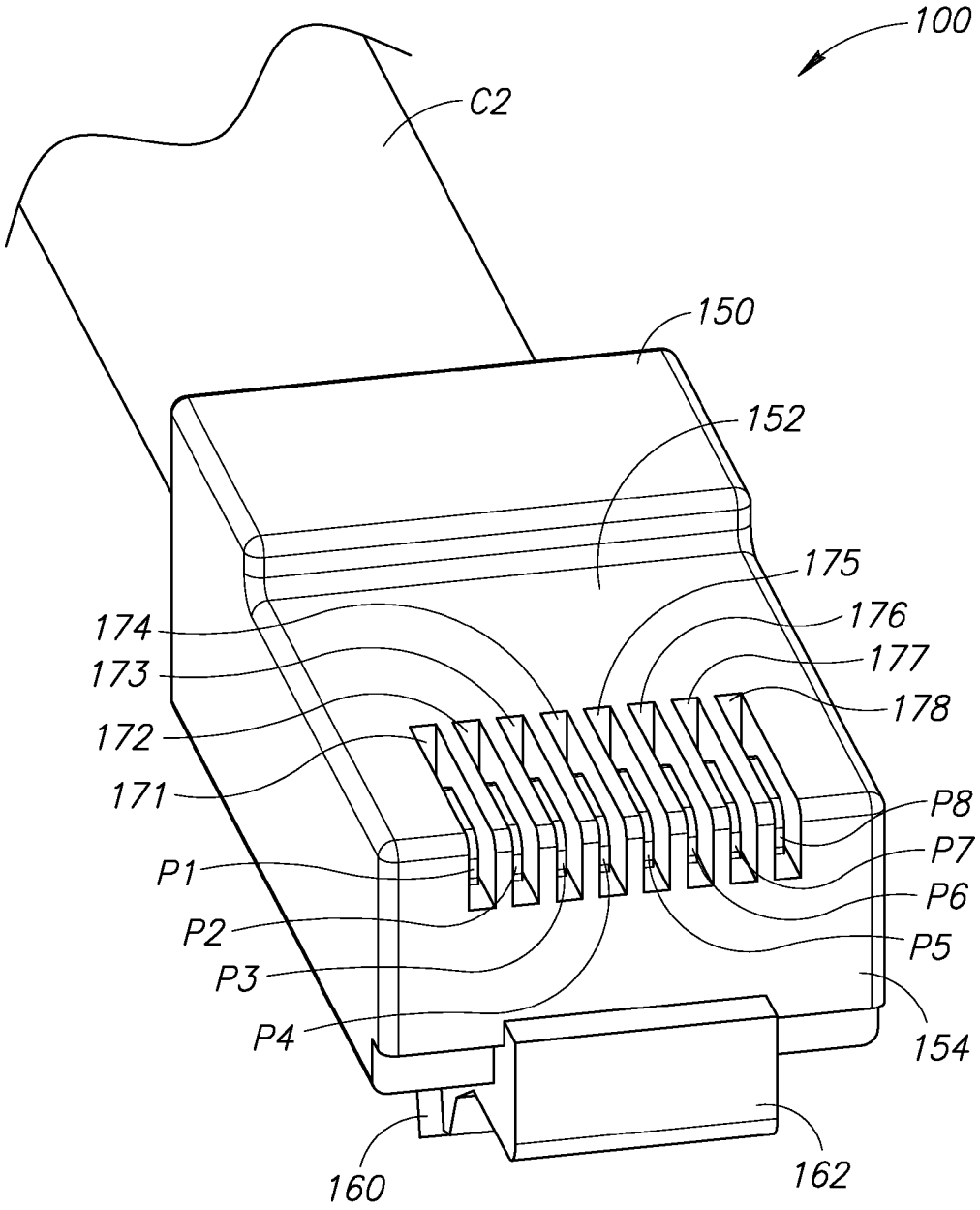
FIG. 3 is a perspective view of the front of the conventional RJ-45 type plug of FIG. 1.
Figure 4:
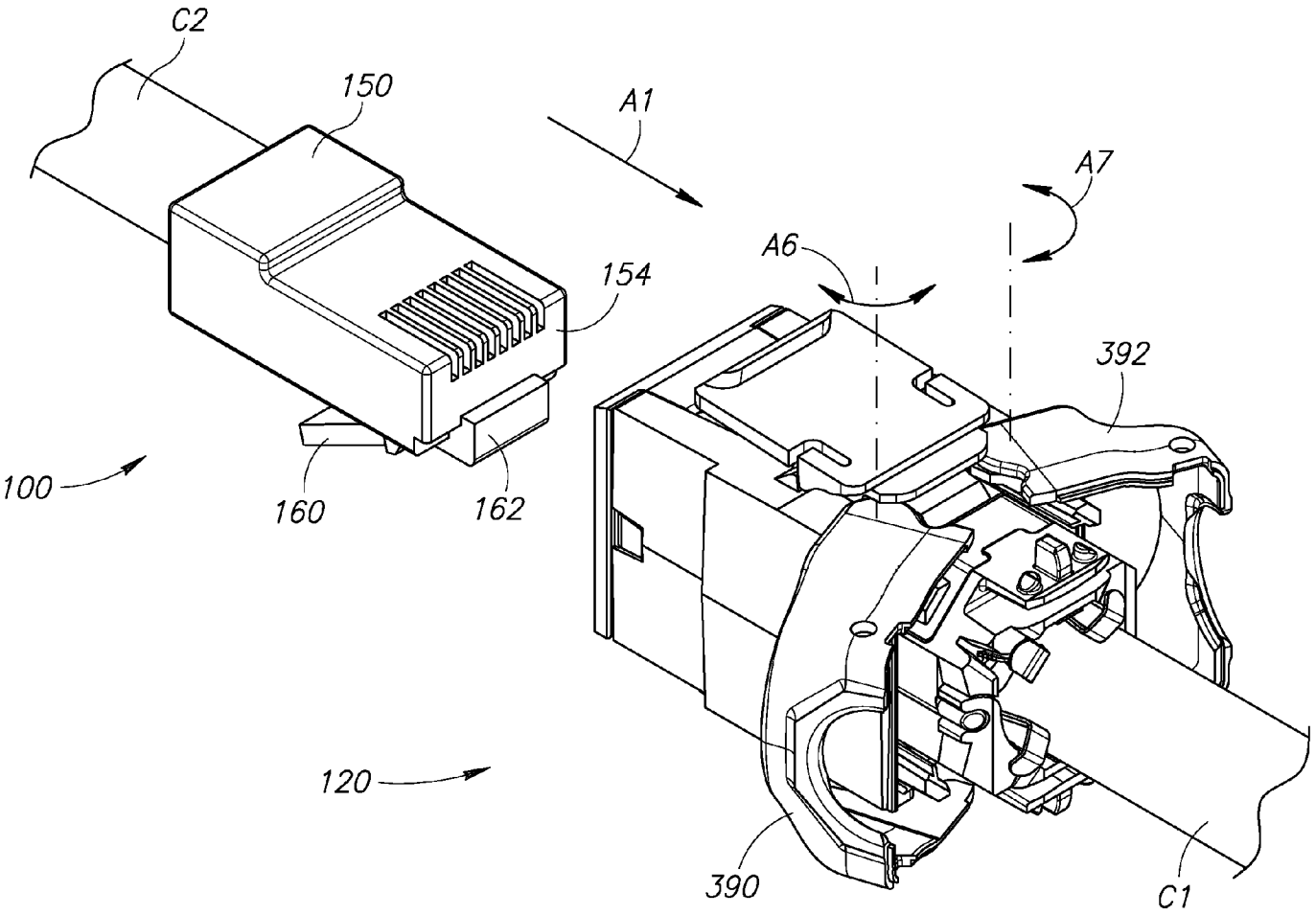
FIG. 4 is a perspective view of the front of the conventional RJ-45 type plug of FIG. 1 and the rear of the outlet of FIG. 1 with its housing doors open.

FIG. 3 is a perspective view of the plug 100 separated from the outlet 120 (see FIG. 1). FIG. 4 is a perspective view showing a front portion of the plug 100 and a rear portion of the outlet 120. The plug 100 may be inserted into the outlet 120 in a direction identified by arrow A1 to form the connection 10 depicted in FIG. 1.

As mentioned above, the plug 100 is a conventional RJ-45 type plug. Thus, referring to FIG. 3, the plug 100 includes a plug housing 150. The housing 150 may be constructed of a conductive material (e.g., metal). In such embodiments, referring to FIG. 1, the drain wire PDW, the cable shield 140P, and/or optional pair shields PPS1-PPS4 may contact the housing 150 and form an electrical connection therewith.

Referring to FIG. 3, the plug housing 150 is configured to house plug contacts P1-P8. Each of the plug contacts P1-P8 is constructed from an electrically conductive material. Referring to FIG. 1, inside the plug 100, the plug contacts P1-P8 (see FIG. 3) are electrically connected to the wires PW1-PW8, respectively, of the cable C2.

Referring to FIG. 3, the housing 150 has a forward portion 152 configured to be received by the outlet 120 (see FIG. 4), and the forward portion 152 has a forward facing portion 154. Openings 171-178 are formed in the forward portion 152 of the plug housing 150. The plug contacts P1-P8 are positioned adjacent the openings 171-178, respectively. Referring to FIG. 1, when the plug 100 is received by the outlet 120 to form the connection 10, outlet contacts J1-J8 (see FIG. 20) in the outlet 120 extend into the openings 171-178 (see FIG. 3), respectively, and contact the plug contacts P1-P8 (see FIG. 3), respectively. In the connection 10, the contacts P1-P8 (see FIG. 3) form physical and electrical connections with the outlet contacts J1-J8 (see FIG. 20), respectively, of the outlet 120.

Referring to FIG. 4, a conventional latch arm 160 is attached to the housing 150. A portion 162 of the latch arm 160 extends onto the forward facing portion 154. The portion 162 extends forwardly from the forward facing portion 154 away from the housing 150.

Outlet

Figure 5:
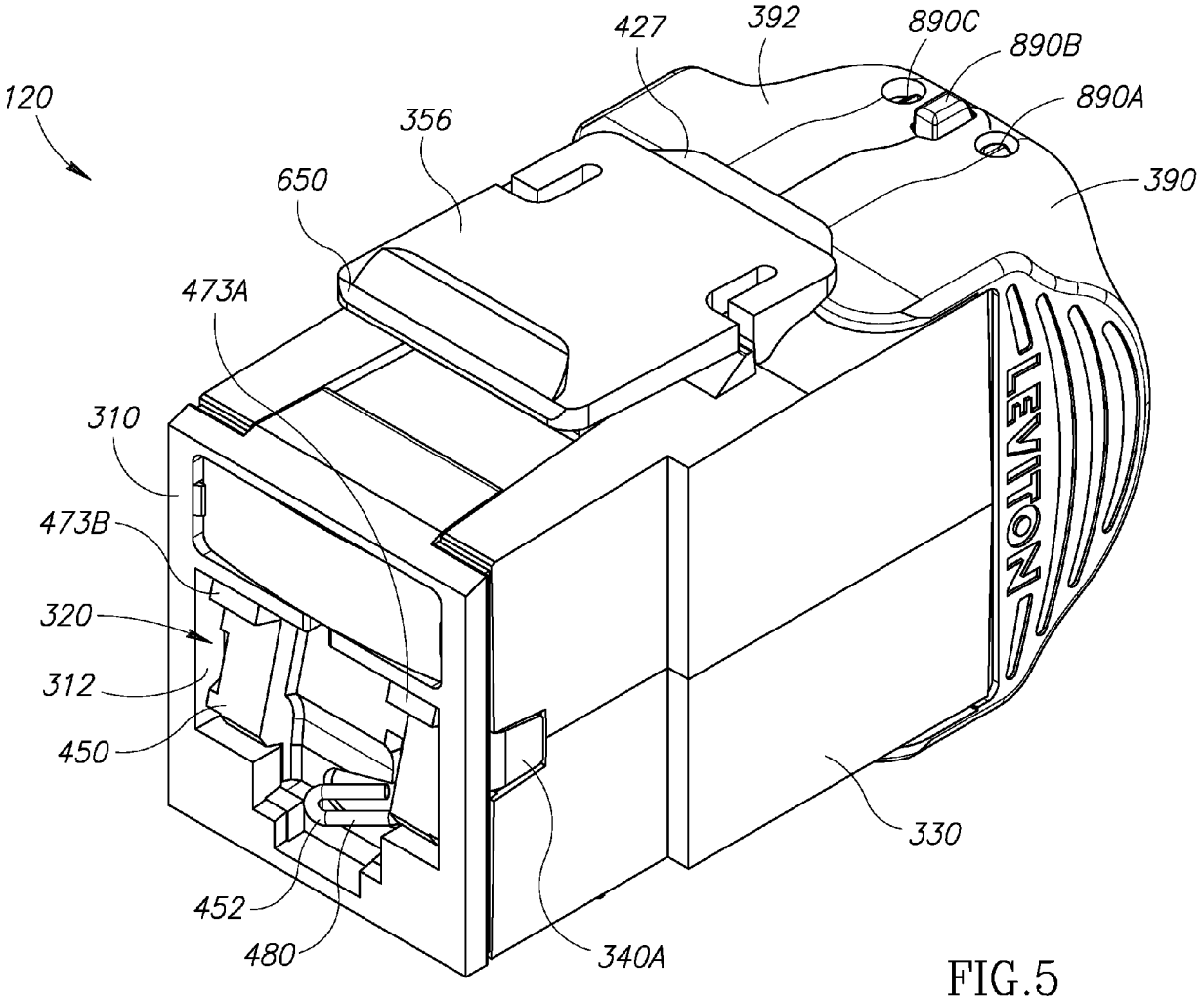
FIG. 5 is a perspective view of the front of the outlet of FIG. 1 with its shutter door and housing doors closed.
Figure 6:
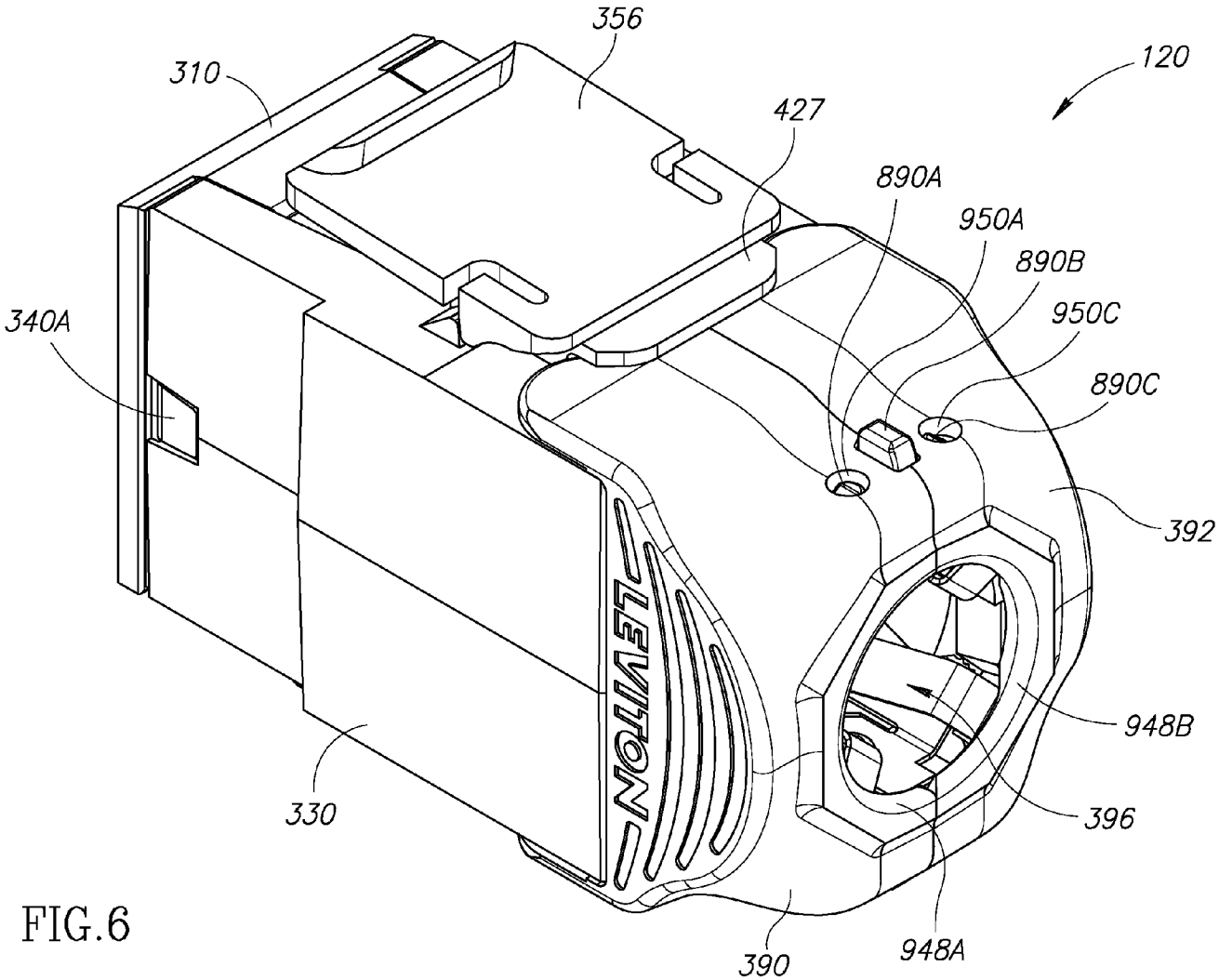
FIG. 6 is a perspective view of the rear of the outlet of FIG. 1 with its housing doors closed.
Figure 7:
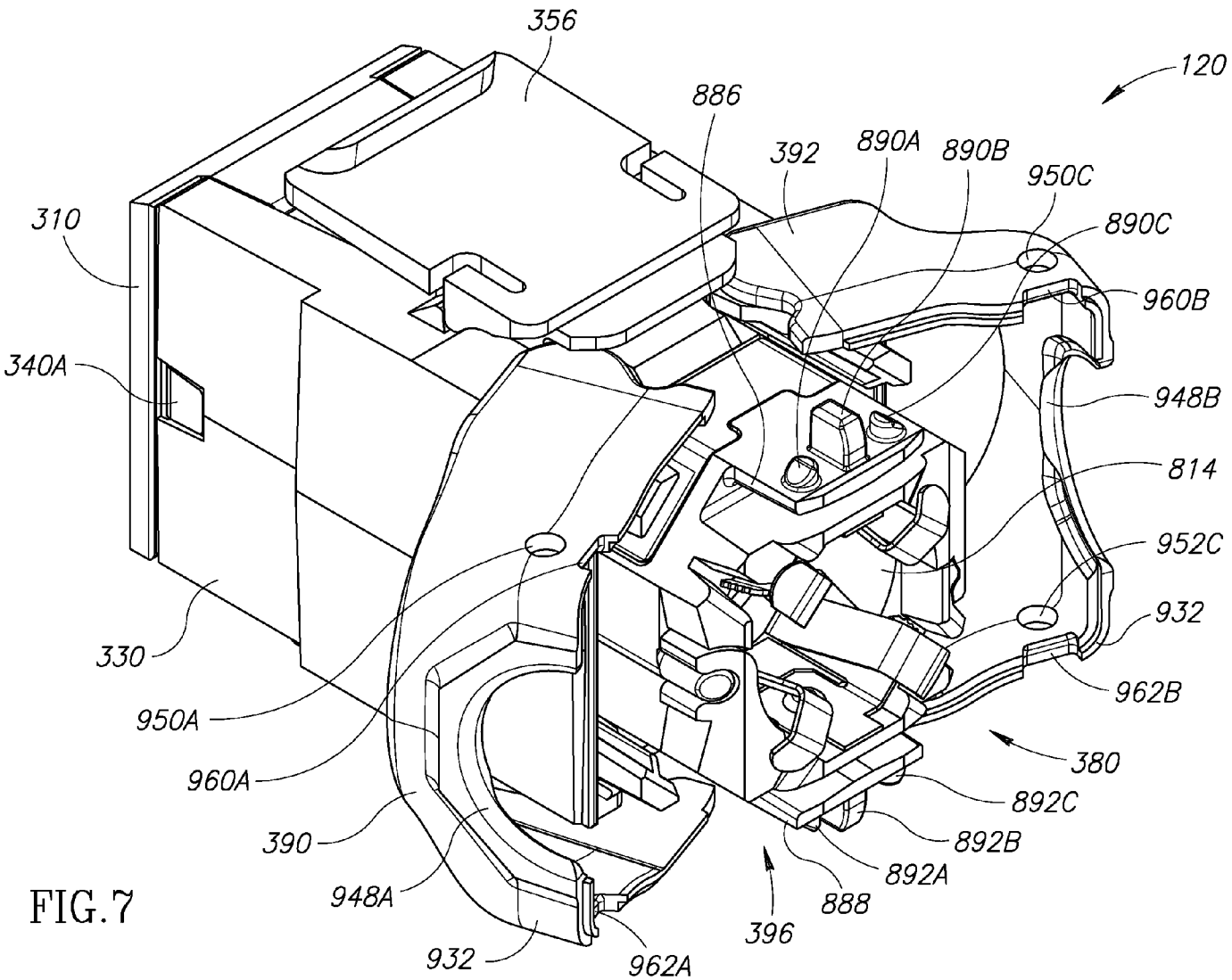
FIG. 7 is a perspective view of the rear of the outlet of FIG. 1 with its housing doors open.

FIG. 5 is a perspective view showing a front portion of the outlet 120, and FIGS. 6 and 7 are perspective views showing a rear portion of the outlet 120. The cable C1 terminated by the outlet 120 has been omitted from FIGS. 5-7. In the embodiment illustrated, the outlet 120 is constructed to comply with the RJ-45 standard.

Figure 8:
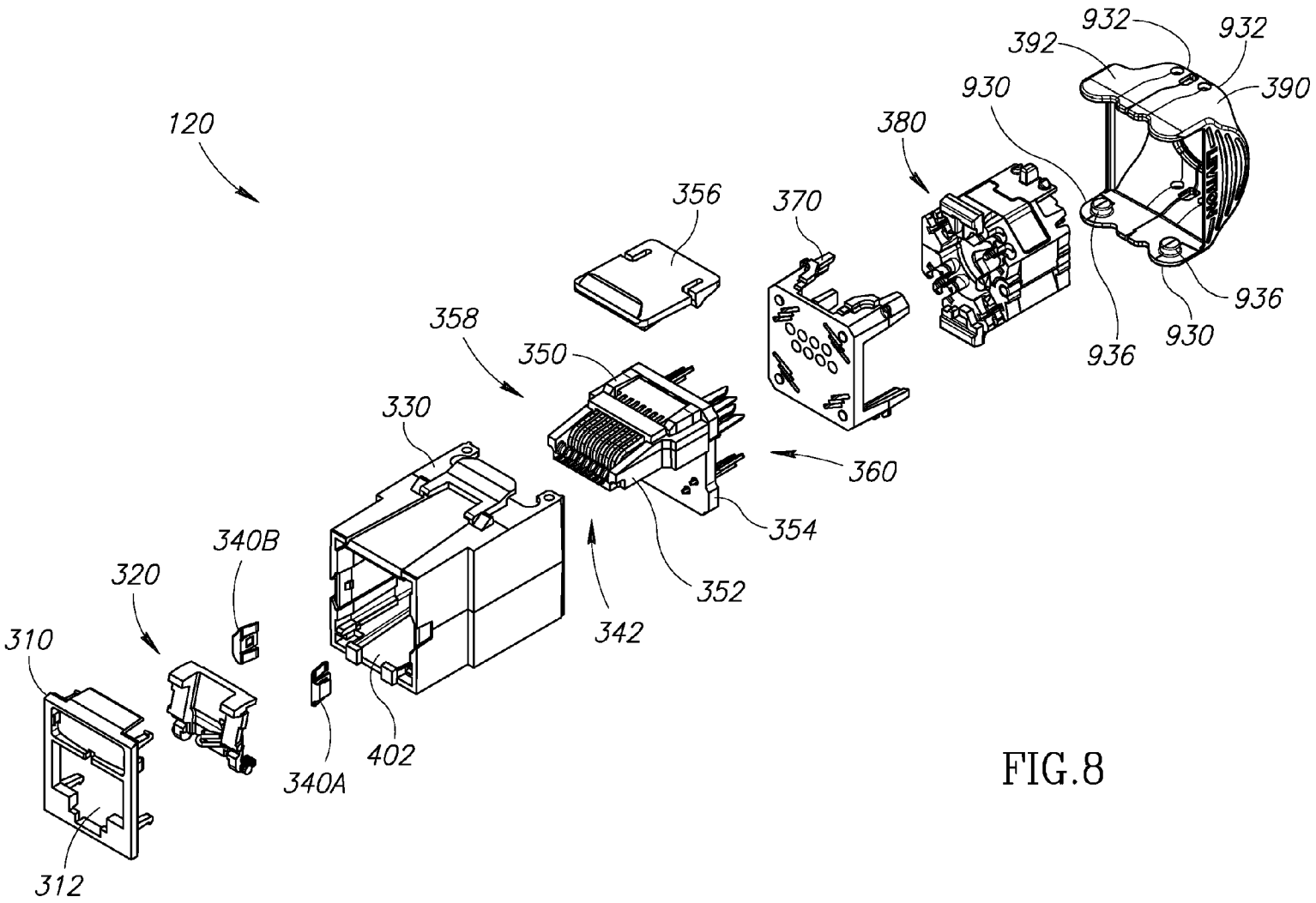
FIG. 8 is a first partially exploded perspective view of the outlet of FIG. 1.
Figure 9:
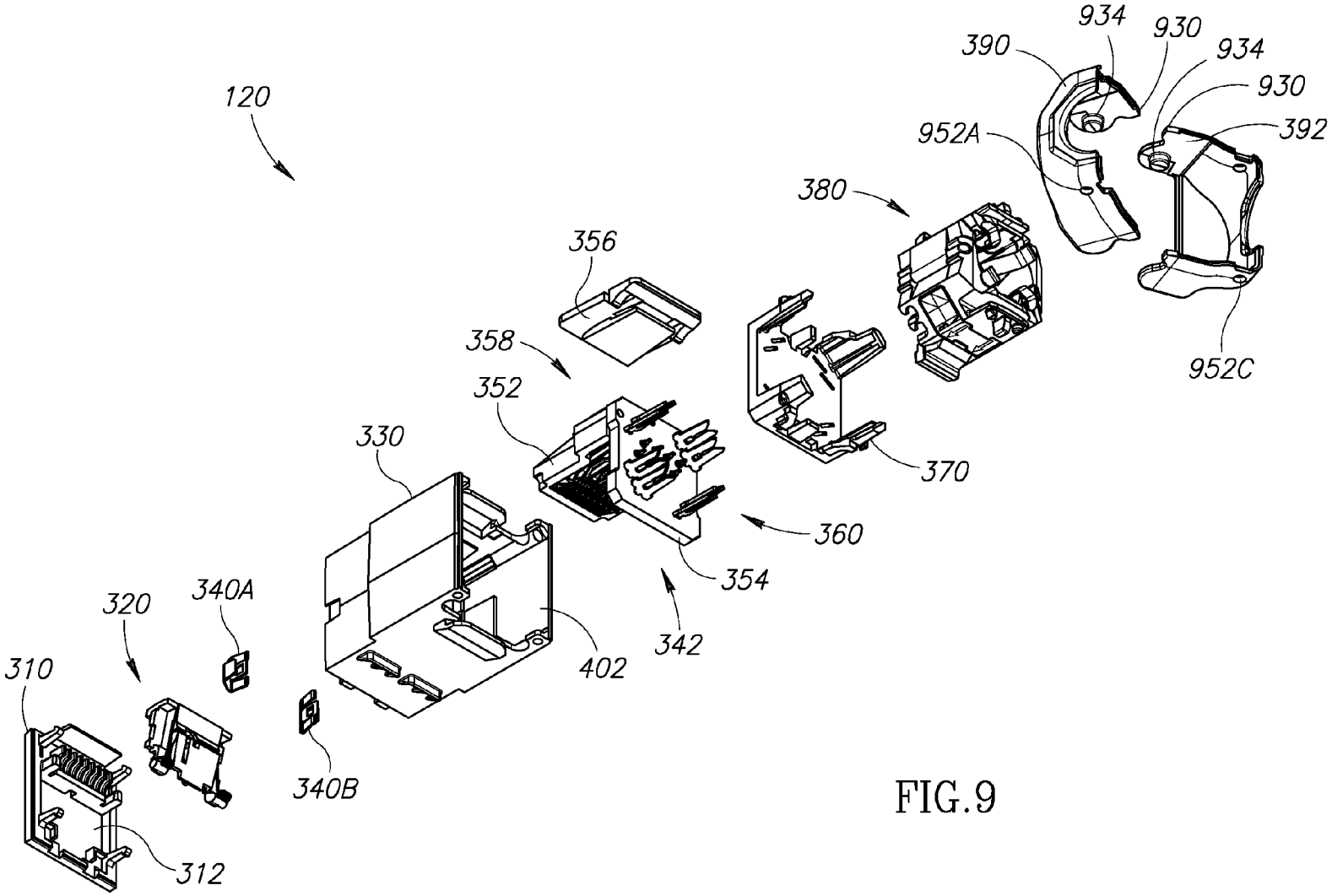
FIG. 9 is a second partially exploded perspective view of the outlet of FIG. 1.
Figure 10:
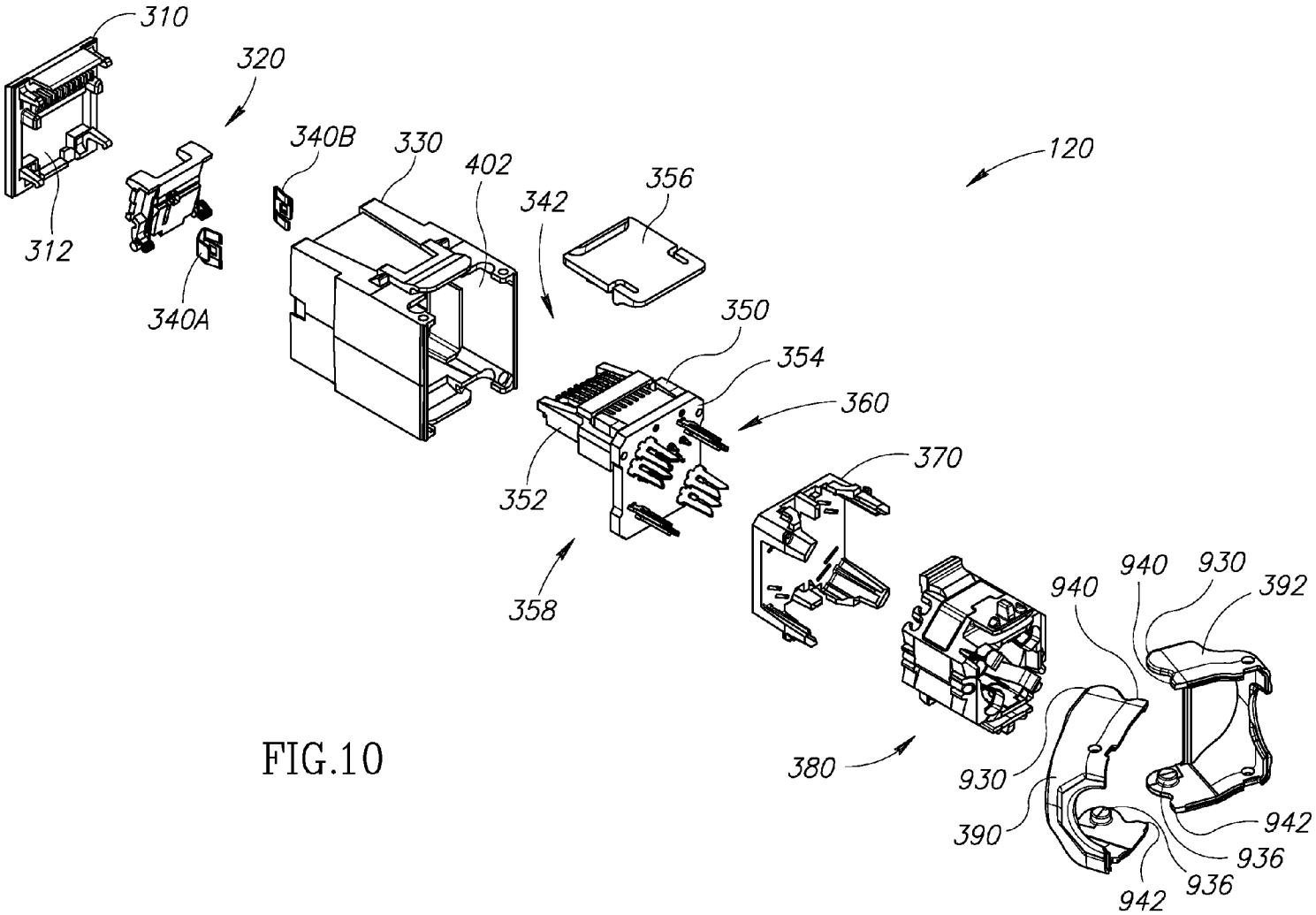
FIG. 10 is a third partially exploded perspective view of the outlet of FIG. 1.

FIGS. 8-10 are exploded perspective views of the outlet 120.

Referring to FIGS. 8-10, the outlet 120 includes a face plate 310, a locking shutter subassembly 320, a housing 330, one or more ground springs 340A and 340B, a plurality of resilient tines or outlet contacts 342, an optional spring assembly 350, a contact positioning member 352, a substrate 354 (depicted as a printed circuit board), an optional clip or latch member 356, a plurality of wire contacts 360, a guide sleeve 370, a wire manager 380, and housing doors 390 and 392. As may be viewed in FIG. 20, the outlet contacts 342 may include the outlet contacts J1-J8. As may be viewed in FIG. 11, the wire contacts 360 may include eight wire contacts 361-368. Together the outlet contacts 342, the optional spring assembly 350, the contact positioning member 352, the substrate 354, and the wire contacts 360 may be characterized as forming a first embodiment of a contact subassembly 358 configured for use with the other components of the outlet 120, which include the face plate 310, the locking shutter subassembly 320, the housing 330, the ground springs 340A and 340B, the optional latch member 356, the guide sleeve 370, the wire manager 380, and the housing doors 390 and 392.

Referring to FIGS. 8-10, the outlet 120 differs significantly from conventional RJ-45 type outlets in several ways. For example, as mentioned in the Background Section, debris and/or foreign objects (e.g., tools, fingers, etc.) may be readily received and/or easily inserted into the plug receiving opening of a conventional RJ-45 type outlet (not shown). In contrast, the locking shutter subassembly 320 of the outlet 120 helps prevent debris and objects other than the plug 100 (see FIGS. 1, 3, and 4) from entering (or being pushed into) a plug receiving opening 312 (formed in the face plate 310) of the outlet 120. The locking shutter subassembly 320 is configured to permit the plug 100 (see FIGS. 1, 3, and 4) to enter the plug receiving opening 312, and to prevent other objects (such as fingers) from being inserted inside the plug receiving opening 312 of the outlet 120.

As also mentioned in the Background Section, a conventional RJ-45 type outlet (not shown) includes a carrier or terminal block. In contrast, the outlet 120 omits the terminal block. Instead of a terminal block, the outlet 120 includes the guide sleeve 370, the wire manager 380, and the housing doors 390 and 392. The housing doors 390 and 392 each pivot with respect to the housing 330 between a closed position and an open position. Turning to FIG. 6, when the housing doors 390 and 392 are both in the closed position, they define an internal cavity 396 inside the outlet 120. Turning to FIG. 7, when the housing doors 390 and 392 are both in the open position, the wire manager 380 may be inserted into or removed from the internal cavity 396.

Referring to FIGS. 8-10, together the face plate 310, the housing 330, and the housing doors 390 and 392 house internal components of the outlet 120 (e.g., the locking shutter subassembly 320, the outlet contacts 342, the optional spring assembly 350, the contact positioning member 352, the substrate 354, the wire contacts 360, the guide sleeve 370, and the wire manager 380).

Face Plate

Figure 11:
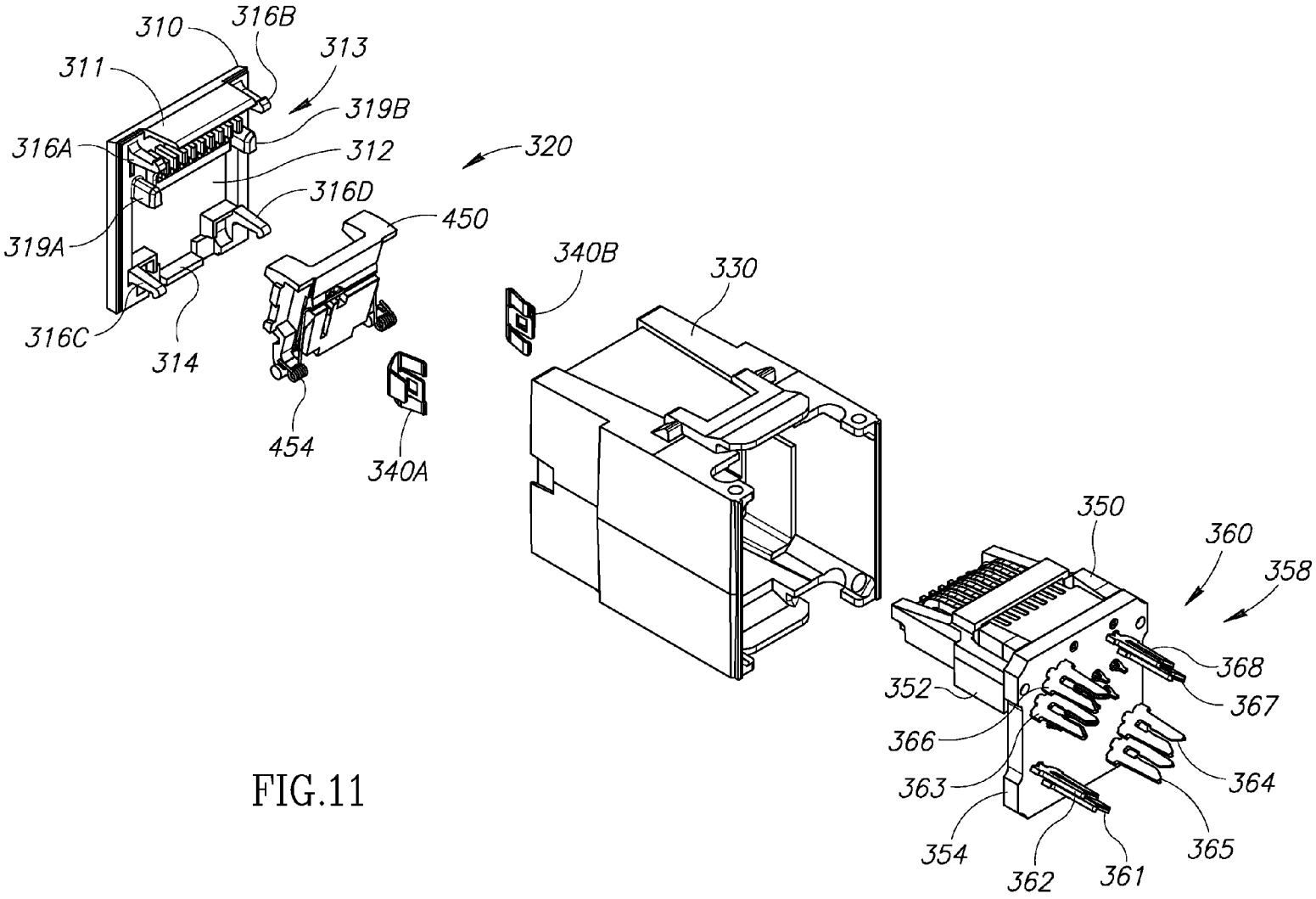
FIG. 11 is an enlargement of a portion of FIG. 10 omitting a latch member.

Referring to FIG. 11, as mentioned above, the plug receiving opening 312 is formed in the face plate 310. The shape of the plug receiving opening 312 corresponds to the cross-sectional shape of the forward portion 152 (see FIG. 3) of the plug 100. Thus, the plug receiving opening 312 is configured to permit the plug 100 to pass therethrough unobstructed. The face plate 310 includes a conventional lip 314 onto which the latch arm 160 of the plug 100 may latch. Thus, the plug 100 may be latched to the outlet 120 when the latch arm 160 engages the lip 314 of the face plate 310.

The face plate 310 is configured to be attached to the housing 330. In the embodiment illustrated, the face plate 310 includes a plurality of hooked members 316A-316D configured to grab or hook onto corresponding projections 318A-318D (see FIGS. 18A and 18B), respectively, formed in the housing 330. When hooked onto the projections 318A-318D, the hooked members 316A-316D couple (removably or permanently) the face plate 310 to the housing 330.

The face plate 310 includes rearwardly extending projections 319A and 319B positioned above the plug receiving opening 312. In the embodiment illustrated, the projection 319A is spaced apart from and positioned underneath the hooked member 316A. Similarly, the projection 319B is spaced apart from and positioned underneath the hooked member 316B.

Optionally, the face plate 310 may include an overhanging portion 311 positioned above the plug receiving opening 312. The overhanging portion 311 may rest upon the housing 330 when the outlet 120 is assembled. A plurality of dividers 313 may be positioned between the overhanging portion 311 and the plug receiving opening 312. When the outlet 120 is assembled, a different one of the dividers 313 may be positioned between adjacent ones of the outlet contacts J1-J8 (see FIG. 20) to help maintain the lateral positioning and/or spacing of the outlet contacts J1-J8 and their electrical isolation from one another.

The face plate 310 may be constructed from an electrically conductive and/or dielectric material.

Locking Shutter Subassembly

Figure 12:
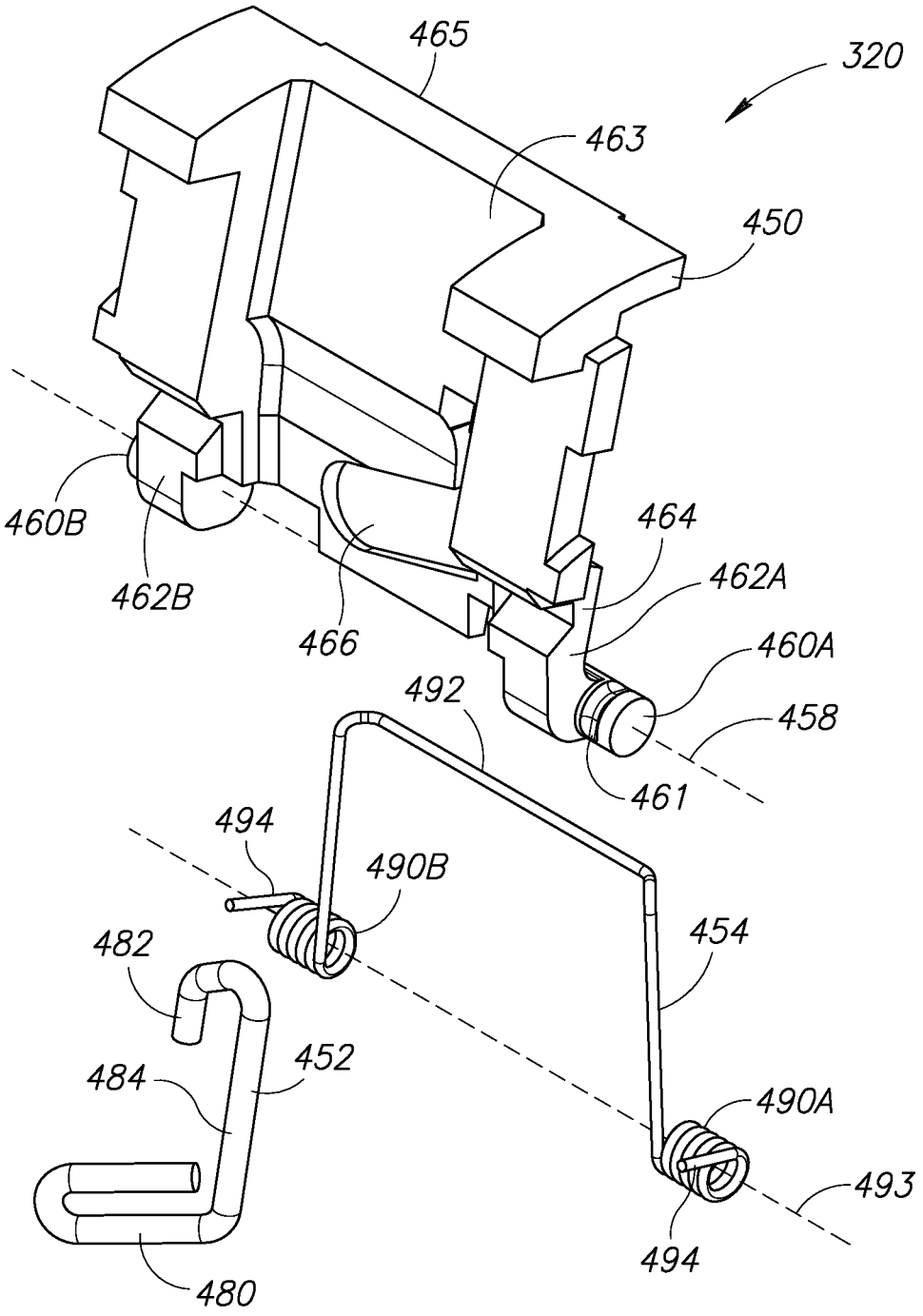
FIG. 12 is an exploded perspective view of a locking shutter subassembly of the outlet of FIG. 1 including the shutter door, a shutter lock member, and a biasing member.

As mentioned above, the locking shutter subassembly 320 helps prevent debris and objects other than the plug 100 (see FIGS. 1, 3, and 4) from entering (or being pushed into) the plug receiving opening 312 of the outlet 120. Turning to FIG. 12, the locking shutter subassembly 320 includes a shutter door 450, a shutter lock member 452, and at least one biasing member (e.g., a biasing member 454).

Referring to FIG. 5, the shutter door 450 is sized and shaped to cover (or close) the plug receiving opening 312 formed in the face plate 310 to prevent contaminants and/or objects other than the plug 100 (see FIGS. 1, 3, and 4) from being received inside the outlet 120. Returning to FIG. 12, the shutter door 450 is configured to pivot about a door pivot axis 458 with respect to the housing 330 (see FIG. 5) between a closed position (see FIGS. 5, 15A, 15B, 16A, 16B, and 17) and an open position (see FIGS. 15C and 16C). In the embodiment illustrated, pivot pins 460A and 460B are formed along a lower portion 464 of the shutter door 450. The pivot pins 460A and 460B extend along the door pivot axis 458. Each of the pivot pins 460A and 460B has a groove 461 that extends circumferentially at least partway around the pivot pin. In the embodiment illustrated, the pivot pins 460A and 460B extend outwardly from downwardly extending legs 462A and 462B, respectively.

Figure 13:
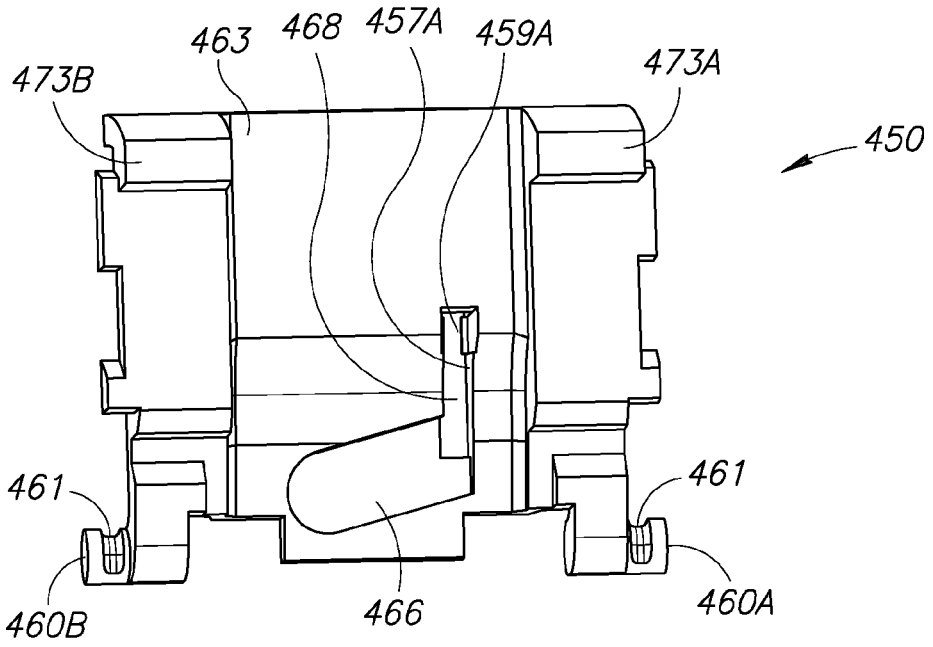
FIG. 13 is a front perspective view of the shutter door of the locking shutter subassembly of FIG. 12.
Figure 14:
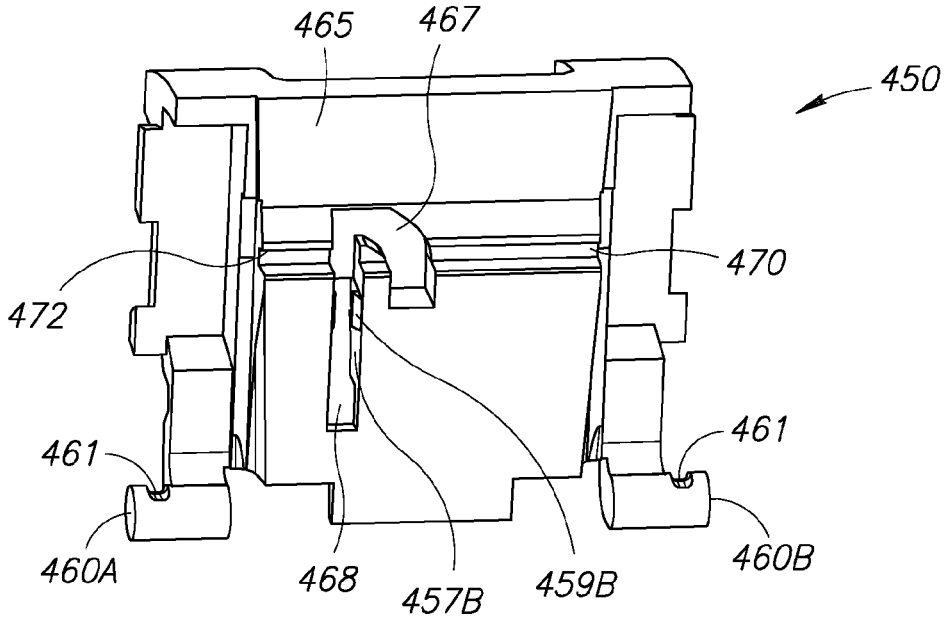
FIG. 14 is a rear perspective view of the shutter door of FIG. 13.

The shutter door 450 has a front facing portion 463 opposite a rearward facing portion 465. Referring to FIG. 13, a first recess 466 is formed in the front facing portion 463. Referring to FIG. 14, a second recess 467 is formed in the rearward facing portion 465. Referring to FIGS. 13 and 14, a through-hole or slot 468 extends at least partway into each of the first and second recesses 466 and 467. The slot 468 is defined between a pair of confronting inside surfaces 457A and 457B. Inwardly extending projections 459A and 459B extend inwardly from the inside surfaces 457A and 457B, respectively. Referring to FIG. 14, the rearward facing portion 465 also includes a third recess 470 having an upper inside surface 472. The third recess 470 intersects or overlaps the second recess 467. However, the second recess 467 is deeper than the third recess 470.

Referring to FIG. 5, the front facing portion 463 (see FIG. 13) may include one or more plug-engaging projections 473A and 473B that extend forwardly into the plug receiving opening 312 of the face plate 310. When the plug 100 (or another object) is inserted into the plug receiving opening 312, the forward facing portion 154 (see FIGS. 3 and 4) of the plug 100 presses against the plug-engaging projections 473A and 473B, and the portion 162 (see FIGS. 3 and 4) of the latch arm 160 (see FIGS. 3 and 4) of the plug 100 presses on the shutter lock member 452.

Referring to FIG. 12, the shutter lock member 452 has a switch portion 480, an arm portion 482, and an intermediate portion 484. In the embodiment illustrated, the shutter lock member 452 is a wire segment that has been bent to define the switch, arm, and intermediate portions 480, 482, and 484. However, this is not a requirement.

Figure 15A:
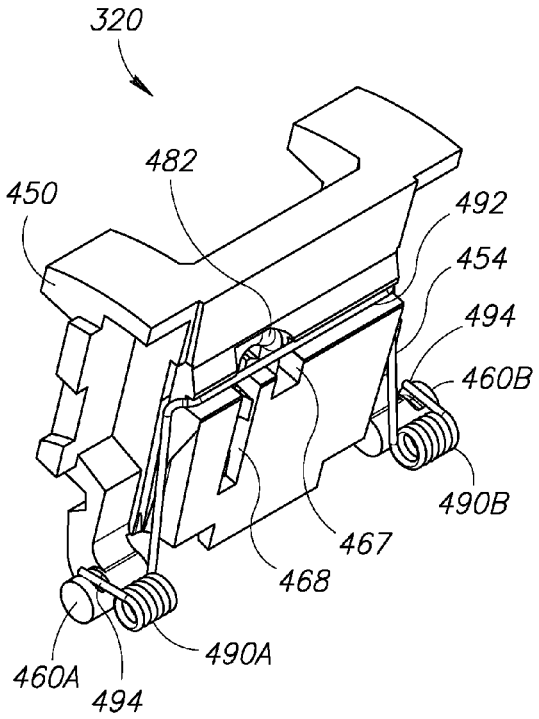
FIG. 15A is a first rear perspective view of the locking shutter subassembly of FIG. 12 with the shutter door in the closed position and the shutter lock member in a locked position.
Figure 15B:
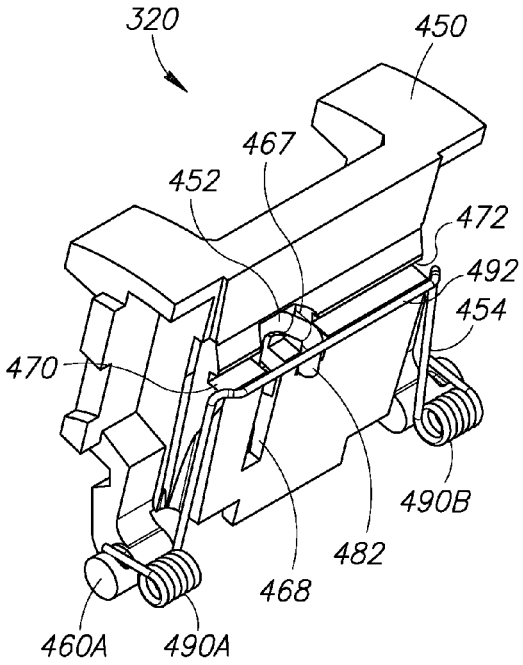
FIG. 15B is a second rear perspective view of the locking shutter subassembly of FIG. 12 with the shutter door in the closed position and the shutter lock member in an unlocked position.
Figure 15C:
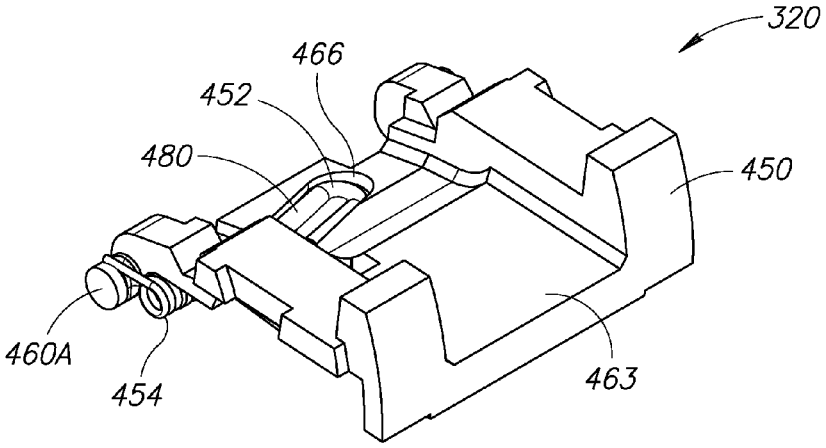
FIG. 15C is a third rear perspective view of the locking shutter subassembly of FIG. 12 with the shutter door in the open position and the shutter lock member in the unlocked position.
Figure 16A:
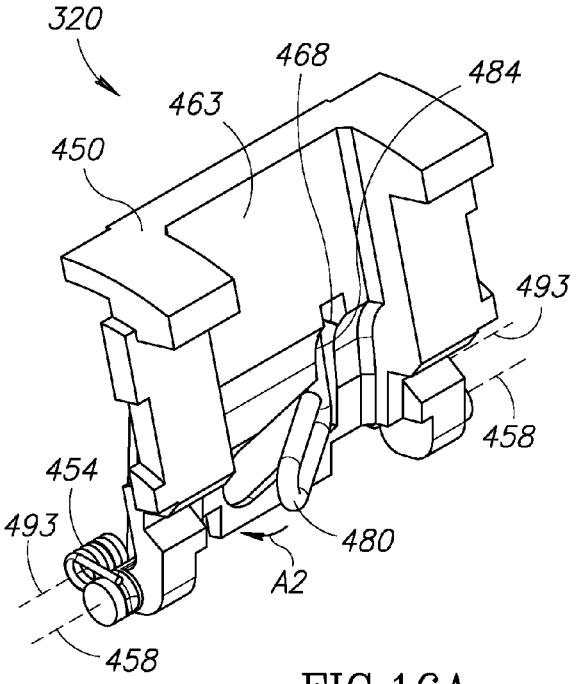
FIG. 16A is a first front perspective view of the locking shutter subassembly of FIG. 12 with the shutter door in the closed position and the shutter lock member in a locked position.
Figure 16B:
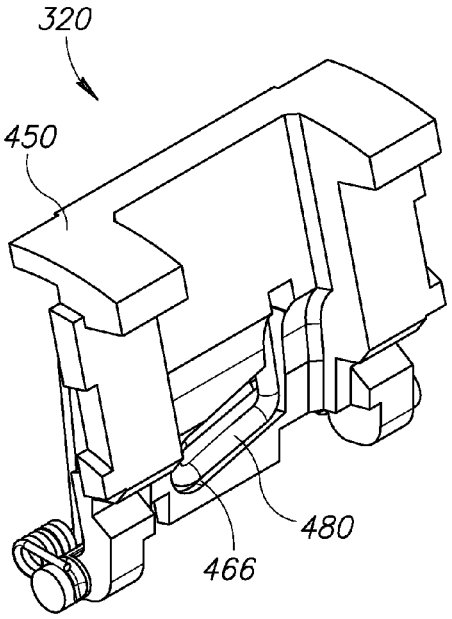
FIG. 16B is a second front perspective view of the locking shutter subassembly of FIG. 12 with the shutter door in the closed position and the shutter lock member in an unlocked position.
Figure 16C:
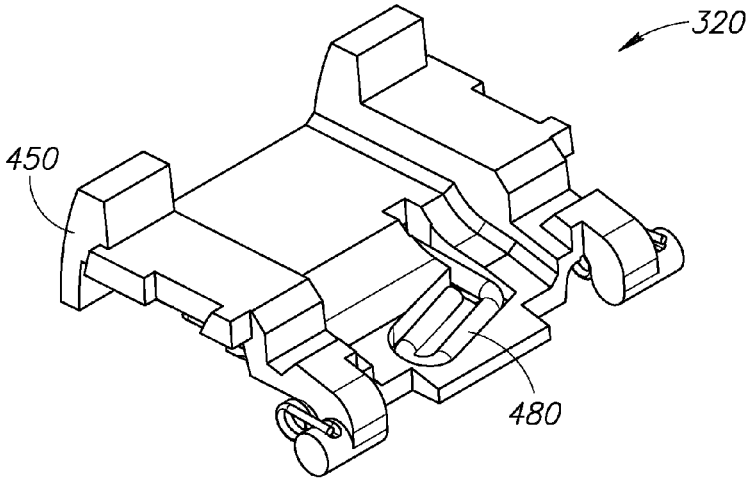
FIG. 16C is a third front perspective view of the locking shutter subassembly of FIG. 12 with the shutter door in the open position and the shutter lock member in the unlocked position.

The shutter lock member 452 is rotatable relative to the shutter door 450 between a locked position (see FIGS. 5, 15A, 16A, and 17), and an unlocked position (see FIGS. 15B, 15C, 16B, and 16C). Referring to FIG. 16A, in the locked position, the switch portion 480 extends forwardly from the front facing portion 463 of the shutter door 450, the intermediate portion 484 is positioned inside the slot 468 between the inside surfaces 457A and 457B (see FIGS. 13 and 14), and, referring to FIG. 15A, the arm portion 482 is positioned inside the second recess 467. As shown in FIGS. 15A and 16A, when the shutter door 450 is in the closed position, the shutter lock member 452 may be in the locked position. Further, as shown in FIGS. 15B and 16B, when the shutter door 450 is in the closed position, the shutter lock member 452 may rotated (in a direction indicated by an arrow A2) into the unlocked position.

Referring to FIG. 16B, when the switch portion 480 is pressed upon (e.g., by the portion 162 of the latch arm 160 of the plug 100 illustrated in FIGS. 3 and 4), the shutter lock member 452 rotates relative to the shutter door 450 until the switch portion 480 is received (at least partially) inside the first recess 466. At the same time, referring to FIG. 15B, the arm portion 482 at least partially exits the second recess 467 thereby positioning the shutter lock member 452 in the unlocked position.

Referring to FIG. 12, the biasing member 454 applies a biasing force to the rearward facing portion 465 of the shutter door 450 that biases the shutter door 450 toward the closed position (see FIGS. 5, 15A, 15B, 16A, 16B, and 17). In the embodiment illustrated, the biasing member 454 includes a pair of spaced apart coil springs 490A and 490B connected together by a U-shaped (connecting) portion 492. The U-shaped portion 492 rotates or pivots relative to the coil springs 490A and 490B about a pivot axis 493. By way of a non-limiting example, the biasing member 454 may be constructed from metal wire, plastic, and the like.

Each of the coil springs 490A and 490B has a forwardly extending free end portion 494. The free end portion 494 of the coil spring 490A is configured to be received inside the groove 461 formed in the pivot pin 460A, and the free end portion 494 of the coil spring 490B is configured to be received inside the groove 461 formed in the pivot pin 460B.

Figure 17:
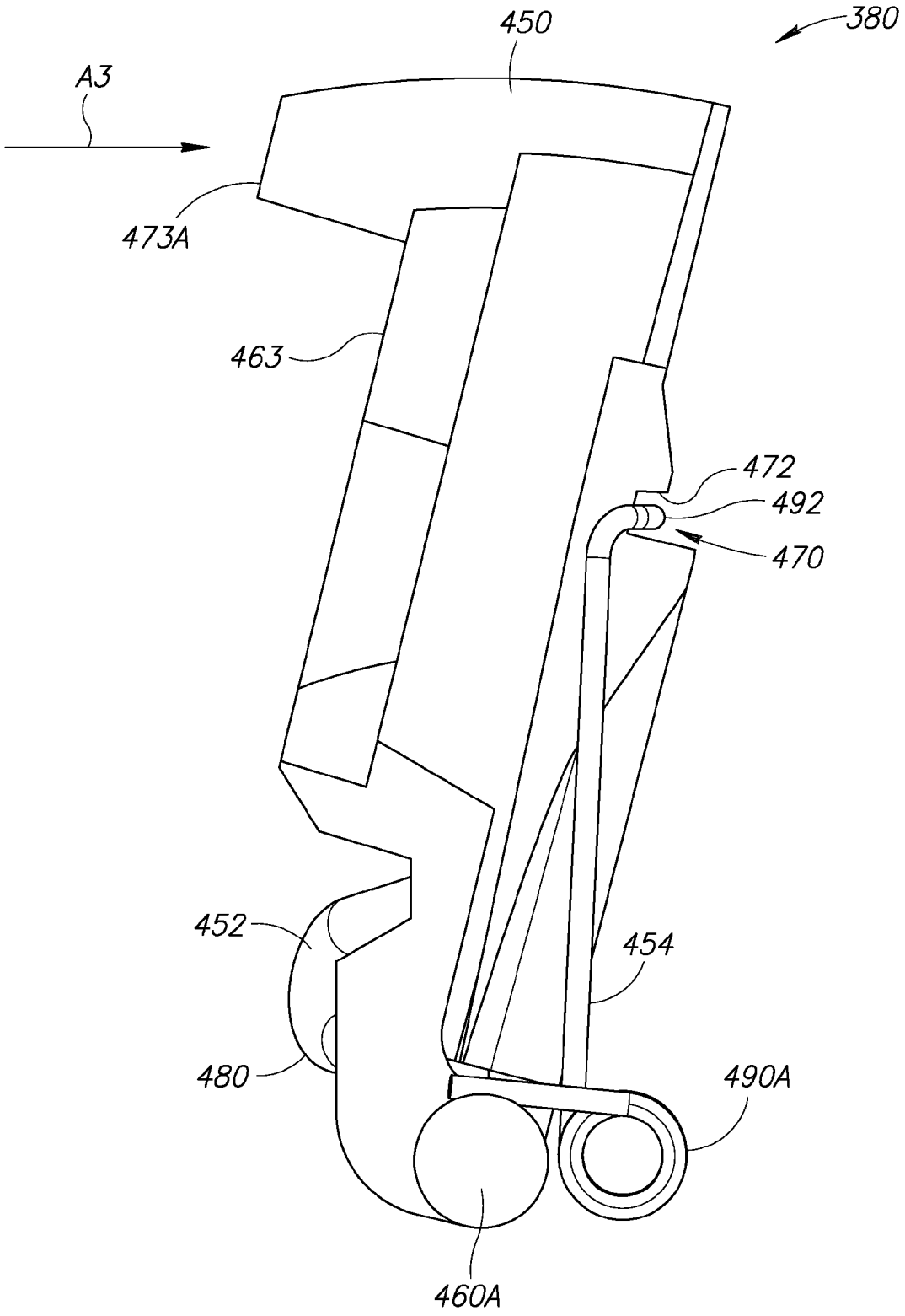
FIG. 17 is a side view of the locking shutter subassembly of FIG. 12 with the shutter door in the closed position and the shutter lock member in a locked position.

Referring to FIG. 5, the biasing member 454 (see FIG. 12) is positioned behind the shutter door 450 inside the housing 330. Referring to FIGS. 15A and 17, when the shutter door 450 is in the closed position and the shutter lock member 452 is in the locked position, the coil springs 490A and 490B bias the U-shaped portion 492 into the third recess 470 of the shutter door 450 with the U-shaped portion 492 positioned adjacent to the upper inside surface 472 of the third recess 470. In this configuration, the shutter door 450 is maintained in the closed position by the biasing member 454. As may be seen in FIG. 16A, the door pivot axis 458 is offset with respect to the pivot axis 493 of the U-shaped portion 492 (see FIG. 15A) of the biasing member 454. As a result of this offset, referring to FIG. 17, pressing inwardly (in a direction indicated by an arrow A3) on the front facing portion 463 (e.g., on the plug-engaging projections 473A and 473B) of the shutter door 450 merely presses the upper inside surface 472 (see FIG. 15B) of the third recess 470 (see FIG. 15B) against the U-shaped portion 492 of the biasing member 454 but does not translate sufficient force in the direction of rotation about the pivot axis 493 (see FIGS. 12 and 16A) of the U-shaped portion 492 to allow the shutter door 450 to be rotated from the closed position to the open position. Thus, the biasing member 454 locks the shutter door 450 in the closed position when the shutter lock member 452 is in the locked position.

As shown in FIG. 15B, when the shutter lock member 452 is rotated (in the direction indicated by the arrow A2 illustrated in FIG. 16A) from the locked position to the unlocked position, the arm portion 482 pushes the U-shaped portion 492 of the biasing member 454 away from the third recess 470 until the U-shaped portion 492 is no longer adjacent the upper inside surface 472 of the third recess 470. Thus, pressing inwardly (in the direction indicated by the arrow A3 illustrated in FIG. 17) on the front facing portion 463 (e.g., on the plug-engaging projections 473A and 473B) of the shutter door 450 no longer presses the upper inside surface 472 of the third recess 470 against the U-shaped portion 492 of the biasing member 454. Instead, pressing inwardly on the front facing portion 463 of the shutter door 450 causes the shutter door 450 to pivot about the door pivot axis 458 (see FIGS. 12 and 16A) from the closed position to the open position. In other words, the shutter lock member 452 allows the shutter door 450 to be pivoted into the open position when the shutter lock member 452 is in the unlocked position.

The shutter door 450 cannot cause the shutter lock member 452 to transition from the locked to the unlocked position. Instead, an inwardly directed force must be applied directly to the switch portion 480 of the shutter lock member 452 to cause this transition.

Referring to FIG. 12, when the shutter door 450 is in the open position (see FIGS. 15C and 16C), the U-shaped portion 492 of the biasing member 454 presses against the shutter lock member 452 and/or the rearward facing portion 465 of the shutter door 450. Thus, when insufficient force is applied to the front facing portion 463 to maintain the shutter door 450 in the open position, the biasing member 454 returns the shutter door 450 to the closed position. Further, if insufficient force is applied to the switch portion 480 of the shutter lock member 452, the U-shaped portion 492 of the biasing member 454 presses against the arm portion 482 pressing the arm portion 482 into the second recess 467 (see FIG. 14) and returning the shutter lock member 452 to the unlocked position.

Referring to FIGS. 4 and 5, when the plug 100 is inserted into the outlet 120, the portion 162 of the latch arm 160 of the plug 100 first presses on the switch portion 480 of the shutter lock member 452 causing the shutter lock member 452 to rotate from the locked position to the unlocked position. Then, the portion 162 and/or the forward facing portion 154 of the plug 100 presses on the shutter door 450. If the plug 100 is inserted into the outlet 120 with sufficient force to overcome any biasing force exerted by the biasing member 454 (see FIG. 12), the shutter door 450 pivots from the closed position to the open position. Then, the plug 100 is latched inside the outlet 120 by the latch arm 160 to maintain the shutter door 450 in the open position. Thus, when the plug 100 is inserted into the outlet 120, the plug 100 triggers the shutter lock member 452 to remove the U-shaped portion 492 (see FIG. 17) from the third recess 470 (see FIG. 17), and pushes the shutter door 450 inwardly allowing the plug contacts P1-P8 (see FIG. 3) to engage the outlet contacts J1-J8 (see FIG. 20), respectively, and allows the latch arm 160 to be latched to the lip 314 (see FIG. 11) of the face plate 310.

When the latch arm 160 is unlatched from the lip 314 (see FIG. 11) of the housing 330, and the plug 100 is removed from the outlet 120, the biasing member 454 (see FIG. 17) biases the shutter door 450 toward the closed position. Further, referring to FIG. 15B, the U-shaped portion 492 of the biasing member 454 presses the arm portion 482 into the second recess 467 thereby returning the shutter lock member 452 to the unlocked position. Thus, when the plug 100 is removed, the shutter door 450 returns to the closed position, and the shutter lock member 452 returns to the locked position.

As mentioned above, the locking shutter subassembly 320 is configured to permit the plug 100 to enter the outlet 120, and to prevent other objects (such as fingers) from being inserted inside the outlet 120. The locking shutter subassembly 320 remains "locked" against the insertion of other objects (e.g., fingertips, fingernails, pencil erasers, other blunt objects, and the like) into the outlet 120. Thus, the locking shutter subassembly 320 may be configured to provide a factory configurable solution that protects the outlet 120 against contaminants (such as dust), and the insertion of objects other than the plug 100.

Housing

Figure 18A:
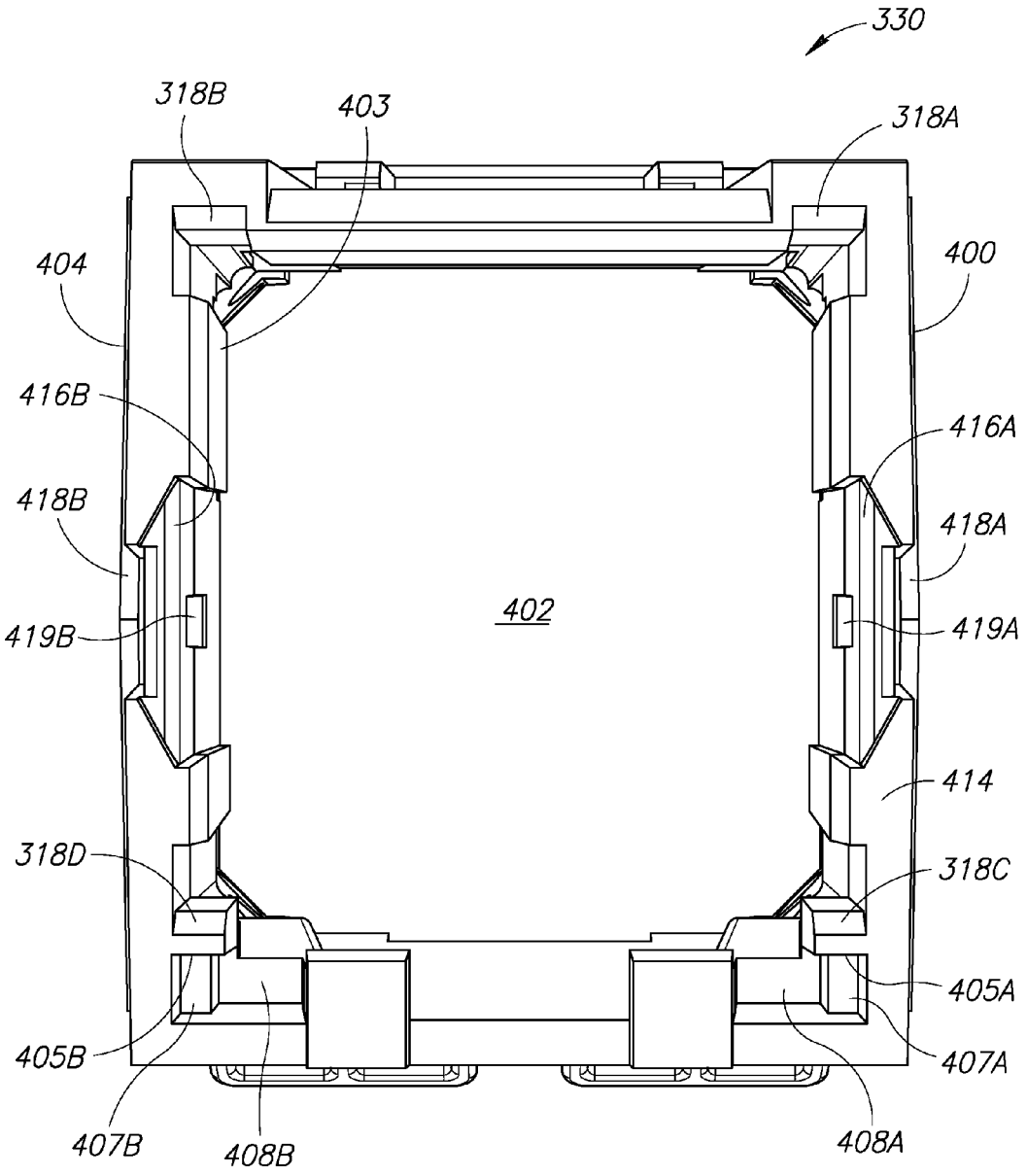
FIG. 18A is a front view of a housing of the outlet of FIG. 1.

Referring to FIG. 18A, the housing 330 is constructed from an electrically conductive material, such as metal. The housing 330 includes a sidewall 400 defining an interior receptacle 402. The sidewall 400 has an inwardly facing surface 403 adjacent the interior receptacle 402, and an exterior surface 404 opposite the inwardly facing surface 403.

The sidewall 400 includes a frontward opening portion 414 in communication with the interior receptacle 402. The projections 318A-318D are formed in the frontward opening portion 414 of the sidewall 400 and extend inwardly from the inwardly facing surface 403 into the interior receptacle 402.

The frontward opening portion 414 includes recesses 408A and 408B configured to receive the pivot pins 460A and 460B, respectively, and the coil springs 490A and 490B, respectively. The projections 318C and 318D partially overhang the recesses 408A and 408B, respectively. The projection 318C has a lower surface 405A positioned above the recess 408A, and the projection 318D has a lower surface 405B positioned above the recess 408B. Optionally, a stop wall 407A may extend from the inwardly facing surface 403 of the sidewall 400 partway into the recess 408A, and a stop wall 407B may extend from the inwardly facing surface 403 of the sidewall 400 partway into the recess 408B.

Inside the recess 408A, the pivot pin 460A is positioned in front of the stop wall 407A, and the coil spring 490A is positioned behind the pivot pin 460A next to the stop wall 407A. The free end portion 494 of the coil spring 490A extends forwardly above the pivot pin 460A and optionally may extend into the groove 461 formed in the pivot pin 460A. Inside the recess 408A, the free end portion 494 may press upwardly against the lower surface 405A of the projection 318C. The grooves 461 allow the pivot pin 460A to rotate freely relative to the coil spring 490A.

Inside the recess 408B, the pivot pin 460B is positioned in front of the stop wall 407B, and the coil spring 490B is positioned behind the pivot pin 460B next to the stop wall 407B. The free end portion 494 of the coil spring 490B extends forwardly above the pivot pin 460B and optionally may extend into the groove 461 formed in the pivot pin 460B. Inside the recess 408B, the free end portion 494 may press upwardly against the lower surface 405B of the projection 318D. The grooves 461 allow the pivot pin 460B to rotate freely relative to the coil spring 490B.

Opposite sides of the frontward opening portion 414 include recesses 416A and 416B formed in the inwardly facing surface 403 of the sidewall 400, and recesses 418A and 418B formed in the exterior surface 404 of the sidewall 400. The recesses 416A and 416B are aligned with the recesses 418A and 418B, respectively. Inwardly extending tabs 419A and 419B are positioned in the recesses 416A and 416B, respectively.

Figure 18B:
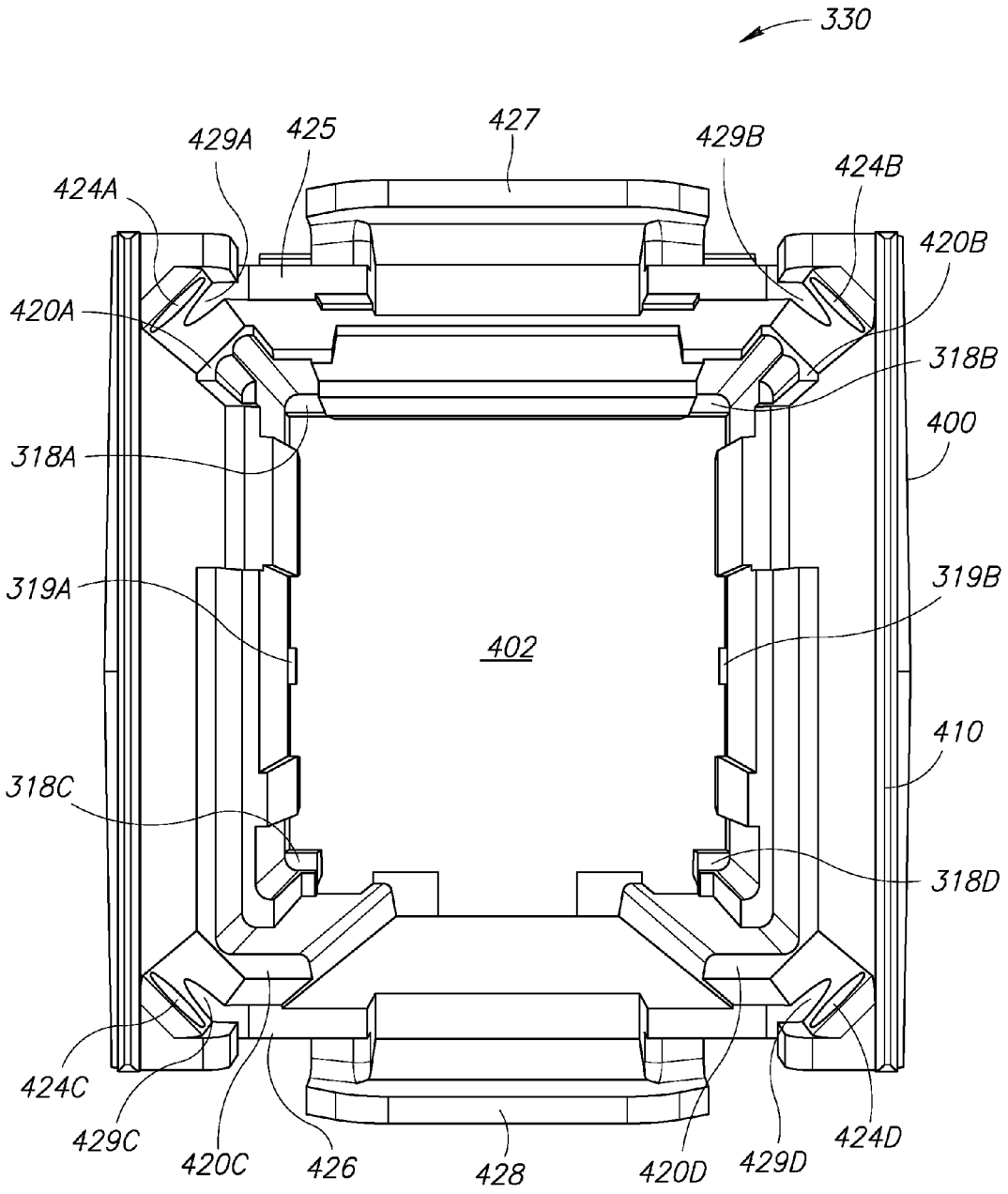
FIG. 18B is a rear view of the housing of FIG. 18A.

As may best be viewed in FIG. 18B, which provides an enlarged view of the backside of the housing 330, the sidewall 400 also includes a rearward opening portion 410 opposite the frontward opening portion 414 (see FIG. 18A). The rearward opening portion 410 is in communication with the interior receptacle 402.

The substrate 354 is received inside the receptacle 402 through the rearward opening portion 410 (see FIGS. 8-10). One or more projections or stop walls 420A-420D are formed in the sidewall 400 and extend into the receptacle 402. The substrate 354 abuts the stop walls 420A-420D inside the receptacle 402. The stop walls 420A-420D help maintain the substrate 354 in a desired position inside the receptacle 402.

The sidewall 400 includes a plurality of openings 424A-424D, which in the embodiment illustrated are implemented as through-holes. The openings 424A-424D are spaced inwardly from the rearward opening portion 410. In the embodiment illustrated, the rearward opening portion 410 has a generally rectangular cross-sectional shape and the openings 424A-424D are positioned at or near the corners of the rectangular cross-sectional shape.

The sidewall 400 has an upper portion 425 opposite a lower portion 426. An upper door gripping member 427 extends upwardly from the upper portion 425, and a lower door gripping member 428 extends downwardly from the lower portion 426. The upper door gripping member 427 is positioned between first and second contoured recesses 429A and 429B, and the lower door gripping member 428 is positioned between third and fourth contoured recesses 429C and 429D.

Turning to FIGS. 8-10, when the housing 330, the substrate 354, the guide sleeve 370, the wire manager 380, and the housing doors 390 and 392 are assembled together, the substrate 354 is sandwiched between the stop walls 420A-420D (see FIG. 18B) of the housing 330 and the guide sleeve 370 and held in place against the stop walls 420A-420D by the guide sleeve 370, the wire manager 380, and the housing doors 390 and 392.

Ground Springs

Figure 19:
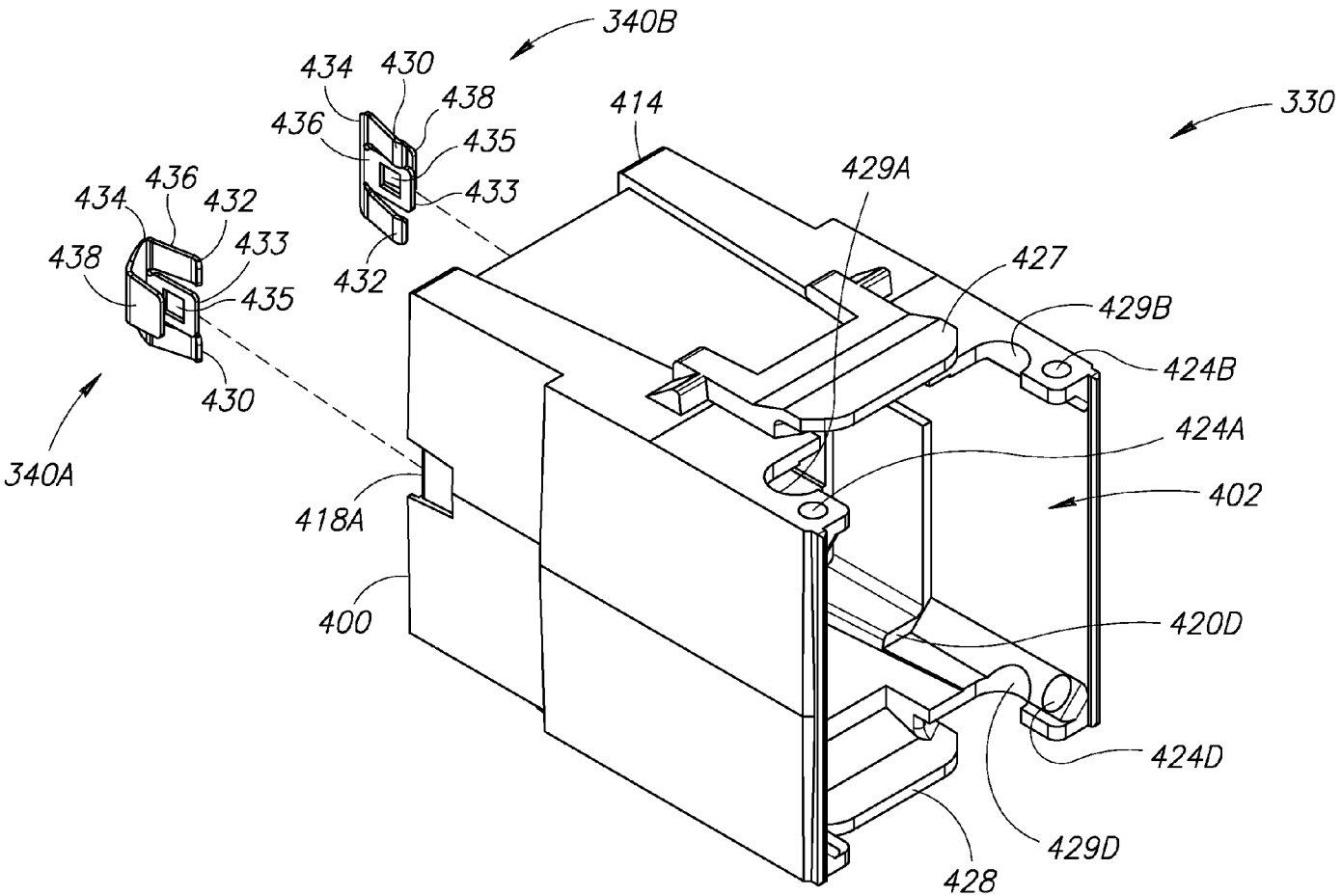
FIG. 19 is a perspective view of the housing and ground springs of the outlet of FIG. 1.

Referring to FIG. 1, as mentioned above, the drain wire PDW, the cable shield 140P, and/or the optional pair shields PPS1-PPS4 of the cable C2 may be electrically connected to the housing 150 of the plug 100. Referring to FIG. 19, the ground springs 340A and 340B are each constructed from an electrically conductive material and electrically connect the housing 330 of the outlet 120 with the housing 150 (see FIGS. 1, 3, and 4) of the plug 100. Thus, the drain wire PDW, the cable shield 140P, and/or the optional pair shields PPS1-PPS4 are electrically connected to the housing 330 of the outlet 120 by the ground springs 340A and 340B.

The ground springs 340A and 340B clip to opposite sides of the frontward opening portion 414 of the housing 330 and extend into the interior receptacle 402. Referring to FIGS. 8-10, when the plug 100 (see FIGS. 1, 3, and 4) enters the interior receptacle 402 through the plug receiving opening 312 (formed in the face plate 310), one or both of the ground springs 340A and 340B contact the housing 150 of the plug 100 and form an electrical connection therewith.

Referring to FIG. 19, the ground springs 340A and 340B may be substantially identical to one another. In the embodiment illustrated, the ground springs 340A and 340B each include an interior portion 436 connected to an exterior portion 438 by a bent portion 434. The interior portion 436 includes fingers 430 and 432 that extend inwardly into the interior receptacle 402, and a grip portion 433 configured to be received inside one of the recesses 416A and 416B (see FIG. 18A) of the housing 330. The exterior portion 438 is configured to be received inside one of the recesses 418A and 418B (see FIG. 18A) of the housing 330. Together, the grip portion 433 and the exterior portion 438 grip the sidewall 400 of the housing 330. In other words, the grip portions 433 of the ground springs 340A and 340B are configured to be received inside the recesses 416A and 416B (see FIG. 18A), respectively, and the exterior portions 438 of the ground springs 340A and 340B are configured to be received inside the recesses 418A and 418B (see FIG. 18A), respectively.

The grip portions 433 of the ground springs 340A and 340B each include an aperture 435. The aperture 435 of the ground spring 340A is configured to receive the tab 419A (see FIG. 18A) when the grip portion 433 of the ground spring 340A is received inside the recess 416A (see FIG. 18A). Similarly, the aperture 435 of the ground spring 340B is configured to receive the tab 419B (see FIG. 18A) when the grip portion 433 of the ground spring 340B is received inside the recess 416B (see FIG. 18A). Engagement between the apertures 435 of the ground springs 340A and 340B and the tabs 419A and 419B, respectively, help maintain the ground springs 340A and 340B, respectively, clipped to the sidewall 400 in desired positions.

Outlet Contacts

Figure 20:
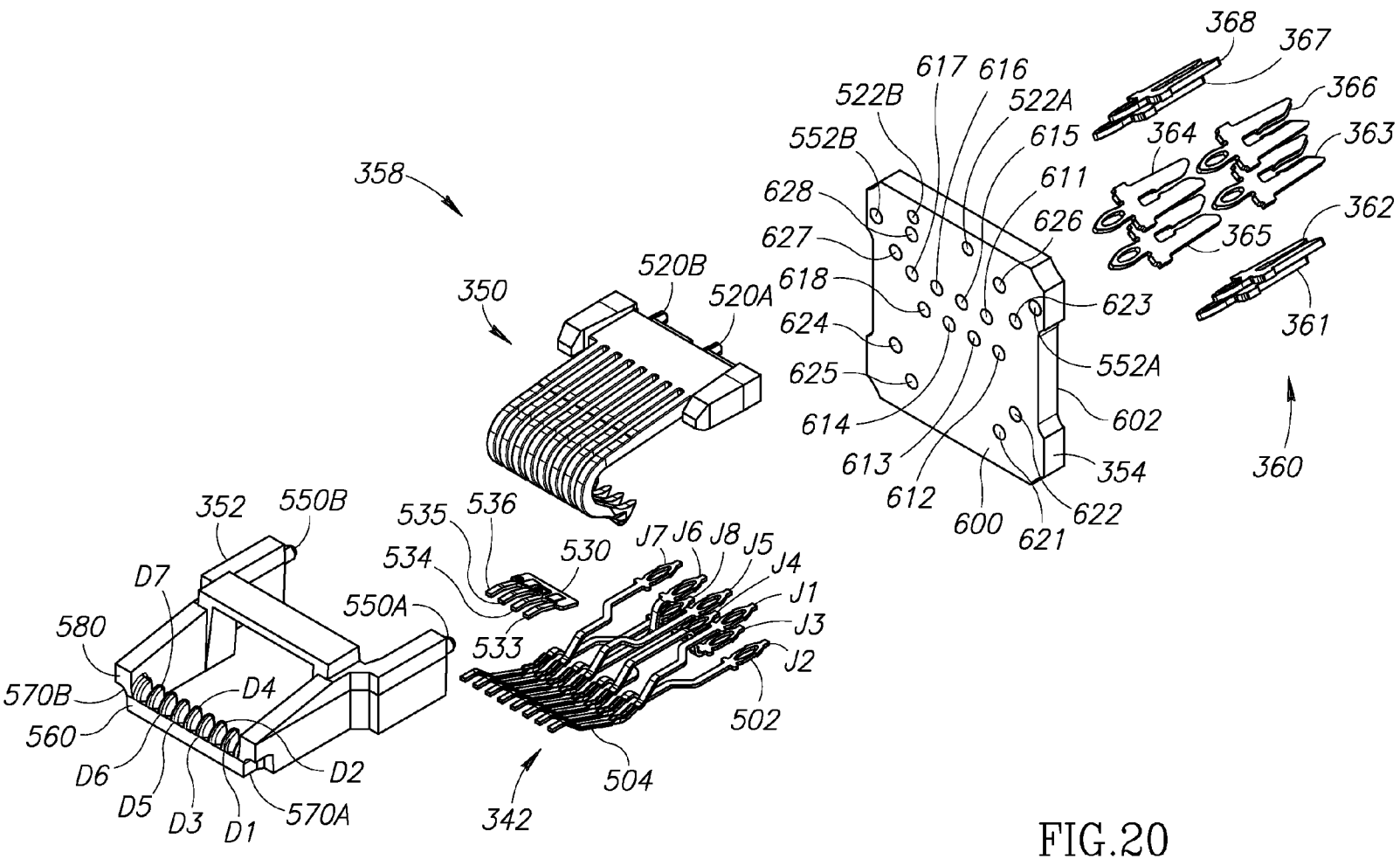
FIG. 20 is an exploded perspective view of a contact positioning member, an optional spring assembly, an optional flexible printed circuit board, outlet contacts, a substrate, and wire contacts of the outlet of FIG. 1.

Referring to FIG. 20, each of the outlet contacts J1-J8 has a first end portion 502 configured to be connected to the substrate 354, and a second free end portion 504 opposite the first end portion 502. The second free end portions 504 are arranged in the interior receptacle 402 (see FIGS. 18A and 18B) of the housing 330 to contact the plug contacts P1-P8 (see FIG. 3), respectively, of the plug 100 (see FIG. 3) when the plug is inserted into the outlet 120.

While in the embodiment illustrated the outlet contacts 342 include the eight individual outlet contacts J1-J8 that correspond to the eight plug contacts P1-P8 (see FIG. 3), respectively, through application of ordinary skill in the art to the present teachings, embodiments including different numbers of outlet contacts (e.g., 4, 6, 10, 12, 16, etc.) may be constructed for use with plugs having different numbers of plug contacts.

Spring Assembly

The optional spring assembly 350 helps position the outlet contacts J1-J8 to contact the plug contacts P1-P8 (see FIG. 3), respectively, when the plug 100 (see FIG. 3) is inserted into the outlet 120. While described as being an assembly, the spring assembly 350 may be implemented as a single unitary body. Exemplary suitable structures for implementing the optional spring assembly 350 are described in U.S. Pat. Nos. 6,641,443, 6,786,776, 7,857,667, and 8,425,255. Further, Leviton Manufacturing Co., Inc. manufactures and sells communication outlets incorporating Retention Force Technology ("RFT") suitable for implementing the spring assembly 350.

The spring assembly 350 biases the outlet contacts J1-J8 against the contact positioning member 352. In the embodiment illustrated, the spring assembly 350 is configured to at least partially nest inside the contact positioning member 352. However, this is not a requirement. The spring assembly 350 may be constructed from a dielectric or non-conductive material (e.g., plastic).

The spring assembly 350 may be mounted to the substrate 354 in a position adjacent the outlet contacts J1-J8. In the embodiment illustrated, the spring assembly 350 has a pair of protrusions 520A and 520B configured to be inserted into apertures 522A and 522B, respectively, in the substrate 354.

Depending upon the implementation details, the centermost outlet contacts J3, J4, J5, and J6 may be connected to an optional flexible printed circuit board ("PCB") 530 having crosstalk attenuating or cancelling circuits formed thereon configured to provide crosstalk compensation. The flexible PCB 530 may include contacts 533, 534, 535, and 536 configured to be soldered to the centermost outlet contacts J3, J4, J5, and J6, respectively.

Contact Positioning Member

Referring to FIG. 20, the contact positioning member 352 may be mounted to the substrate 354 in a position adjacent the outlet contacts J1-J8 and the spring assembly 350. In the embodiment illustrated, the contact positioning member 352 has a pair of protrusions 550A and 550B configured to be inserted into apertures 552A and 552B, respectively, in the substrate 354.

In the embodiment illustrated, the contact positioning member 352 includes a front portion 580 with a transverse member 560. The transverse member 560 includes a plurality of upwardly extending dividers D1-D7 configured to fit between adjacent ones of the outlet contacts J1-J8 and help maintain the lateral positioning and/or spacing of the outlet contacts J1-J8 and their electrical isolation from one another. The spring assembly 350 biases the outlet contacts J1-J8 against the transverse member 560 of the contact positioning member 352.

In the embodiment illustrated, the contact positioning member 352 includes forwardly opening apertures or recesses 570A and 570B. When the outlet 120 is assembled, the rearwardly extending projections 319A and 319B (see FIG. 11) of the face plate 310 are received inside the recesses 570A and 570B, respectively. The rearwardly extending projections 319A and 319B of the face plate 310 may help provide support for the front portion 580 of the contact positioning member 352.

The contact positioning member 352 is constructed from a dielectric or non-conductive material (e.g., plastic).

Substrate

The substrate 354 has a first forwardly facing side 600 opposite a second rearwardly facing side 602. As mentioned above, the protrusions 520A and 520B of the spring assembly 350 may be received in the apertures 522A and 522B, respectively, and the protrusions 550A and 550B of the contact positioning member 352 may be received in the apertures 552A and 552B, respectively. The apertures 522A, 522B, 552A, and 552B are formed in the forwardly facing side 600.

The substrate 354 includes circuit paths or traces (not shown) formed on one or both of the first and second sides 600 and 602 of the substrate 354. The traces (not shown) electrically connect the outlet contacts J1-J8, respectively, to the wire contacts 361-368, respectively. The substrate 354 includes apertures 611-618 (e.g., plated through-holes) configured to receive the first end portions 502 of the outlet contacts J1-J8, respectively, and electrically connect the outlet contacts J1-J8 to the traces (not shown). The substrate 354 also includes apertures 621-628 (e.g., plated through-holes) configured to receive each of the wire contacts 361-368, respectively, and electrically connect the wire contacts 361-368 to the traces (not shown).

In the embodiment illustrated, the first end portions 502 of the outlet contacts J1-J8 may be pressed into the apertures 611-618, respectively, from the first forwardly facing side 600 of the substrate 354 and the wire contacts 361-368 may be pressed into the apertures 621-628, respectively, in the substrate 354 from the second rearwardly facing side 602 of the substrate 354. Thus, the outlet contacts J1-J8 and the wire contacts 361-368 extend away from the substrate 354 in opposite directions. The outlet contacts J1-J8 may be subsequently soldered into place, if desired.

Latch Member

Referring to FIGS. 5-10, the latch member 356 may be attached to the housing 330 or formed as part of the housing 330. Referring to FIG. 5, the latch member 356 includes one or more connector portions 650 configured to (removably or permanently) attach the outlet 120 inside an aperture (not shown) formed in an external structure (not shown). For example, the connector portions 650 may be used to attach the outlet 120 inside an aperture (not shown) formed in a patch panel, rack, wall outlet, and the like.

Wire Contacts

Referring to FIG. 20, as mentioned above, the wire contacts 361-368 are connected to the outlet contacts J1-J8, respectively, by the traces (not shown) formed on one or both of the first and second sides 600 and 602 of the substrate 354. Thus, the wire contacts 361-368 may be characterized as corresponding to the outlet contacts J1-J8, respectively. Similarly, the wire contacts 361-368 may be characterized as corresponding to the wires JW1-JW8 (see FIGS. 1, 26B-26E, and 28A), respectively, of the cable C1 (see FIGS. 1, 26B-26E, and 28A). Each of the wire contacts 361-368 may be implemented as an insulation displacement connector ("IDC"). However, this is not a requirement. In the embodiment illustrated, the wire contacts 361-368 are positioned on the substrate 354 in a generally circular or rhombus shaped arrangement. Thus, not all of the wire contacts 361-368 are parallel with one another.

Figure 28A:
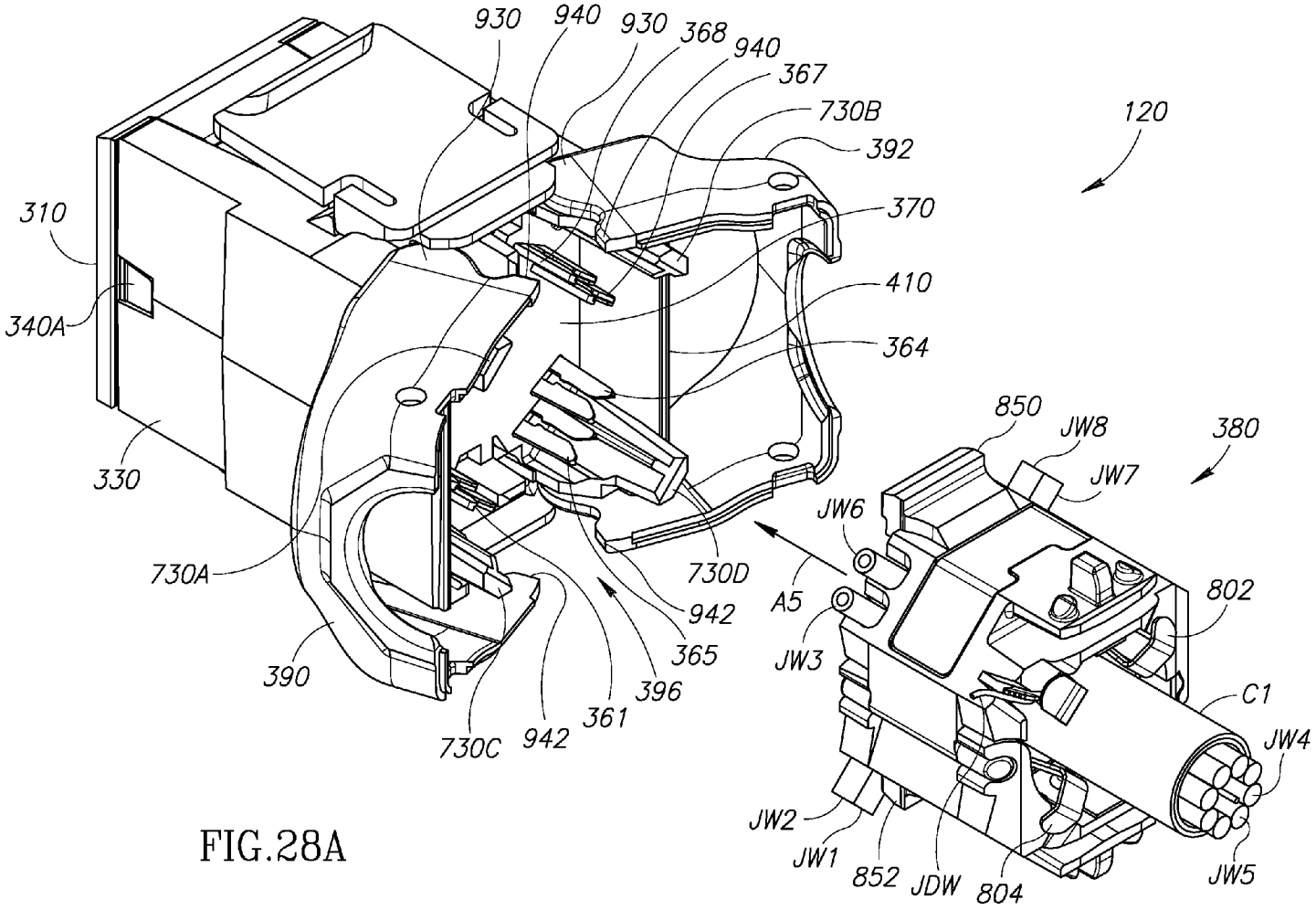
FIG. 28A is a perspective view of the wire manager being inserted into the housing of the outlet of FIG. 1.

In the embodiment illustrated, the wire contacts 361-368 are implemented as conventional IDCs configured to cut through the insulation 144 (see FIG. 2) of the wires JW1-JW8 (see FIGS. 1, 26B-26E, and 28A), respectively, to form an electrical connection with the conductor 142 (see FIG. 2) of the wires JW1-JW8, respectively. As is apparent to those of ordinary skill in the art, the wires JW1-JW8 must be properly aligned with the IDCs for the IDCs to cut through the insulation 144. Referring to FIG. 28A, the guide sleeve 370 and the wire manager 380 help position the wires JW1-JW8 with respect to the wire contacts 361-368 (see FIG. 22), respectively.

Guide Sleeve

Figure 22:
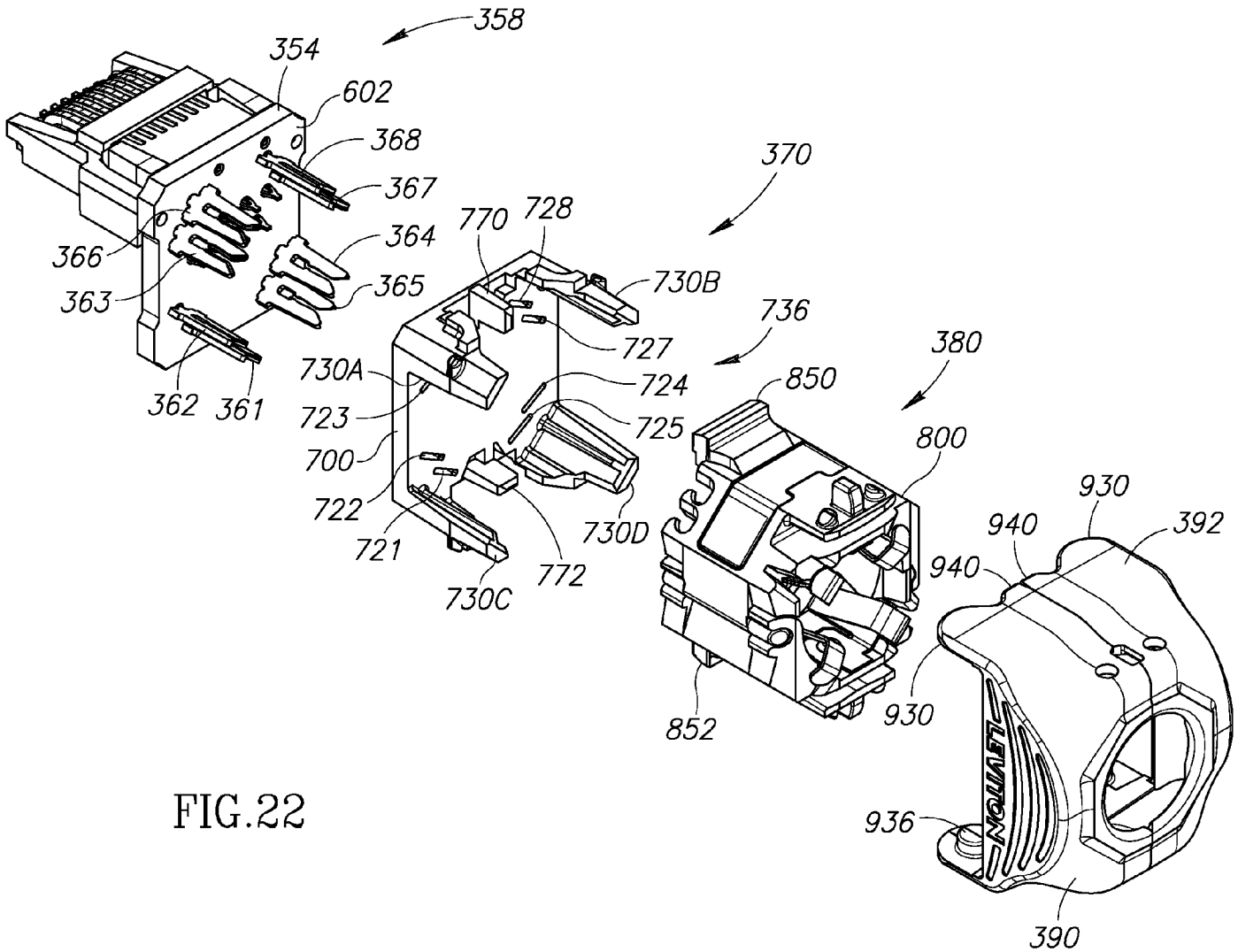
FIG. 22 is a partially exploded perspective view of the housing doors, a wire manager, the guide sleeve, and a subassembly including the contact positioning member, the optional spring assembly, the optional flexible printed circuit board, the outlet contacts, the substrate, and the wire contacts of the outlet of FIG. 1.

Referring to FIG. 22, the guide sleeve 370 is configured to position the wire manager 380 with respect to the wire contacts 361-368, and determine the orientation of the wire manager 380 with respect to the wire contacts 361-368.

Figure 21A:
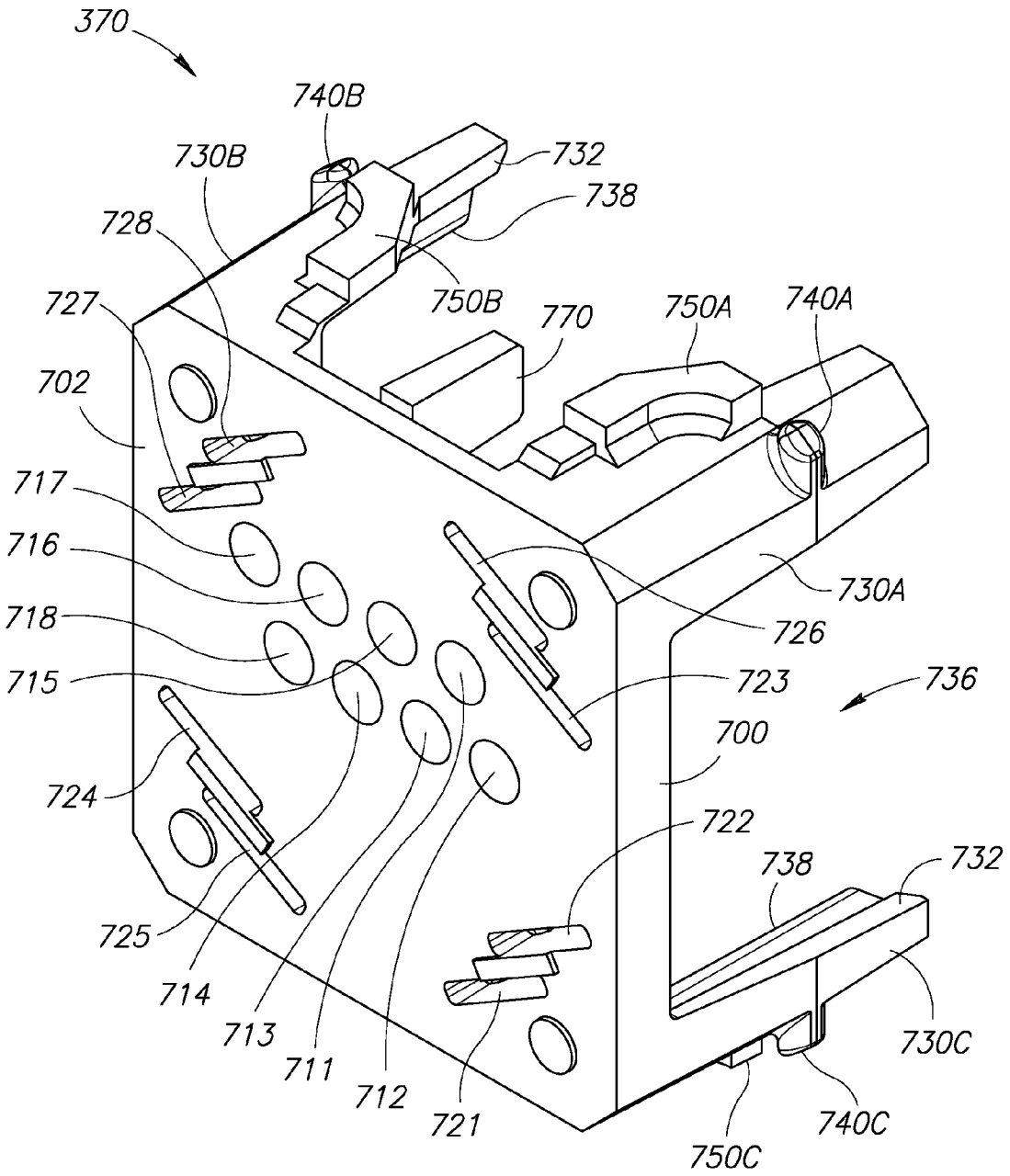
FIG. 21A is a front perspective view of a guide sleeve of the outlet of FIG. 1.
Figure 21B:
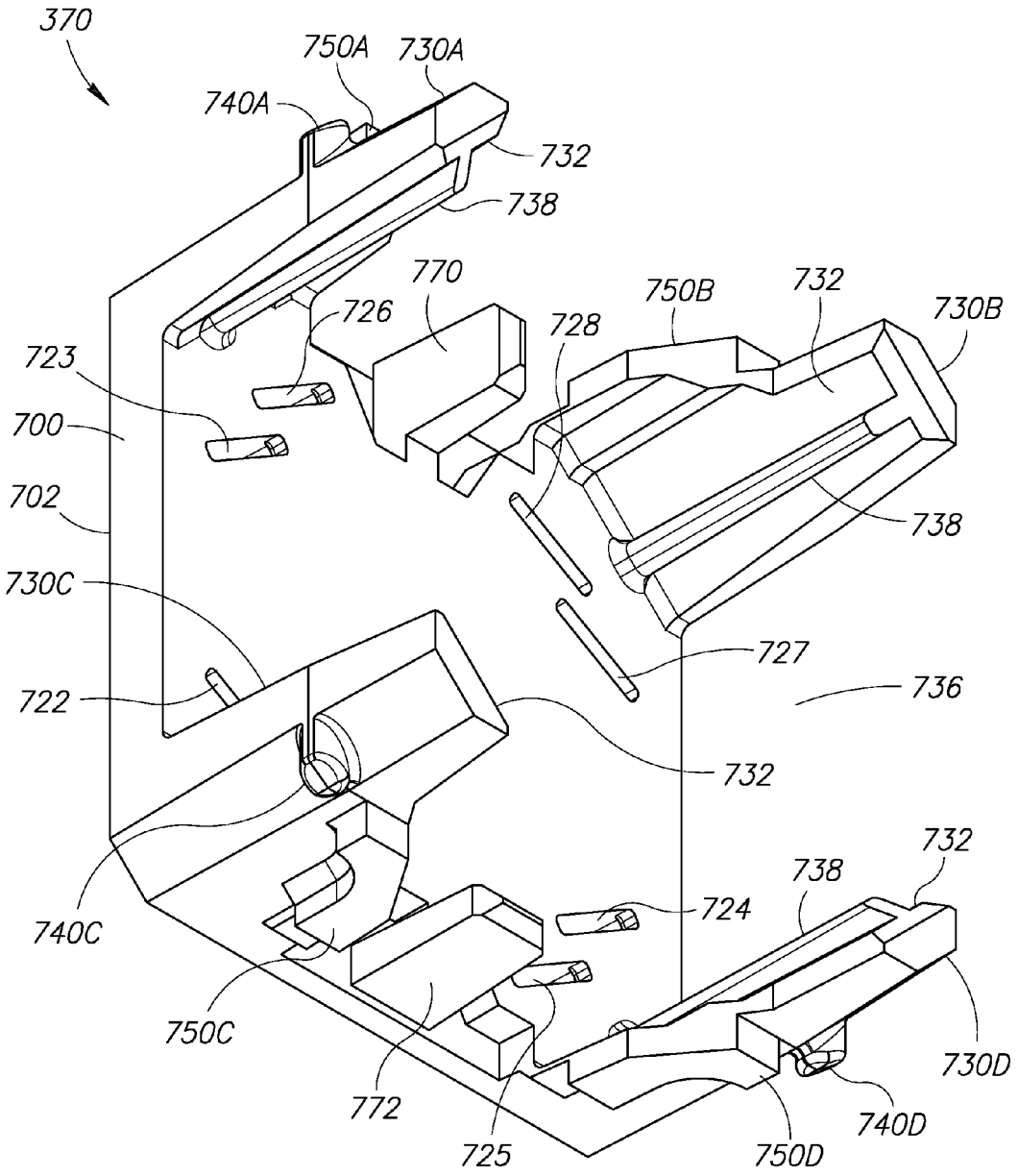
FIG. 21B is a rear perspective view of the guide sleeve of FIG. 21A.

Referring to FIGS. 21A and 21B, the guide sleeve 370 has a body portion 700 with a forwardly facing surface 702 configured to be positioned alongside and spaced apart from the rearwardly facing side 602 (see FIG. 22) of the substrate 354 (see FIG. 22). Referring to FIG. 21A, recesses or apertures 711-718 are formed in the forwardly facing surface 702. Referring to FIG. 20, the recesses 711-718 (see FIG. 21A) are configured to receive portions of the first end portions 502 of the outlet contacts J1-J8, respectively, that extend rearwardly beyond the rearwardly facing side 602 of the substrate 354.

Referring to FIGS. 21A and 21B, through-channels or through-slots 721-728 extend from the forwardly facing surface 702 through the body portion 700. Referring to FIG. 22, the through-slots 721-728 are configured to receive the wire contacts 361-368, respectively, and allow the wire contacts 361-368 to pass through the body portion 700 of the guide sleeve 370 and into the wire manager 380.

Referring to FIG. 21B, the guide sleeve 370 includes a plurality of projections or posts 730A-730D that extend rearwardly from the body portion 700. In the embodiment illustrated, each of the posts 730A-730D has an inwardly facing surface 732. A void 736 having a predetermined cross-sectional shape is defined between the inwardly facing surfaces 732 of the posts 730A-730D. The predetermined cross-sectional shape of the void 736 corresponds to the outer shape of the wire manager 380. In the embodiment illustrated, the predetermined cross-sectional shape of the void 736 is octagonal. Optionally, a projection 738 extends inwardly into the void 736 from the inwardly facing surface 732 of each of the posts 730A-730D.

Referring to FIGS. 21A and 21B, pegs or projections 740A-740D extent upwardly from the posts 730A-730D, respectively. When the outlet 120 is assembled, the projections 740A-740D are received inside and engage with the openings 424A-424D (see FIG. 18B), respectively, formed in the housing 330 (see FIG. 18B). For example, the projections 740A-740D may snap inside the openings 424A-424D, respectively. Engagement between the projections 740A-740D and openings 424A-424D, respectively, helps maintain the guide sleeve 370 inside the housing 330.

Curved or contoured projections 750A-750D spaced apart from the projections 740A-740D, respectively, also extent upwardly from the posts 730A-730D, respectively. Together, the contoured projections 750A-750D and the contoured recesses 429A-429D (see FIG. 18B) of the housing 330 (see FIG. 18B) each define a circular opening or recess 760 (see FIGS. 28B and 28C).

Referring to FIG. 21B, the guide sleeve 370 may include one or more alignment blades or key members 770 and 772 that extend rearwardly from the body portion 700. Referring to FIG. 22, as will be explained below, the key members 770 and 772 help ensure the wire manager 380 is oriented correctly with respect to the wire contacts 361-368 so that the wires JW1-JW8 (see FIGS. 1, 26B-26E, and 28A) may be connected to the wire contacts 361-368, respectively. In the embodiment illustrated, the key member 770 has a generally rectangular cross-sectional shape that is oriented vertically, and the key member 772 has a generally rectangular cross-sectional shape that is oriented horizontally.

The guide sleeve 370 may be constructed from a dielectric or non-conductive material (e.g., plastic).

Wire Manager

Figure 23B:
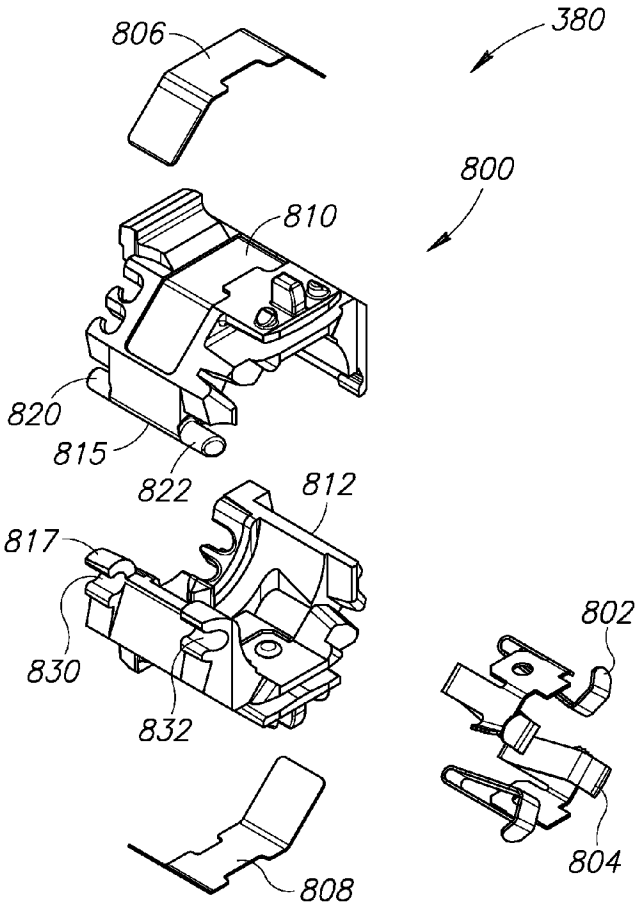
FIG. 23B is a rear exploded perspective view of the wire manager of FIG. 23A.
Figure 23A:
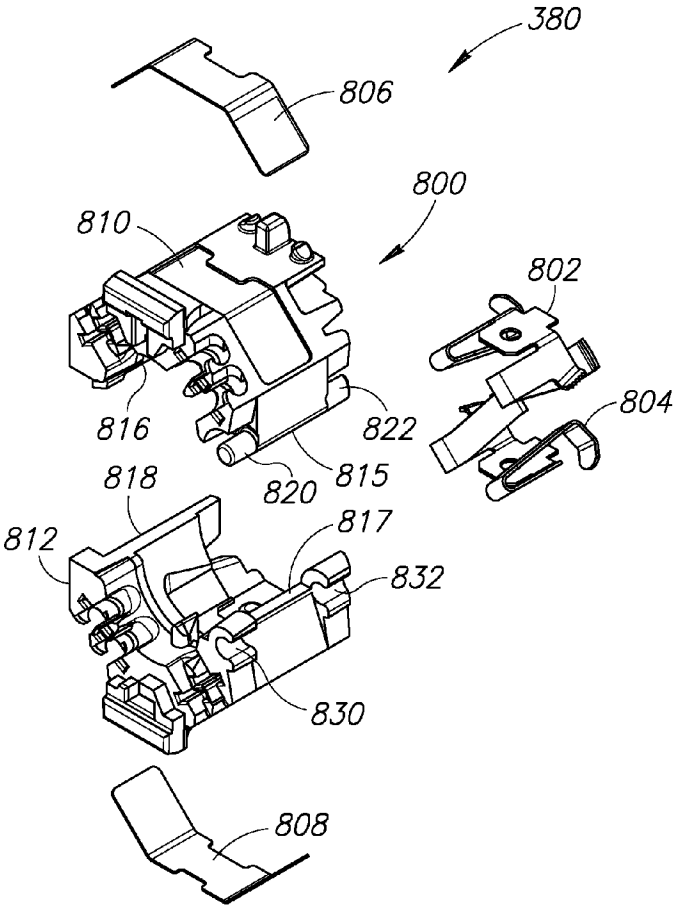
FIG. 23A is a front exploded perspective view of the wire manager of the outlet of FIG. 1.

FIG. 23A is an exploded perspective view of a front portion of the wire manager 380, and FIG. 23B is an exploded perspective view of a rear portion of the wire manager 380. Referring to FIGS. 23A and 23B, the wire manager 380 includes a housing 800, one or more conductive members 802 and 804, and optional labels 806 and 808.

Referring to FIG. 22, the housing 800 has an outer shape configured to be slid into the void 736 defined between the inwardly facing surfaces 732 (see FIG. 21B) of the posts 730A-730D of the guide sleeve 370. Referring to FIGS. 23A and 23B, the housing 800 includes a first portion 810 rotatably connected to a second portion 812. Both the first and second portions 810 and 812 are constructed from a dielectric material. The optional labels 806 and 808 may be adhered along outer surfaces of the first and second portions 810 and 812, respectively. The optional labels 806 and 808 have been omitted from FIGS. 26E and 28A.

The housing 800 may be selectively transitioned between an open configuration (see FIGS. 24B, 25B, 26A, and 26B) and a closed configuration (see FIGS. 24A, 25A, 26C-26E, and 28A) by rotating the first portion 810 relative to the second portion 812. Each of the first and second portions 810 and 812 has a generally C-shaped cross-sectional shape. Thus, when the first and second portions 810 and 812 are rotated into the closed configuration (see FIGS. 24A, 25A, and 26C-26E), an open-ended central passageway 814 is defined between them (see FIGS. 7, 24A, 25A, and 26C-26E). In the embodiment illustrated, when in the closed configuration, the housing 800 has a generally octagonal cross-sectional shape and fits within the predetermined cross-sectional shape of the void 736 (see FIG. 22).

Figure 26A:
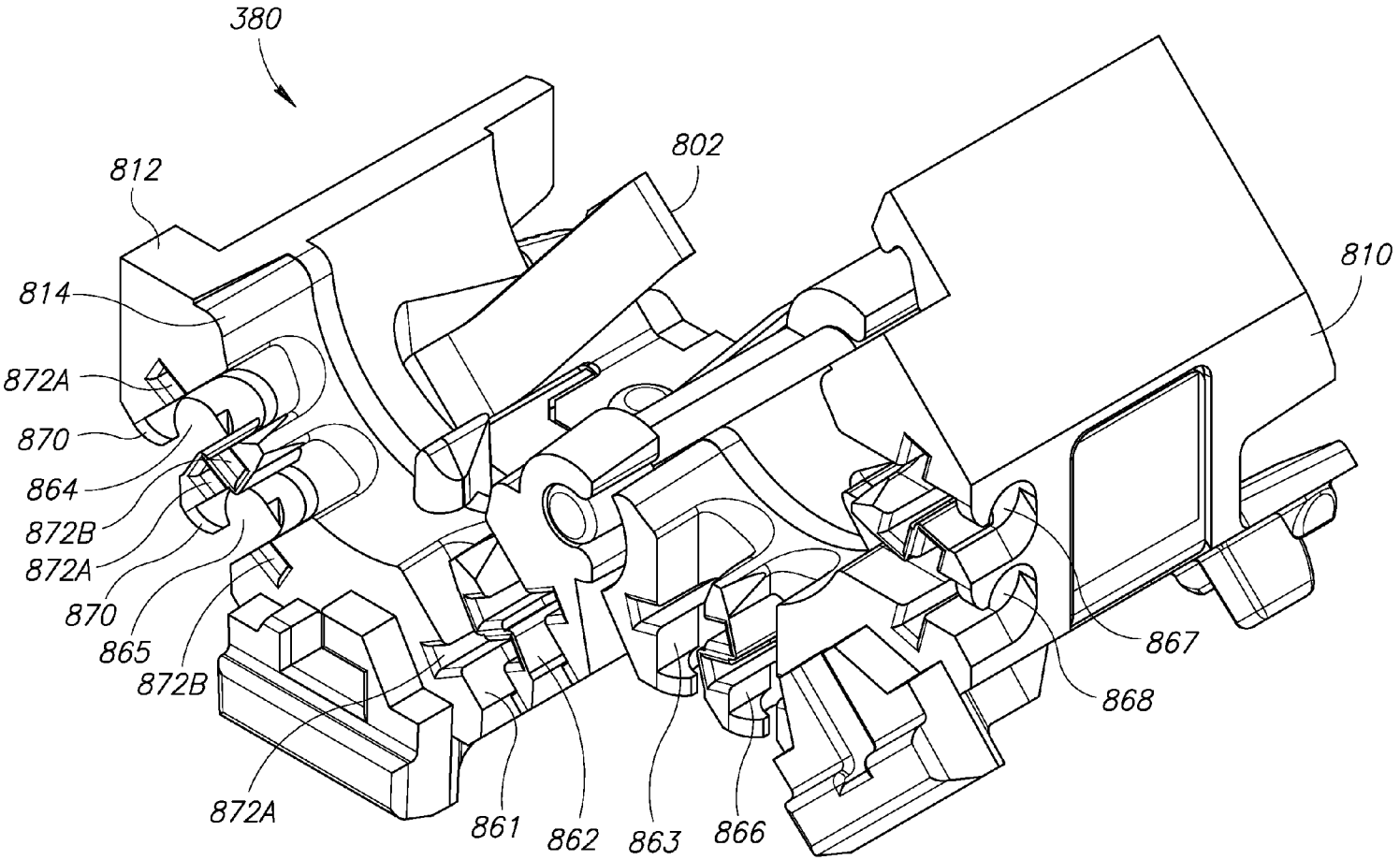
FIG. 26A is a front perspective view of the wire manager of FIG. 23A depicted in the open configuration.
Figure 26B:
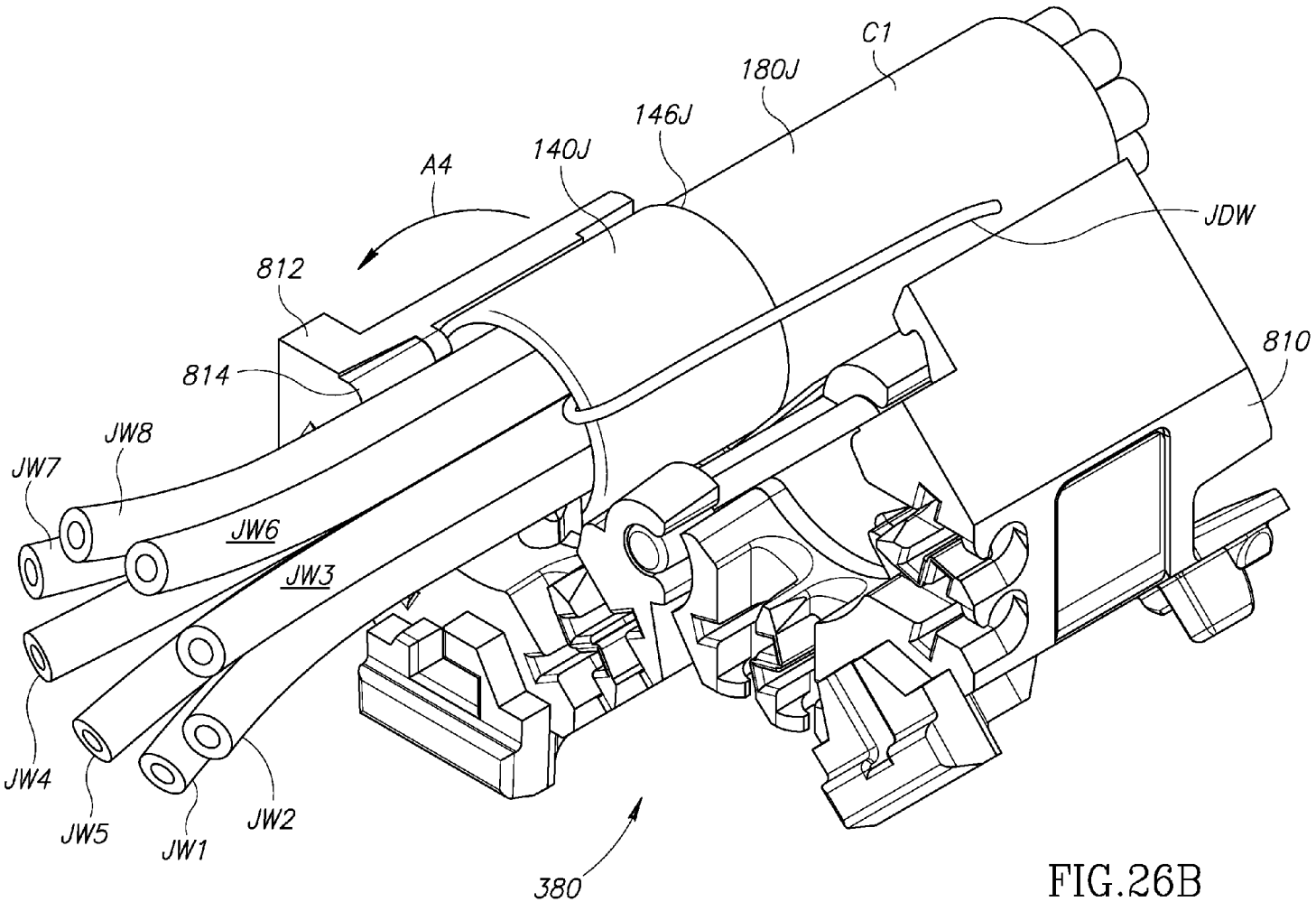
FIG. 26B is a front perspective view of the wire manager of FIG. 23A depicted in the open configuration with a cable positioned to be inside an open-ended passageway defined between first and second portions of the wire manager when the wire manager is in the closed configuration.
Figure 26C:
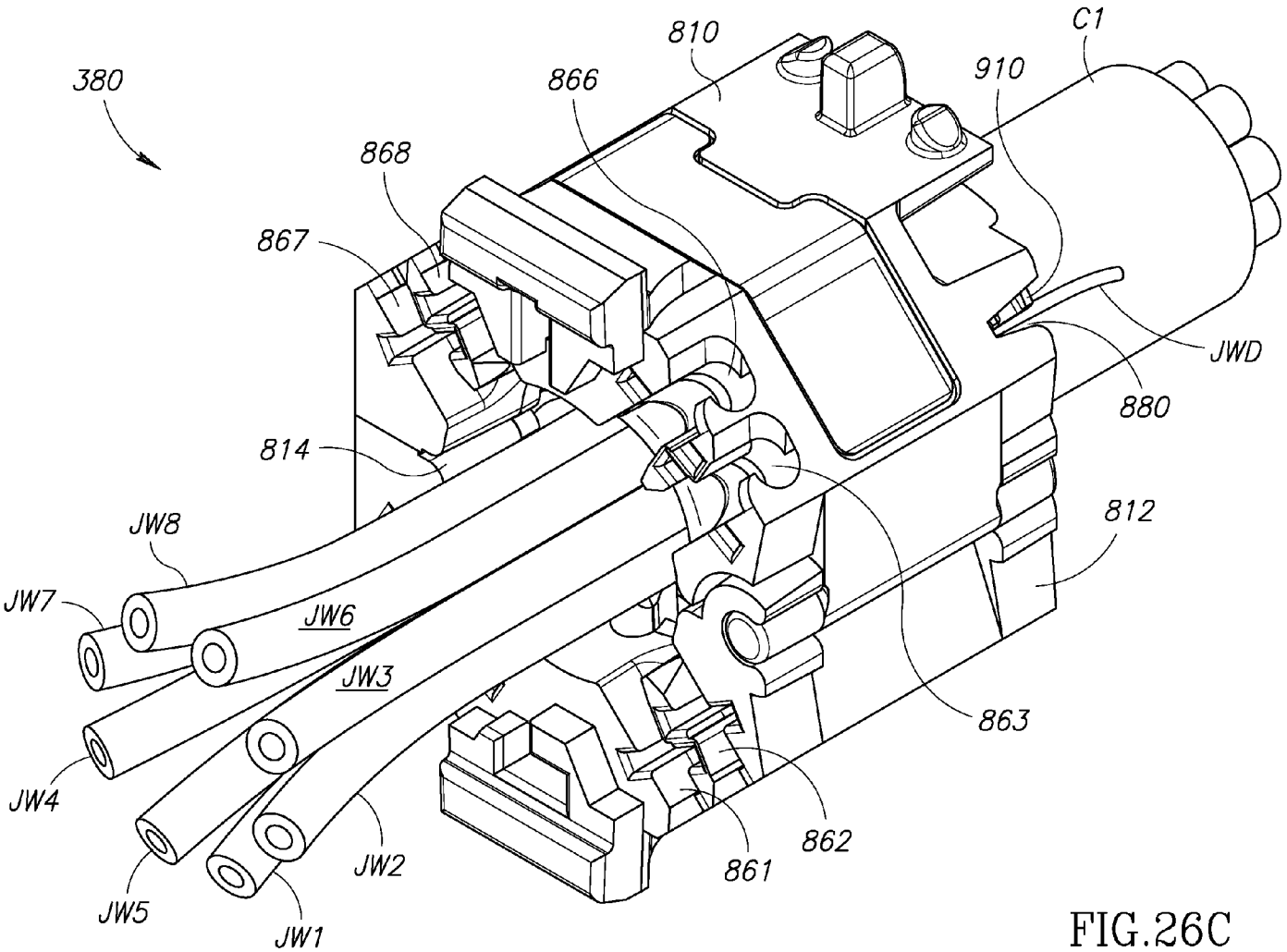
FIG. 26C is a front perspective view of the wire manager of FIG. 23A depicted in the closed configuration with the cable inside the open-ended passageway defined between the first and second portions of the wire manager.

Referring to FIG. 26C, the central passageway 814 is configured to receive the cable C1. As shown in FIG. 26B, the cable C1 may be positioned inside the passageway 814 when the housing 800 is in the open configuration. Then, as illustrated in FIG. 26C, the housing 800 may be transitioned into the closed configuration (e.g., by rotating the first portion 810 in a direction indicated by arrow A4 (see FIG. 26B) with respect to the second portion 812) with the cable C1 inside the passageway 814 to compress the cable C1 inside the passageway 814. Thus, the first and second portions 810 and 812 may be characterized as being configured to clamp onto an end portion of the cable C1.

Referring to FIG. 23A, the first portion 810 has a first side portion 815 opposite a second side portion 816. Similarly, the second portion 812 has a first side portion 817 opposite a second side portion 818. The first side portion 815 of the first portion 810 has a first forwardly extending pivot pin 820, and a second rearwardly extending pivot pin 822. Referring to FIG. 23B, the first side portion 817 of the second portion 812 has a first channel 830, and a second channel 832. The first forwardly extending pivot pin 820 is configured to be received inside the first channel 830, and the second rearwardly extending pivot pin 822 is configured to be received inside the second channel 832. The pivot pins 820 and 822 are selectively rotatable inside the channels 830 and 832, respectively. The pivot pins 820 and 822 and the channels 830 and 832 may be characterized as forming a hinge that attaches the first portion 810 to the second portion 812.

Figure 24A:
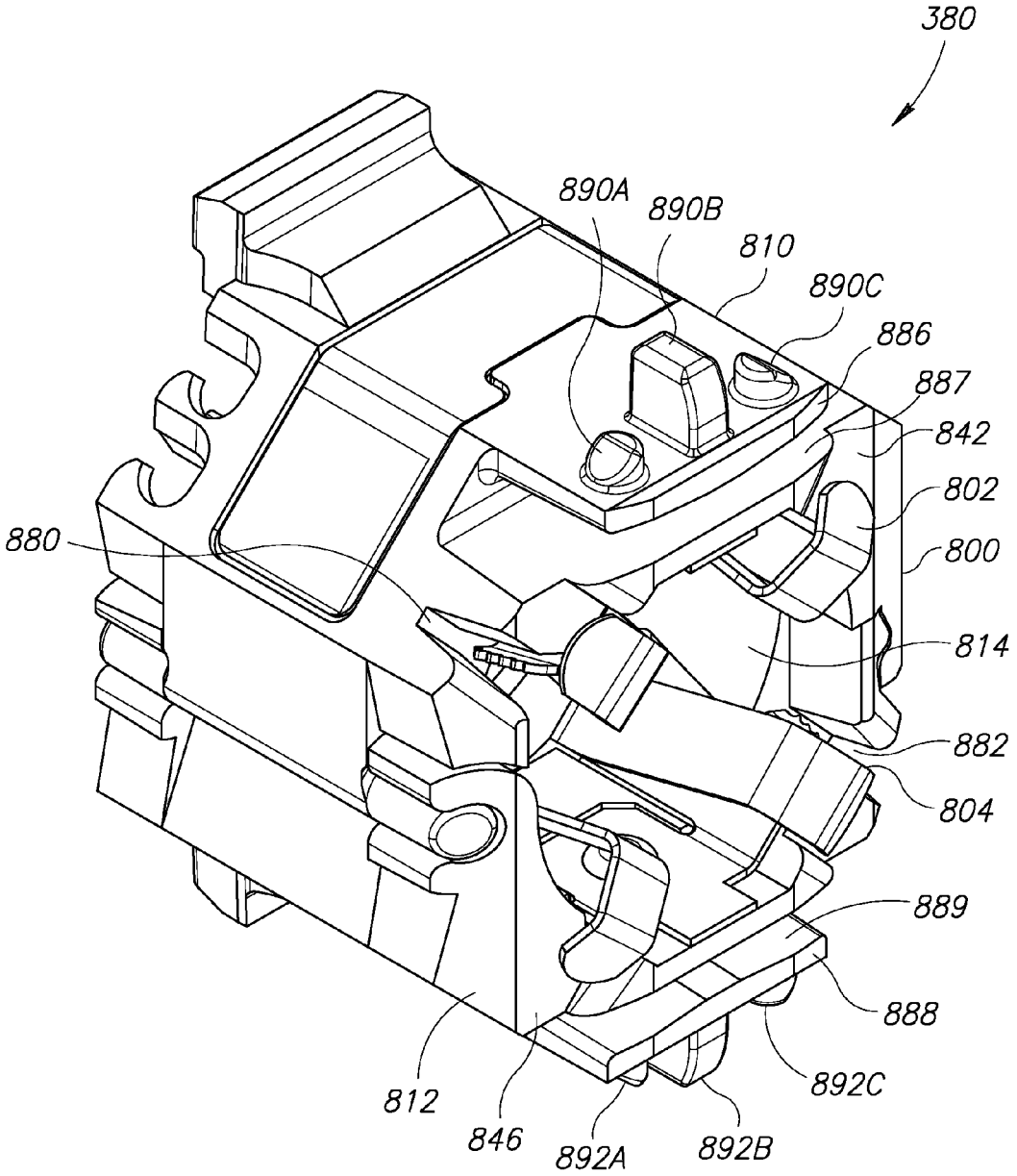
FIG. 24A is a rear perspective view of the wire manager of FIG. 23A depicted in a closed configuration.
Figure 25A:
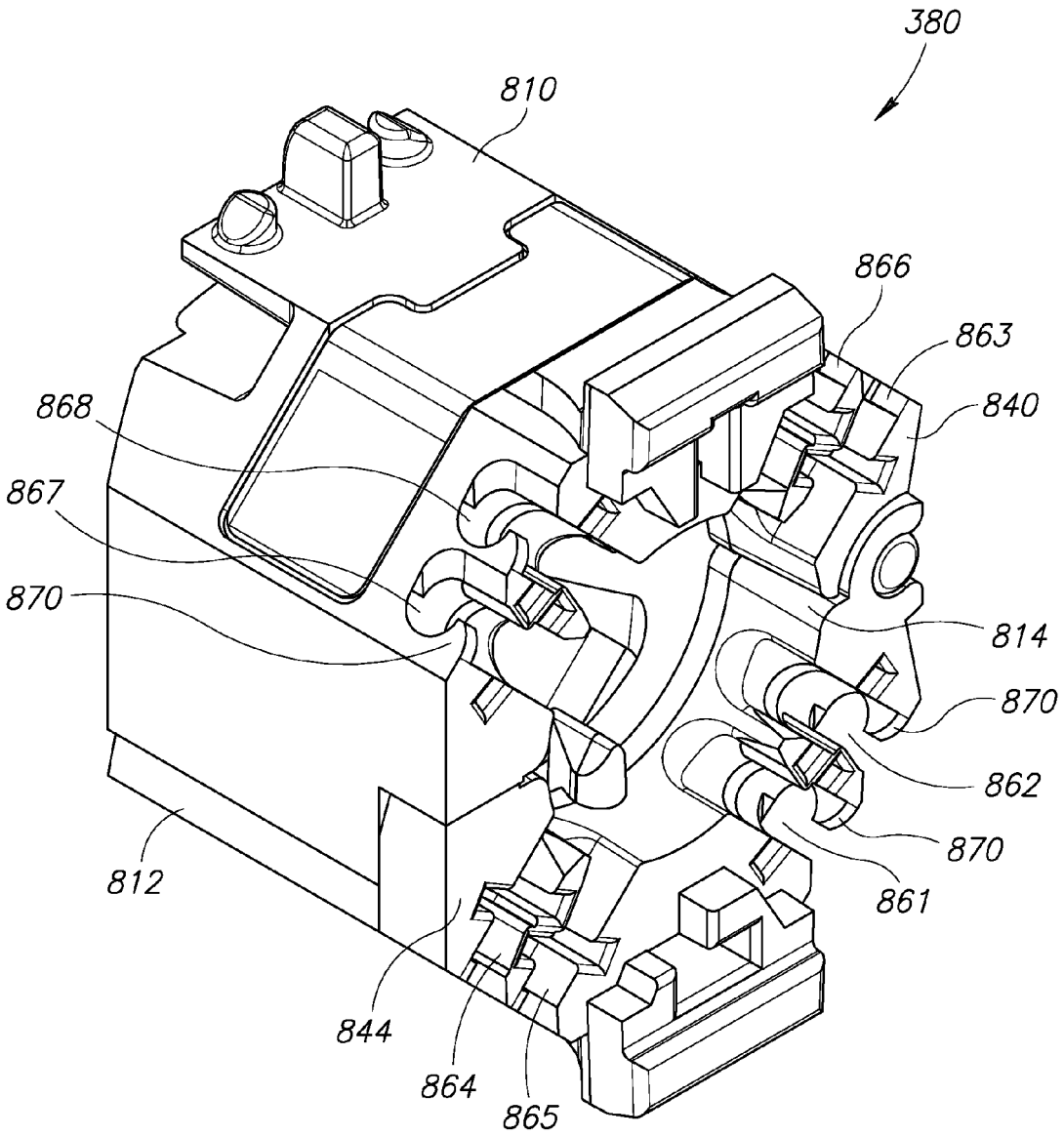
FIG. 25A is a front perspective view of the wire manager of FIG. 23A depicted in a closed configuration.
Figure 25B:
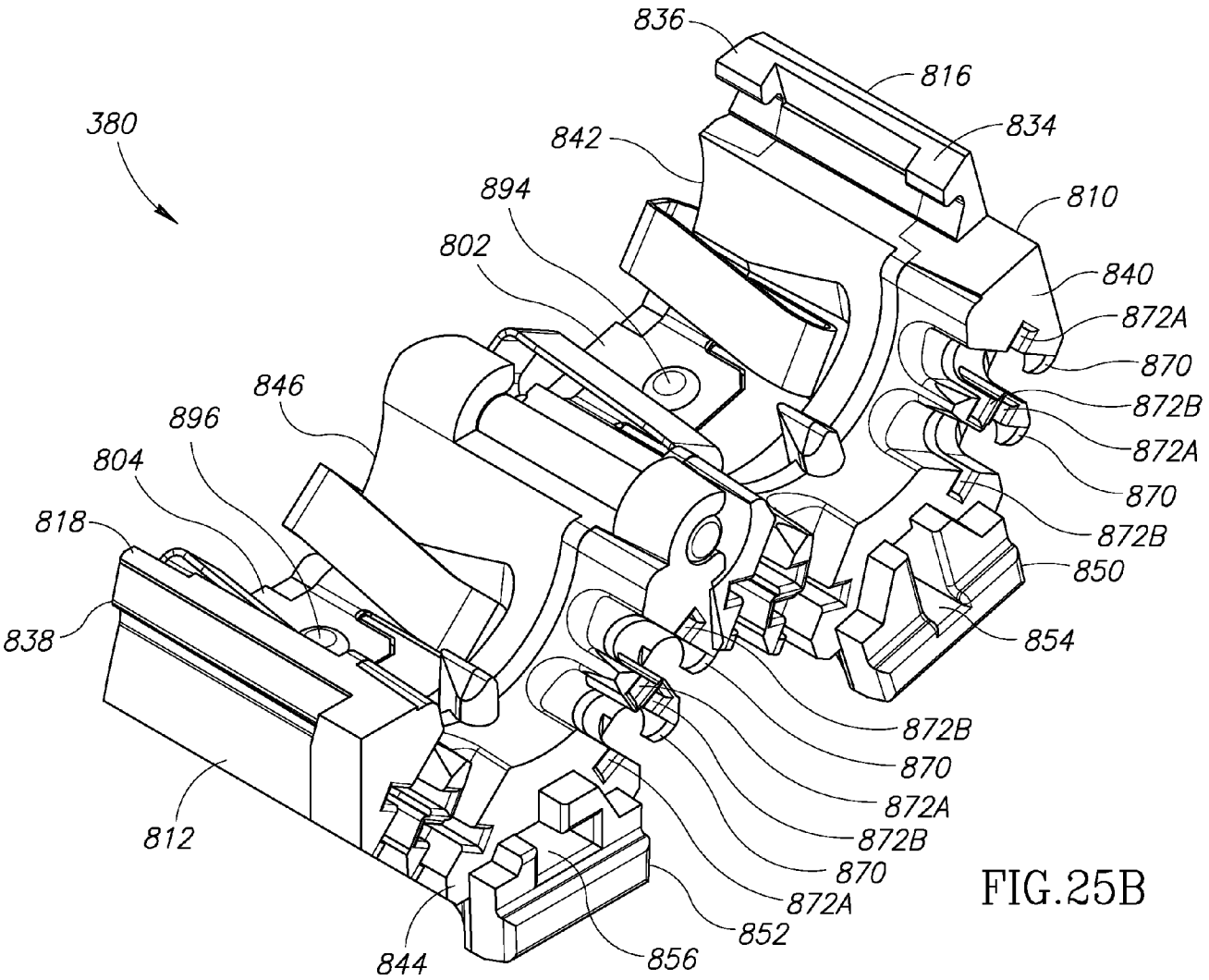
FIG. 25B is a front perspective view of the wire manager of FIG. 23A depicted in an open configuration.

Referring to FIG. 25B, the second side portion 816 of the first portion 810 has one or more gripping projections 834 and 836. The second side portion 818 of the second portion 812 has a lip or rail 838 configured to be gripped by the gripping projections 834 and 836 to maintain the housing 800 in the closed configuration (see FIGS. 24A, 25A, 26C-26E, and 28A). In other words, the gripping projections 834 and 836 and the rail 838 interlock with one another to maintain the first and second portions 810 and 812 in the closed configuration.

Continuing to refer to FIG. 25B, the first portion 810 has a forward portion 840 opposite a rearward portion 842. Similarly, the second portion 812 has a forward portion 844 opposite a rearward portion 846. The forward portion 840 of the first portion 810 has an upwardly extending member 850, and the forward portion 844 of the second portion 812 has a downwardly extending member 852. Referring to FIG. 22, the upwardly extending member 850 includes an upper keyway 854 (see FIG. 25B) having a generally rectangular cross-sectional shape that is oriented vertically and configured to receive the key member 770 of the guide sleeve 370 but not the key member 772 of the guide sleeve 370. Similarly, the downwardly extending member 852 includes a lower keyway 856 (see FIG. 25B) having a generally rectangular cross-sectional shape that is oriented horizontally and configured to receive the key member 772 of the guide sleeve 370 but not the key member 770 of the guide sleeve 370. Thus, when the wire manager 380 is slid into the void 736 of the guide sleeve 370, the key member 770 is receivable into the upper keyway 854 (but not the lower keyway 856), and the key member 772 is receivable into the lower keyway 856 (but not the upper keyway 854). In this manner, the upper and lower keyways 854 and 856 and the key members 770 and 772 determine the orientation of the wire manager 380 with respect to the guide sleeve 370.

Figure 26D:
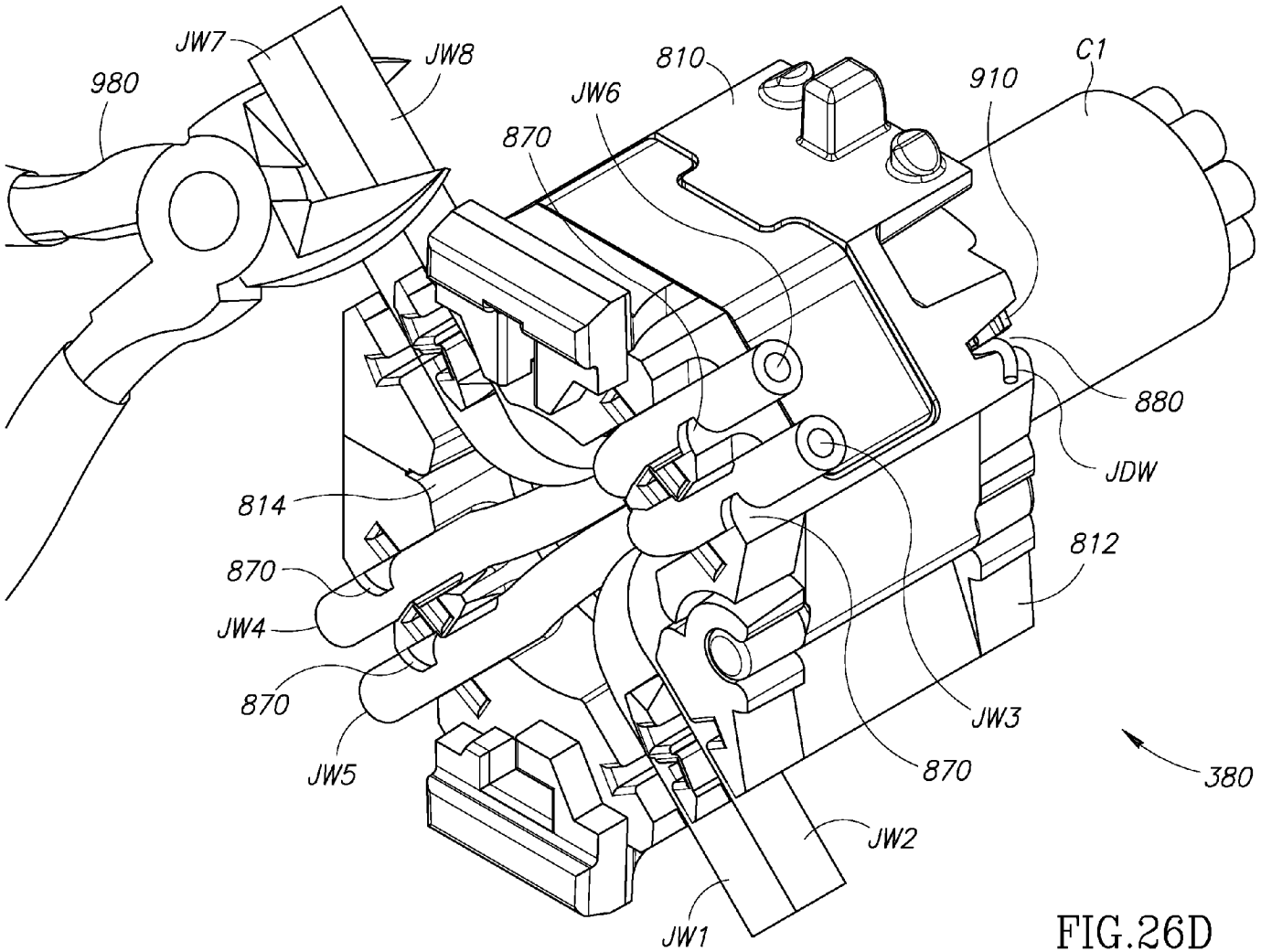
FIG. 26D is a front perspective view of the wire manager of FIG. 23A depicted in the closed configuration with the wires of the cable inserted into the wire channels (or recesses) formed in the wire manager.

Referring to FIG. 25A, the forward portion 840 of the first portion 810 includes four wire channels or recesses 863, 866, 867, and 868 that extend outwardly from the passageway 814. As illustrated in FIGS. 26A and 26D, the recesses 863, 866, 867, and 868 are configured to receive and grip the wires JW3, JW6, JW7, and JW8, respectively, of the cable C1 when the wire manager 380 is in the closed configuration. The recesses 863, 866, 867, and 868 provide passageways for the wires JW3, JW6, JW7, and JW8, respectively, from the passageway 814.

Referring to FIG. 25A, the forward portion 844 of the second portion 812 includes four wire channels or recesses 861, 862, 864, and 865 that extend outwardly from the passageway 814. As illustrated in FIGS. 26A and 26D, the recesses 861, 862, 864, and 865 are configured to receive and grip the wires JW1, JW2, JW4, and JW5, respectively, of the cable C1 when the wire manager 380 is in the closed configuration. The recesses 861, 862, 864, and 865 provide passageways for the wires JW1, JW2, JW4, and JW5, respectively, from the passageway 814.

Figure 26E:
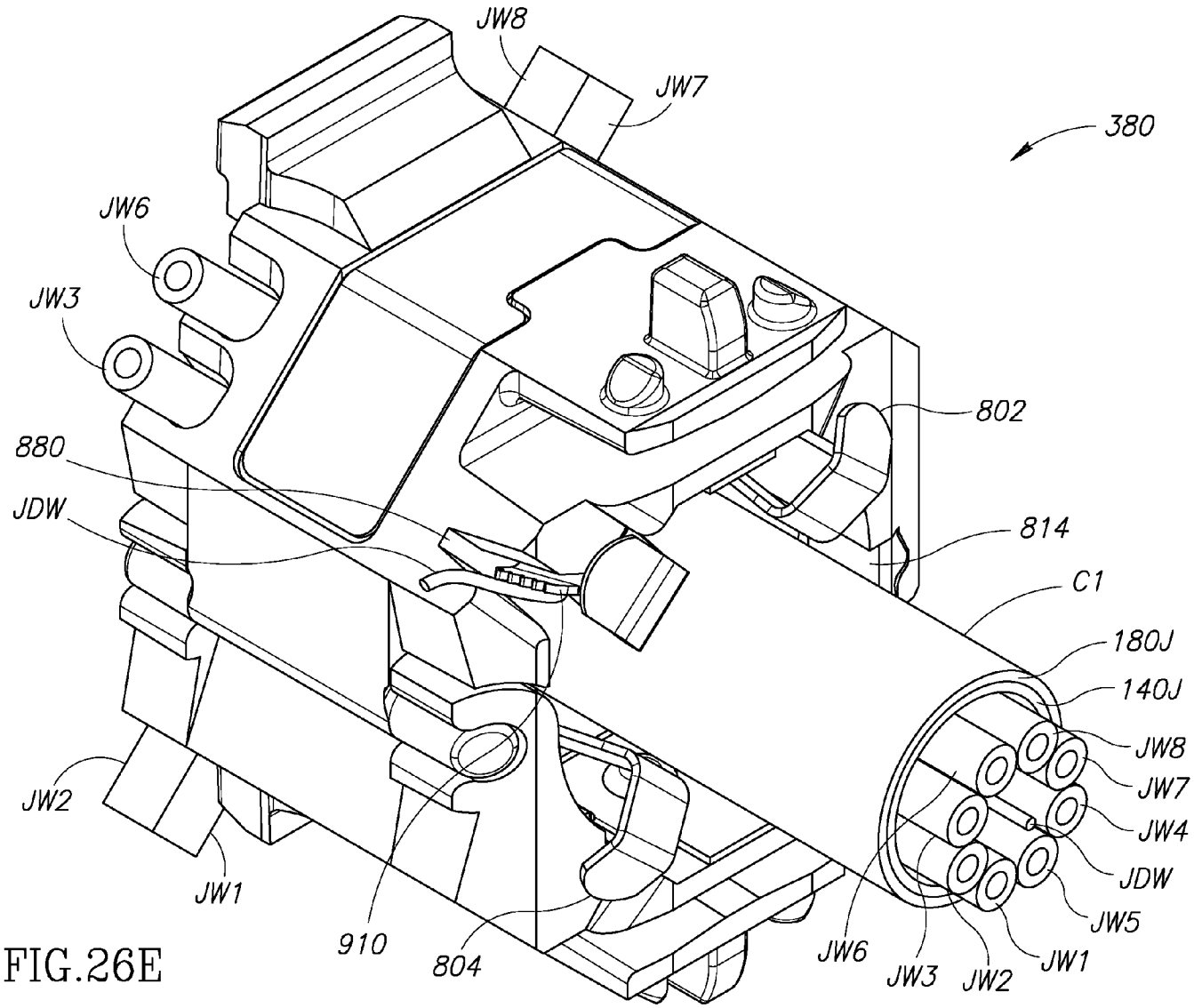
FIG. 26E is a rear perspective view of the wire manager of FIG. 23A depicted in the closed configuration with a drain wire of the cable positioned inside a drain wire channel formed in the wire manager.

As shown in FIGS. 26D, 26E, and 28A, together the recesses 861-868 (see FIG. 25A) may be used to grip the wires JW1-JW8, respectively, and position them to engage the wire contacts 361-368 (see FIG. 22). Referring to FIG. 25A, in the embodiment illustrated, a gripping projection 870 extends laterally into each of the recesses 861-868 to help maintain the wires JW1-JW8, respectively, therein. Each of the recesses 861-868 may include side channels 872A and 872B (see FIG. 25B) configured to receive portions of the appropriate one of the wire contacts 361-368 (see FIG. 22) as the wire contact engages the wire positioned inside the recess.

Turning to FIG. 24A, a first drain wire channel 880 is formed in the rearward portion 842 of the first portion 810, and a second drain wire channel 882 is formed in the rearward portion 846 of the second portion 812. Referring to FIG. 26D, when the cable C1 is inside the passageway 814, the drain wire JDW may exit the passageway 814 through one of the drain wire channels 880 and 882 (see FIG. 24A).

Turning to FIG. 24A, the rearward portion 842 of the first portion 810 has a rearwardly extending upper cantilever member 886 positioned above a recess 887, and the rearward portion 846 of the second portion 812 has a rearwardly extending lower cantilever member 888 positioned under a recess 889. The upper and lower cantilever members 886 and 888 are configured to deflect into the recesses 887 and 889, respectively, when inwardly directed lateral forces (e.g., exerted by the housing doors 390 and 392) press upon by the upper and lower cantilever members 886 and 888.

The upper cantilever member 886 includes one or more upwardly extending anchor projections 890A-890C, and the lower cantilever member 888 has one or more downwardly extending anchor projections 892A-892C. In the embodiment illustrated, the upwardly extending anchor projection 890B is positioned between the upwardly extending anchor projections 890A and 890C, and the downwardly extending anchor projection 892B is positioned between the downwardly extending anchor projections 892A and 892C. Further, the anchor projections 890B and 892B are larger than the anchor projections 890A, 890C, 892A, and 892C. However, this is not a requirement.

Referring to FIG. 25B, the first portion 810 includes a first tab 894 that extends downwardly into the passageway 814, and the second portion 812 includes a second tab 896 that extends upwardly into the passageway 814. The first and second tabs 894 and 896 are juxtaposed with one another across the passageway 814. In the embodiment illustrated, the first tab 894 is positioned at or near the rearward portion 842 of the first portion 810, and the second tab 896 is positioned at or near the rearward portion 846 of the second portion 812.

Referring to FIG. 24A, the conductive members 802 and 804 are constructed from an electrically conductive material. The conductive members 802 and 804 may be substantially identical to one another and may be characterized as being ground springs. The first conductive member 802 extends inside the passageway 814 along at least a portion of the first portion 810 of the housing 800, and the second conductive member 804 extends inside the passageway 814 along at least a portion of the second portion 812 of the housing 800. Referring to FIG. 26E, the conductive members 802 and 804 (see FIG. 26D) are physically and electrically connected to both the drain wire JDW and the cable shield 140J (see FIG. 26B) of the cable C1. If the cable C1 includes the optional pair shields JPS1-JPS4 (see FIG. 1), they may be physically and electrically connected to the first conductive member 802 and/or the second conductive member 804.

Figure 27:
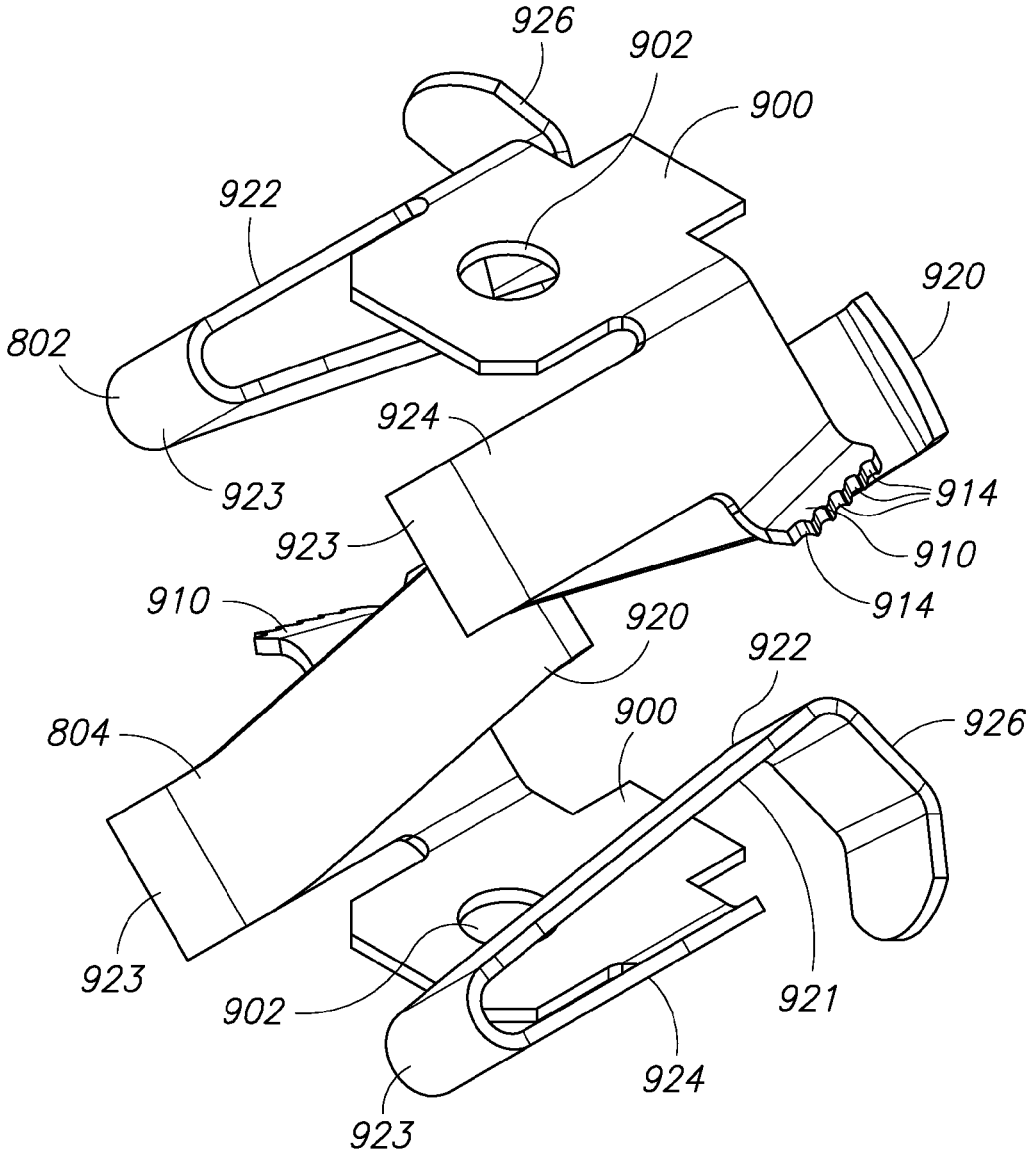
FIG. 27 is a front perspective view of conductive members of the wire manager of the outlet of FIG. 1.

Returning to FIG. 24A, the first conductive member 802 is configured to be attached to the rearward portion 842 of the first portion 810 inside the passageway 814, and the conductive member 804 is configured to be attached to the rearward portion 846 of the second portion 812 inside the passageway 814. Referring to FIG. 27, each of the conductive members 802 and 804 has a base portion 900 with a through-hole 902. The through-hole 902 of the first conductive member 802 is configured to receive the first tab 894 (see FIG. 25B), and the through-hole 902 of the second conductive member 804 is configured to receive the second tab 896 (see FIG. 25B).

A drain wire contact portion 910 extends outwardly from the base portion 900 of each of the conductive members 802 and 804. The drain wire contact portion 910 of the first conductive member 802 is configured to extend at least partway into the first drain wire channel 880 (see FIG. 24A) so that when the drain wire JDW is in the first drain wire channel 880, the drain wire contact portion 910 contacts and forms an electrical connection with the drain wire JDW. Similarly, the drain wire contact portion 910 of the second conductive member 804 is configured to extend at least partway into the second drain wire channel 882 (see FIG. 24A) so that when the drain wire JDW is in the second drain wire channel 882, the drain wire contact portion 910 contacts and forms an electrical connection with the drain wire JDW. Optionally, the drain wire contact portion 910 may include one or more gripping projections or teeth 914 configured to grip onto the drain wire JDW.

One or more shield engaging portions 920 and 922 extend from the base portion 900 of each of the conductive members 802 and 804 into the passageway 814. As illustrated in FIG. 26B, an end portion (referred to as a folded back portion 146J) of the cable shield 140J may be folded back over an end portion of the cable jacket 180J. Referring to FIG. 27, each of the shield engaging portions 920 and 922 is configured to contact and form an electrical connection with the folded back portion 146J (see FIG. 26B) of the cable shield 140J when the cable C1 is positioned inside the passageway 814 (see FIG. 26E).

Referring to FIG. 26B, if the cable C1 includes the optional pair shields JPS1-JPS4 (see FIG. 1), they may be folded back over the end portion of the cable jacket 180J and positioned alongside the folded back portion 146J (see FIG. 26B) of the cable shield 140J. When folded in this manner, the optional pair shields JPS1-JPS4 (see FIG. 1) may contact the shield engaging portions 920 and 922 (see FIG. 27) of at least one of the conductive members 802 and 804 when the cable C1 is positioned inside the passageway 814.

Referring to FIG. 26E, the shield engaging portions 920 and 922 (see FIG. 27) are configured to apply an inwardly directed biasing force against the cable C1 when the cable C1 is inside the passageway 814 to help maintain contact with the folded back portion 146J (see FIG. 26B) of the cable shield 140J and the folded back portions of the optional pair shields JPS1-JPS4, if present.

Referring to FIG. 27, by way of a non-limiting example, each of the shield engaging portions 920 and 922 may be constructed as a cantilever spring that includes a free distal portion 921 connected to an anchored proximal portion 924 by a bent portion 923. The anchored proximal portion 924 is connected to the base portion 900 at an angle to follow the interior contours of the passageway 814 (see FIGS. 24A and 25A). In the embodiment illustrated, the drain wire contact portion 910 is connected to and extends outwardly from the anchored proximal portion 924 of the shield engaging portion 920.

Figure 28B:
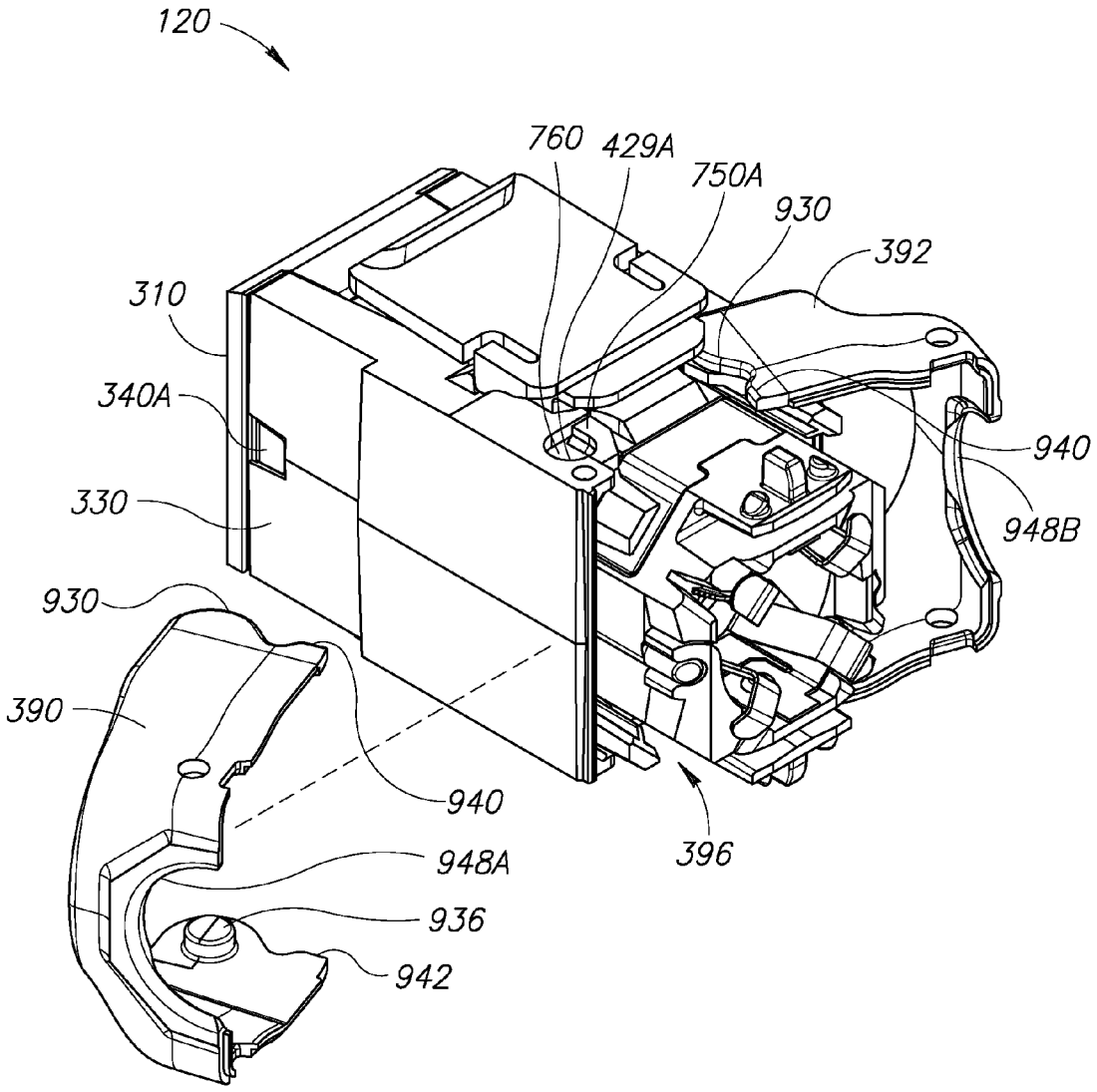
FIG. 28B is a perspective view of the rear of the outlet of FIG. 1 depicted with one of its housing doors removed (or exploded) and the other housing door in the open position.
Figure 28C:
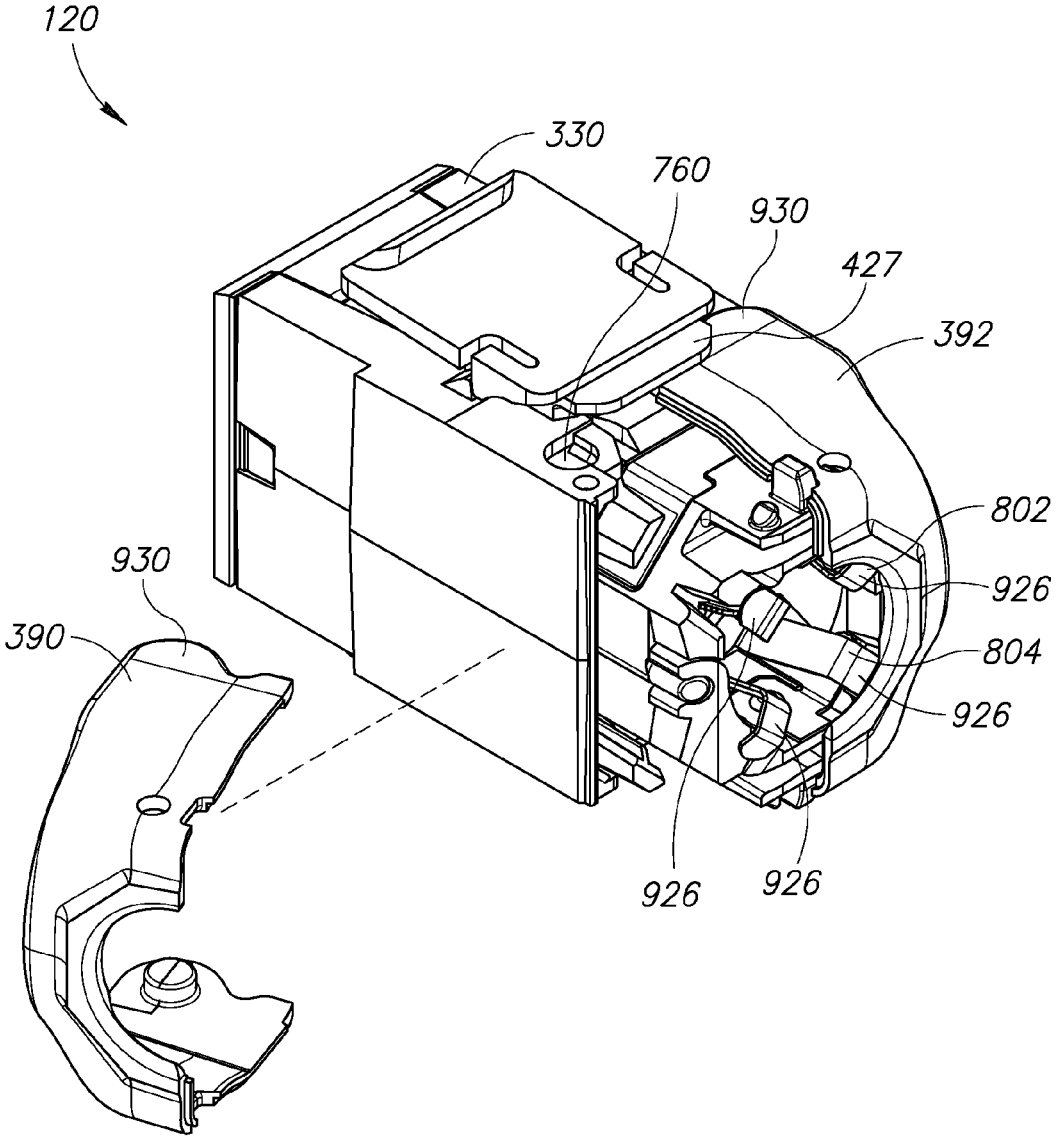
FIG. 28C is a perspective view of the rear of the outlet of FIG. 1 depicted with one of its housing doors removed (or exploded) and the other housing door in the closed position.

The shield engaging portions 920 and 922 each have a door engaging portion 926 that extends rearwardly and outwardly from the passageway 814 (see FIGS. 24A and 25A) and contacts one of the housing doors 390 and 392 (see FIG. 28C). In the embodiment illustrated, the door engaging portion 926 of each of the shield engaging portions 920 and 922 is connected to the free distal portion 921. As illustrated in FIG. 28C, when the housing doors 390 and 392 are closed, they may press on one or more of the door engaging portions 926 of the shield engaging portions 920 and 922 (see FIG. 27) of the conductive members 802 and 804. The door engaging portions 926 may be generally hook shaped. Optionally, the drain wire JDW may be received under and/or wrapped around one or more of the door engaging portions 926.

As described above, the door engaging portions 926 each contact at least one of the housing doors 390 and 392 and form an electrical connection therewith. Thus, the conductive members 802 and 804 electrically connect the cable shield 140J and the drain wire JDW with the housing doors 390 and 392, which are electrically connected to the housing 330. As described above, if the cable C1 includes the optional pair shields JPS1-JPS4 (see FIG. 1), the conductive members 802 and 804 may also electrically connect the optional pair shields JPS1-JPS4 with the housing doors 390 and 392, which are electrically connected to the housing 330.

As mentioned above, referring to FIG. 1, the housing 150 of the plug 100 (which may be connected to the drain wire PDW, the cable shield 140P, and/or the optional pair shields PPS1-PPS4 of the cable C2) is also electrically connected to the housing 330 by the ground springs 340A and 340B (see FIGS. 8-10). Thus, a continuous ground may be maintained across the connection 10.

While the guide sleeve 370 has been described as including the key members 770 and 772 and the wire manager 380 has been described as including keyways 854 and 856, as is apparent to those of ordinary skill in the art, in alternate embodiments, the guide sleeve 370 may include one or more keyways and the wire manager 380 may include one or more key members. Further, in such embodiments, one or more of the key members 770 and 772 may be omitted from the guide sleeve 370, and one or more of the keyways 854 and 856 may be omitted from the wire manager 380.

Housing Doors

As mentioned above, each of the housing doors 390 and 392 pivots with respect to the housing 330. Turning to FIG. 28A, when the housing doors 390 and 392 are both in the open position, the wire manager 380 may be inserted into the internal cavity 396 (in a direction indicated by an arrow A5). Similarly, if the wire manager 380 is already inside the internal cavity 396 (as illustrated in FIG. 4), the wire manager 380 may be removed therefrom (in a direction opposite the direction indicated by the arrow A5) when the housing doors 390 and 392 are both in the open position.

As mentioned above, the wire manager 380 positions the wires JW1-JW8 to contact the wire contacts 361-368, respectively. As the housing doors 390 and 392 are closed, they push the wire manager 380 toward the wire contacts 361-368 helping to ensure that each of the wire contacts 361-368 successfully cuts through the insulation 144 (see FIG. 2) and contacts the conductor 142 (see FIG. 2) inside the appropriate one of the wires JW1-JW8. In this manner, when the housing doors 390 and 392 push the wire manager 380 forwardly, the wire contacts 361-368 cut through the insulation 144 surrounding the conductor 142 of the wires JW1-JW8, respectively. The wire contacts 361-368 connect the wires JW1-JW8, respectively, to the traces (not shown) on the substrate 354 (see FIG. 22). As explained above, the traces (not shown) connect the wire contacts 361-368 to the outlet contacts J1-J8 (see FIG. 20).

The housing doors 390 and 392 may be constructed from any material suitable for constructing the housing 330. The housing doors 390 and 392 may be substantially identical to one another or mirror images of one another.

Referring to FIG. 8, each of the housing doors 390 and 392 includes a forward portion 930 opposite a rearward portion 932. Referring to FIGS. 8 and 9, the forward portion 930 includes an upper and lower pivot pin 934 and 936. Referring to FIG. 28B, the upper pivot pin 934 (see FIG. 9) of the first housing door 390 is configured to be received inside the substantially circular recess 760 defined between the contoured projection 750A of the guide sleeve 370 and the contoured recess 429A of the housing 330. The lower pivot pin 936 of the first housing door 390 is configured to be received inside the substantially circular recess 760 defined between the contoured projection 750C (see FIG. 21B) of the guide sleeve 370 and the contoured recess 429C (see FIG. 18B) of the housing 330. The upper and lower pivot pins 934 and 936 of the first housing door 390 are configured to be selectively rotated (in directions indicated by double headed arrow A6 illustrated in FIG. 4) in the recesses 760 to position the first housing door 390 in either the open position (see FIGS. 4, 7, and 28A) or the closed position (see FIGS. 1, 5, and 6).

Referring to FIG. 9, the upper pivot pin 934 of the second housing door 392 is configured to be received inside the substantially circular recess 760 defined between the contoured projection 750B (see FIG. 21A) of the guide sleeve 370 and the contoured recess 429B (see FIG. 18B) of the housing 330. Referring to FIG. 8, the lower pivot pin 936 of the second housing door 392 is configured to be received inside the substantially circular recess 760 defined between the contoured projection 750D (see FIG. 21B) of the guide sleeve 370 and the contoured recess 429D (see FIG. 18B) of the housing 330. The upper and lower pivot pins 934 and 936 of the second housing door 392 are configured to be selectively rotated (in directions indicated by double headed arrow A7 illustrated in FIG. 4) in the recesses 760 to position the second housing door 392 in either the open position (see FIGS. 4, 7, 28A, and 28B) or the closed position (see FIGS. 1, 5, 6, and 28C).

Referring to FIG. 28B, when the housing doors 390 and 392 are both in the open position (see FIGS. 4, 7, and 28A), the wire manager 380 may be selectively removed from or placed inside the internal cavity 396. As mentioned above, closing the housing doors 390 and 392 with the wire manager 380 inside the internal cavity 396 pushes the wire manager 380 forward. When the housing doors 390 and 392 are both in the closed position (see FIGS. 1, 5, and 6), the wire manager 380 is maintained securely inside the internal cavity 396.

Referring to FIG. 28A, the forward portions 930 of the housing doors 390 and 392 each include an upper wire manager engaging portion 940 and a lower wire manager engaging portion 942. The upper and lower wire manager engaging portions 940 and 942 are positioned inwardly from the upper pivot pins 934 (see FIG. 9) and the lower pivot pins 936 (see FIG. 8) such that when the housing doors 390 and 392 are pivoted from the open position to the closed position, the upper and lower wire manager engaging portions 940 and 942 of the housing doors 390 and 392 are brought into physical contact with the upwardly and downwardly extending members 850 and 852, respectively, of the wire manager 380 and press forwardly thereupon. This forwardly directed force presses the wires JW1-JW8 (positioned in the recesses 861-868, respectively) against the wire contacts 361-368, respectively. Thus, each of the housing doors 390 and 392 may be characterized as being a cam, and the upwardly and downwardly extending members 850 and 852 may each be characterized as being a cam follower.

Referring to FIG. 7, the rearward portions 932 of the housing doors 390 and 392 each include cutouts or openings 948A and 948B, respectively. The openings 948A and 948B align to form a throughway into the internal cavity 396 of the housing 330 (see FIG. 6) and the passageway 814 of the wire manger 380 through which the cable C1 (see FIG. 4) may pass.

The rearward portions 932 of the first housing door 390 includes an aperture 950A configured to receive the upwardly extending anchor projection 890A of the wire manger 380, and an aperture 952A (see FIG. 9) configured to receive the downwardly extending anchor projection 892A of the wire manger 380. Similarly, the rearward portions 932 of the second housing door 392 includes an aperture 950C configured to receive the upwardly extending anchor projection 890C of the wire manger 380, and an aperture 952C configured to receive the downwardly extending anchor projection 892C of the wire manger 380. The rearward portions 932 of the housing doors 390 and 392 include cutouts or openings 960A and 960B, respectively, that align to form an aperture configured to receive the upwardly extending anchor projection 890B of the wire manger 380. Similarly, the rearward portions 932 of the housing doors 390 and 392 include cutouts or openings 962A and 962B, respectively, that align to form an aperture configured to receive the downwardly extending anchor projection 892B of the wire manger 380.

When the housing doors 390 and 392 are closed, they press downwardly on the upper cantilever member 886 allowing the upwardly extending anchor projections 890A and 890C to slide into the apertures 950A and 950C, respectively, and the upwardly extending anchor projection 890B to slide into the aperture formed by the aligned openings 960A and 960B. At the same time, the housing doors 390 and 392 press upwardly on the lower cantilever member 888 allowing the downwardly extending anchor projections 892A and 892C to slide into the apertures 952A and 952C, respectively, and the downwardly extending anchor projection 892B to slide into the aperture formed by the aligned openings 962A and 962B. Engagement between the apertures of the housing doors 390 and 392 and the anchor projections 890A-890C and 892A-892C helps maintain the wire manager 380 in a desired position with respect to the wire contacts 361-368 (see FIG. 20) and helps maintain the housing doors 390 and 392 in the closed position.

Referring to FIG. 28C, as mentioned above, when the housing doors 390 and 392 are closed, they press against the door engaging portions 926 of the conductive members 802 and 804 and form electrical connections therewith. Further, the forward portions 930 of the housing doors 390 and 392 are received between the upper and lower door gripping members 427 and 428 (see FIG. 18B) of the housing 330. The upper and lower door gripping members 427 and 428 help maintain the housing doors 390 and 392 in the closed position.

While the embodiment illustrated includes the housing doors 390 and 392, through application of ordinary skill to the present teachings, embodiments may be constructed that include a different number of housing doors (e.g., a single housing door).

Cable Termination

The cable C1 is termined by the outlet 120 as follows. First, referring to FIG. 26B, the end of the cable C1 being terminated is prepared. This preparation includes removing an end portion of the cable jacket 180J to expose the cable shield 140J, the drain wire JDW, the wires JW1-JW8, and the optional pairs shields JPS1-JPS4 (see FIG. 1), if present. Next, the cable shield 140J is folded back over the cable jacket 180J to define the folded back portion 146J, and the drain wire JDW is folded back and positioned adjacent the folded back portion 146J of the cable shield 140J.

Second, referring to FIG. 26A, the wire manager 380 is obtained. Referring to FIG. 7, if the wire manager 380 is housed inside the internal cavity 396 of the outlet 120, the housing doors 390 and 392 are opened, and the wire manager 380 is removed therefrom.

Third, referring to FIG. 26B, the housing 800 is placed in the open configuration and the prepared end of the cable C1 is positioned between the first and second portions 810 and 812 inside the open-ended central passageway 814.

Fourth, referring to FIG. 26C, the housing 800 is placed in the closed configuration by rotating the first portion 810 of the housing 800 in the direction indicated by the arrow A4 (see FIG. 26B) with respect to the second portion 812 of the housing 800 with the cable C1 inside the passageway 814 thereby compressing the cable C1 inside the passageway 814. Further, at least one of the shield engaging portions 920 and 922 (see FIG. 27) of the conductive members 802 and 804 contacts and forms an electrical connection with the folded back portion 146J (see FIG. 26B) of the cable shield 140J.

Fifth, referring to FIG. 26D, the wires JW1-JW8 are pressed into the recesses 861-868, respectively, and optionally trimmed (e.g., using a tool 980 such as a wire cutter). The gripping projection 870 that extends laterally into each of the recesses 861-868 (see FIG. 26A) helps maintain the wires JW1-JW8, respectively, therein.

Sixth, referring to FIG. 26E, the drain wire JDW is pressed into one of the drain wire channels 880 and 882 (see FIG. 24A). By way of a non-limiting example, in FIG. 26D, the drain wire JDW has been pressed into the drain wire channel 880. Inside the drain wire channel 880, the drain wire JDW contacts the drain wire contact portion 910 of one of the conductive members 802 and 804. Optionally, the drain wire JDW may be trimmed (e.g., using the tool 980 illustrated in FIG. 26D).

Seventh, referring to FIG. 28A, when the housing doors 390 and 392 are both in open positions, and the wire manager 380 is inserted into the internal cavity 396 (in the direction indicated by the arrow A5). FIGS. 4 and 7 each show the housing doors 390 and 392 in open positions and the wire manager 380 positioned inside the internal cavity 396. In FIG. 7, the cable C1 has been omitted. FIG. 28B shows the housing door 392 in the open position and the wire manager 380 positioned inside the internal cavity 396. In FIG. 28B, the housing door 390 has been removed or exploded.

Finally, the housing doors 390 and 392 are both closed, which presses the wire manager 380 inwardly to help ensure the wire contacts 361-368 slice through the outer layers of insulation 144 of the wires JW1-JW8, respectively, and form electrical connections with the conductors 142 of the wires JW1-JW8, respectively. As also explained above, the wire contacts 361-368 are connected to the outlet contacts J1-J8, respectively. Further, at least one of the door engaging portions 926 of the conductive members 802 and 804 contacts the housing doors 390 and 392 and forms an electrical connection therewith.

In this manner, the outlet 120 enables tooless termination of the cable C1.

After the cable C1 has been terminated by the outlet 120, the plug 100 may be inserted into the outlet 120 to form the connection 10 illustrated in FIG. 1. Inside the connection 10, the plug contacts P1-P8 contact and form electrical connections with the outlet contacts J1-J8. The plug contacts P1-P8 are electrically connected to the wires PW1-PW8, respectively, and the outlet contacts J1-J8 are electrically connected to the wires JW1-JW8, respectively. Thus, the wires PW1-PW8 are connected to the wires JW1-JW8, respectively, by the connection 10.

Further, when the plug 100 is inserted into the plug receiving opening 312, the ground springs 340A and 340B (see FIGS. 8-10) contact the plug housing 150 and form an electrical connection between the plug housing 150 and the outlet housing 330. The outlet housing 330 is connected to the housing doors 390 and 392, which are electrically connected (by the conductive members 802 and 804) to the drain wire JDW, the cable shield 140J, and/or the optional pair shields JPS1-JPS4, if present. As mentioned above, the housing 150 of the plug 100 may be connected to the drain wire PDW, the cable shield 140P, and/or the optional pair shields PPS1-PPS4, if present, of the cable C2. Thus, a continuous ground may be maintained across the connection 10.

Referring to FIG. 5, the outlet 120 may offer one or more advantages over prior art RJ-45 type outlets. For example, the locking shutter subassembly 320 helps prevent the insertion of debris and/or foreign objects (e.g., tools, fingers, etc.) into the plug receiving opening 312 (formed in the face plate 310). The outlet 120 enables tooless termination of the cable C1. The wire manager 380 may provide substantial contact area between the housing 330 (see FIG. 28A-28C) and at least one of the cable shield 140J, the drain wire JDW, and the optional pair shields JPS1-JPS2 (see FIG. 1). The outlet 120 may include snap closures and is easily to assemble. The outlet 120 provides dedicated termination of the drain wire JDW to at least one of the conductive members 802 and 804. The housing doors 390 and 392 (cams) provide mechanical advantage with a small lever arm and allow for a short overall outlet length. Engagement of the key member 770 with the upper keyway 854 (see FIG. 25B), and the key member 772 with the lower keyway 856 (see FIG. 25B) helps ensure correct alignment of the wire manager 380 and the wire contacts 361-368. The outlet 120 includes a conductive housing 330 and conductive housing doors 390 and 392 for improved electrical performance.

Alternate Embodiment

Figure 29:
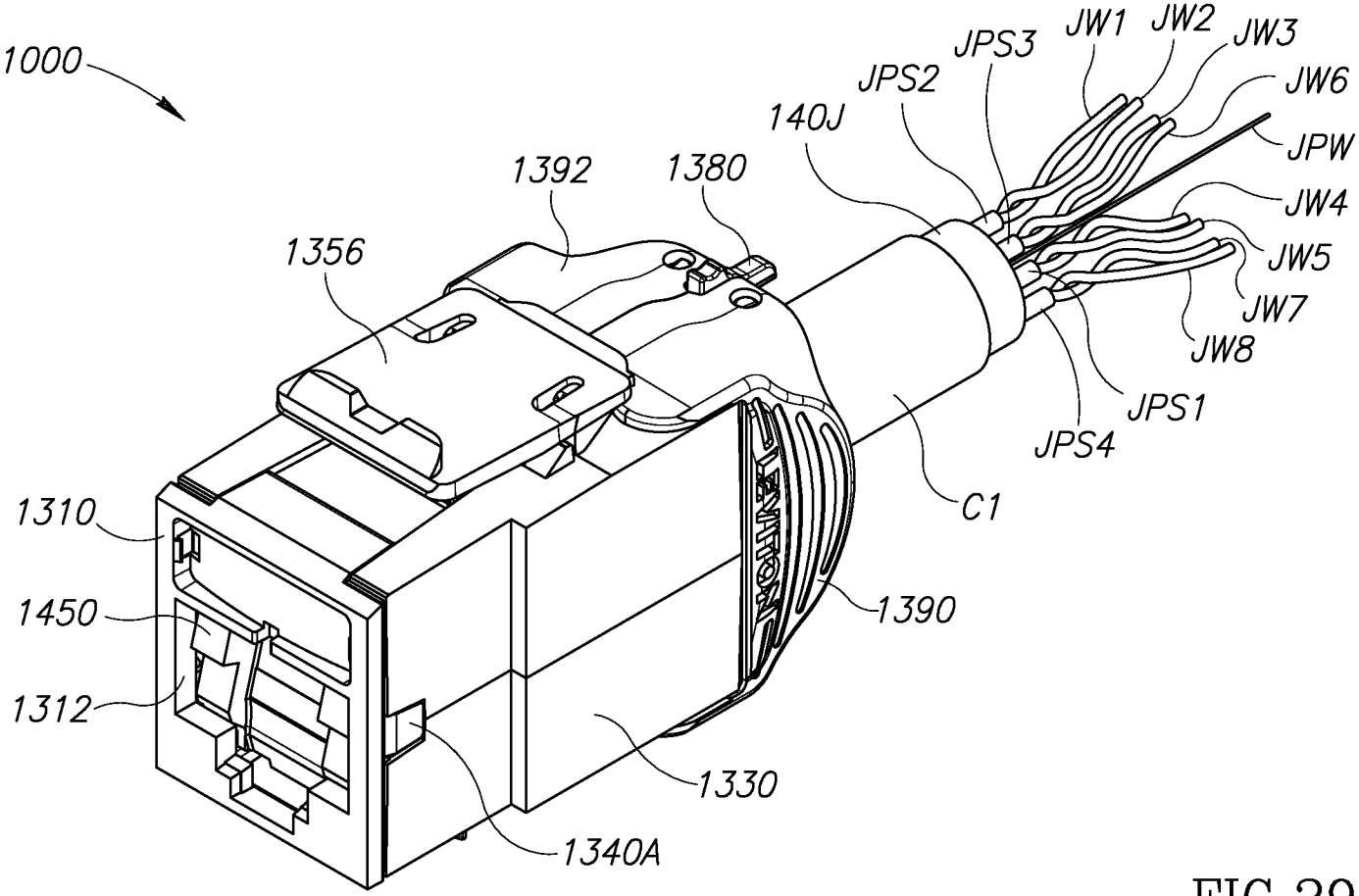
FIG. 29 is a perspective view of a front of a second embodiment of a communication outlet terminating a cable.

FIG. 29 is a perspective view of an outlet 1000 that is an alternate embodiment of the outlet 120 (see FIGS. 1 and 4-10). Like the outlet 120, the outlet 1000 is configured to terminate the communication cable C1 and form a communication connection (like the connection 10 depicted in FIG. 1) with the plug 100 (see FIGS. 1, 3, and 4). For ease of illustration, like reference numerals have been used in the drawings to identify like components.

The outlet 1000 may be implemented as a Category 8, RJ-45 outlet (or port). Further, the outlet 1000 may be implemented as a lower category outlet, such as a Category 6A outlet, a Category 6 outlet, a Category 5E outlet, and the like.

Figure 30:
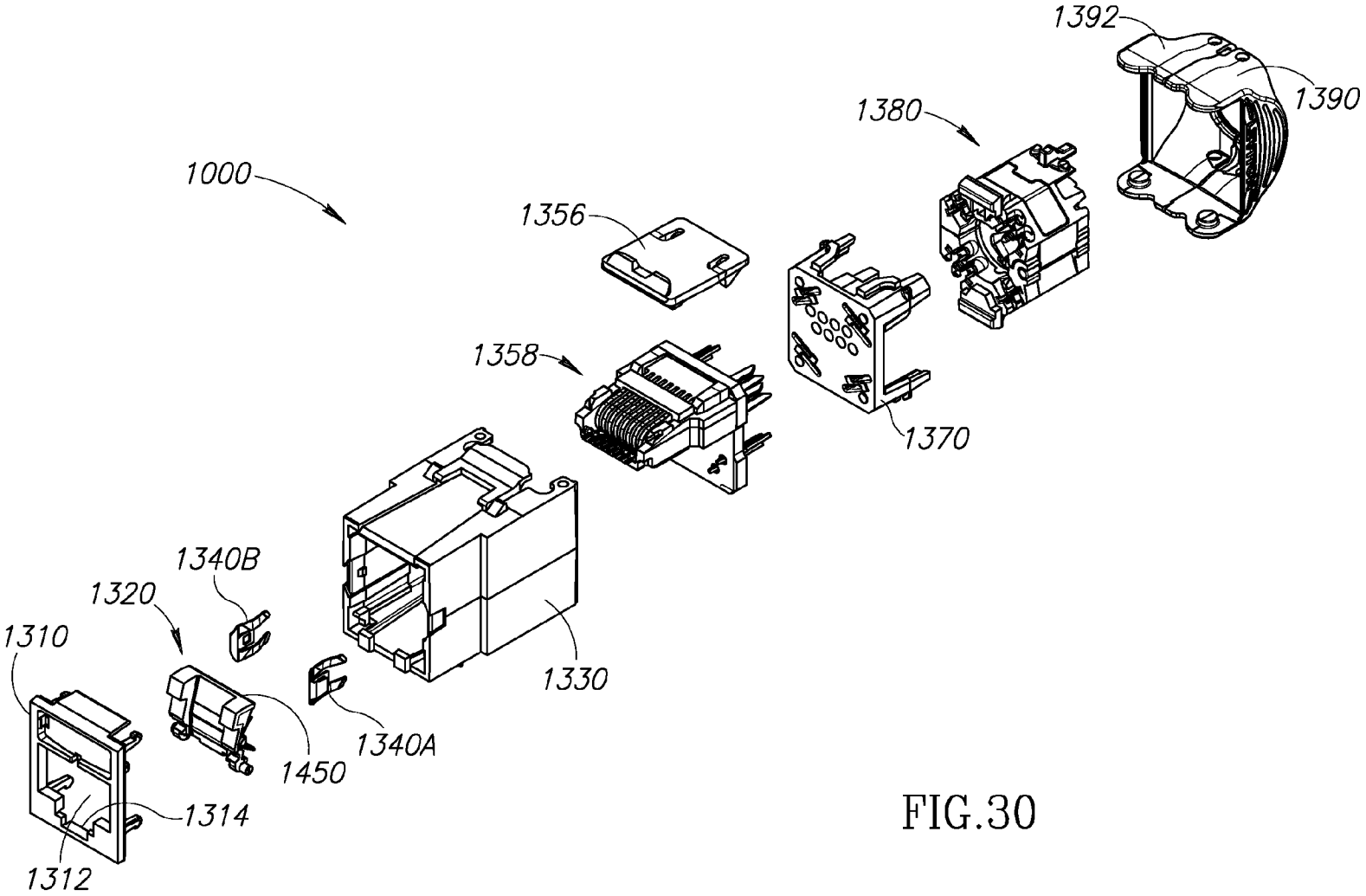
FIG. 30 is a partially exploded perspective view of the outlet of FIG. 29.

Referring to FIG. 30, the outlet 1000 includes a face plate 1310, a shutter subassembly 1320, a housing 1330, one or more ground springs 1340A and 1340B, an optional clip or latch member 1356, a contact subassembly 1358, a guide sleeve 1370, a wire manager 1380, and housing doors 1390 and 1392. Together the face plate 1310, the housing 1330, and the housing doors 1390 and 1392 house internal components of the outlet 1000 (e.g., the shutter subassembly 1320, the contact subassembly 1358, the guide sleeve 370, and the wire manager 380). The ground springs 1340A and 1340B clip to the housing 1330 in the same manner that the ground springs 340A and 340B (see FIGS. 8-11 and 19) clip to the housing 330 (see FIGS. 1, 5-11, 18A-19, and 28A-28C). The latch member 1356 may be attached to the housing 1330 or formed as part of the housing 1330. The latch member 1356 is configured to (removably or permanently) attach the outlet 1000 inside an aperture (not shown) formed in an external structure (not shown), such as a patch panel, rack, wall outlet, and the like.

The contact subassembly 1358 includes outlet contacts, a contact positioning member, a substrate, and wire contacts substantially identical to the outlet contacts 342, the contact positioning member 352, the substrate 354, and the wire contacts 360, respectively, of the contact subassembly 358 (see FIG. 20). Optionally, the contact subassembly 1358 includes a spring assembly substantially identical to the optional spring assembly 350.

Referring to FIGS. 8 and 30, the face plate 1310, the housing 1330, the ground springs 1340A and 1340B, the latch member 1356, and the contact subassembly 1358 are substantially identical to the face plate 310, the housing 330, the ground springs 340A and 340B, the latch member 356, and the contact subassembly 358, respectively. Further, these components of the outlet 1000 provide substantially identical functionality to those corresponding components of the outlet 120. Therefore, these components of the outlet 1000 have not been described in detail below.

Shutter Subassembly

Referring to FIGS. 31A-32B, the shutter subassembly 1320 includes a shutter door 1450 and at least one biasing member (e.g., a biasing member 1454). Like the locking shutter subassembly 320 (see FIGS. 5, 8-12, and 15A-17), the shutter subassembly 1320 helps prevent debris (e.g., dust and dirt) from entering the outlet 1000 (see FIGS. 29, 30, and 34-36) through a plug receiving opening 1312 (see FIGS. 29 and 30) substantially identical to the plug receiving opening 312 (see FIGS. 5 and 8-11) of the outlet 120 (see FIGS. 1 and 4-10). However, unlike the locking shutter subassembly 320 (see FIGS. 5, 8-12, and 15A-17) of the outlet 120, the shutter subassembly 1320 is not configured to lock and unlock. Instead, the shutter door 1450 may be opened by pressing upon it through the plug receiving opening 1312 (see FIGS. 29 and 30).

Figure 31A:
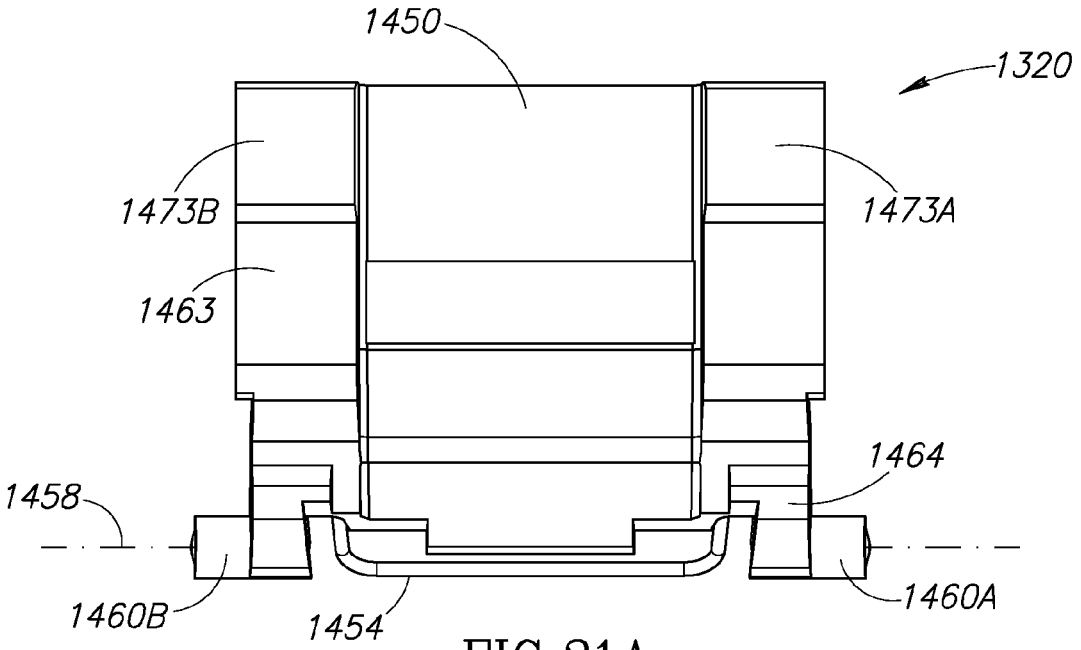
FIG. 31A is a front view of a shutter door of a shutter subassembly of the outlet of FIG. 29.
Figure 31B:
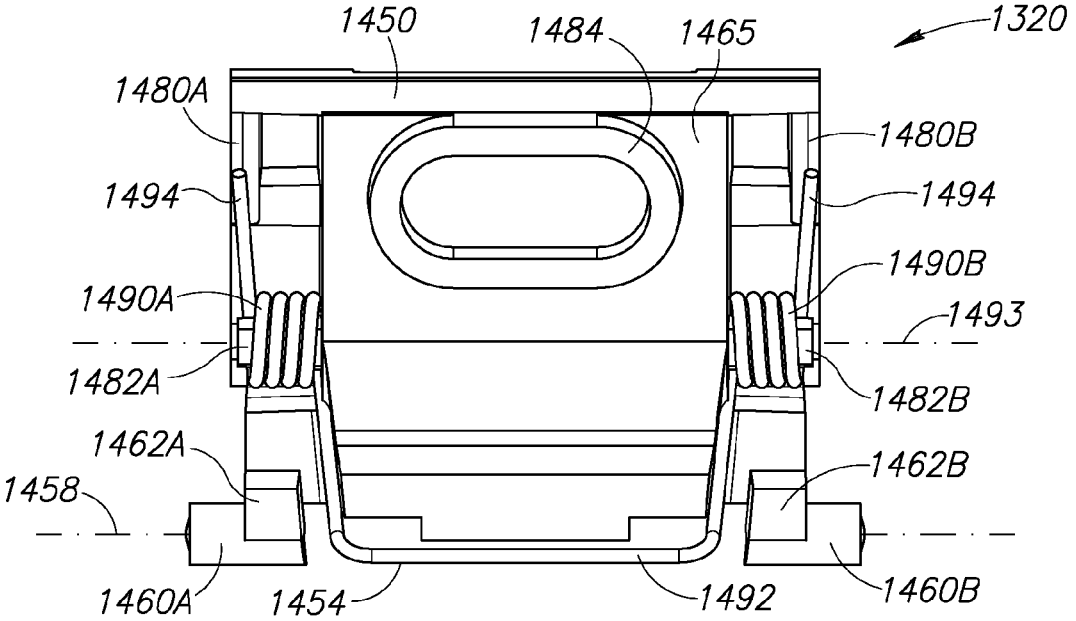
FIG. 31B is a rear view of the shutter door of FIG. 31A.

Referring to FIGS. 29 and 30, the shutter door 1450 is sized and shaped to cover (or close) the plug receiving opening 1312 formed in the face plate 1310 to prevent contaminants from being received inside the outlet 1000. Referring to FIGS. 31A and 31B, the shutter door 1450 is configured to pivot about a door pivot axis 1458 with respect to the housing 1330 (see FIGS. 29, 30, and 34-36) between a closed position (see FIGS. 29-32A) and an open position (see FIG. 32B). In the embodiment illustrated, pivot pins 1460A and 1460B are formed along a lower portion 1464 of the shutter door 1450. The pivot pins 1460A and 1460B extend outwardly away from one another along the door pivot axis 1458. Referring to FIG. 31B, in the embodiment illustrated, the pivot pins 1460A and 1460B extend outwardly from downwardly extending legs 1462A and 1462B, respectively.

The shutter door 1450 has a front facing portion 1463 (see FIG. 31A) opposite a rearward facing portion 1465 (see FIG. 31B). Referring to FIG. 31A, the front facing portion 1463 (see FIG. 13) may include one or more plug-engaging projections 1473A and 1473B that extend forwardly into the plug receiving opening 1312 (see FIGS. 29 and 30) of the face plate 1310 (see FIGS. 29 and 30). When the plug 100 (see FIGS. 1, 3, and 4) is inserted into the plug receiving opening 1312, the forward facing portion 154 (see FIGS. 3 and 4) of the plug 100 presses against the plug-engaging projections 1473A and 1473B.

Referring to FIG. 31B, the rearward facing portion 1465 includes first and second tapered portions 1480A and 1480B. Pins 1482A and 1482B are positioned on opposite sides of the shutter door 1450. The pins 1482A and 1482B are spaced apart from the first and second tapered portions 1480A and 1480B, respectively. The pins 1482A and 1482B are aligned along an axis 1493. The axis 1493 is offset from and substantially parallel with the pivot axis 1458. In the embodiment illustrated, the first and second tapered portions 1480A and 1480B each taper rearwardly away from the pins 1482A and 1482B, respectively. Optionally, the rearward facing portion 1465 may include a projection or spacer 1484.

Referring to FIGS. 31B-32B, the biasing member 1454 applies a biasing force to the rearward facing portion 1465 of the shutter door 1450 that biases the shutter door 1450 toward the closed position (see FIGS. 29-32A). By way of a non-limiting example, the biasing member 1454 may be constructed from metal wire, plastic, and the like.

Referring to FIG. 31B, in the embodiment illustrated, the biasing member 1454 includes a pair of spaced apart coil springs 1490A and 1490B connected together by a U-shaped (connecting) portion 1492. The coil springs 1490A and 1490B are mounted on the pins 1482A and 1482B, respectively. The windings of the coil springs 1490A and 1490B may be selectively tightened and loosed about the axis 1493. Each of the coil springs 1490A and 1490B has a forwardly extending free end portion 1494. The free end portion 1494 of the coil spring 1490A is configured to press against the first tapered portion 1480A, and the free end portion 1494 of the coil spring 1490B is configured to press against the second tapered portion 1480B. In the embodiment illustrated, the first and second tapered portions 1480A and 1480B are each sloped or curved such that the free end portions 1494 of the coil springs 1490A and 1490B may slide forwardly along the first and second tapered portions 1480A and 1480B, respectively.

Referring to FIGS. 31A-32B, the biasing member 1454 is positioned behind the shutter door 1450 inside the housing 1330 (see FIGS. 29, 30, and 34-36). Referring to FIG. 31B, the coil springs 1490A and 1490B bias the U-shaped portion 1492 against the inside of the housing 1330 (see FIGS. 29, 30, and 34-36). At the same time, the coil springs 1490A and 1490B bias the free end portions 1494 of the coil springs 1490A and 1490B against the first and second tapered portions 1480A and 1480B, respectively. Thus, resistance in the coil springs 1490A and 1490B press the free end portions 1494 of the coil springs 1490A and 1490B against the shutter door 1450, which pushes or biases the shutter door 1450 forwardly away from the U-shaped portion 1492 about the pivot axis 1458. In this manner, the biasing member 1454 biases the shutter door 1450 toward the closed position (see FIGS. 29-32A), which helps maintain the shutter door 1450 in the closed position.

The shutter door 1450 may be pivoted about the door pivot axis 1458 from the closed position (see FIGS. 29-32A) to the open position (see FIG. 32B) by pressing inwardly (in the direction indicated by an arrow A8 illustrated in FIG. 32A) on the front facing portion 1463 (e.g., on the plug-engaging projections 1473A and 1473B shown in FIG. 31A) of the shutter door 1450 with sufficient force to overcome the biasing force applied to the rearward facing portion 1465 of the shutter door 1450 by the biasing member 1454. As the shutter door 450 opens, the biasing member 1454 is compressed. In the embodiment illustrated, as the shutter door 450 opens the coil springs 1490A and 1490B are wound tighter, and the U-shaped portion 1492 slides rearwardly along the inside of the housing 1330 (see FIGS. 29, 30, and 34-36). At the same time, the free end portions 1494 of the coil springs 1490A and 1490B slide (e.g., downwardly) along the first and second tapered portions 1480A and 1480B, respectively. Optionally, the spacer 1484 may rest upon the inside of the housing 1330 (see FIGS. 29, 30, and 34-36) when the shutter door 1450 is in the open position.

Figure 32A:
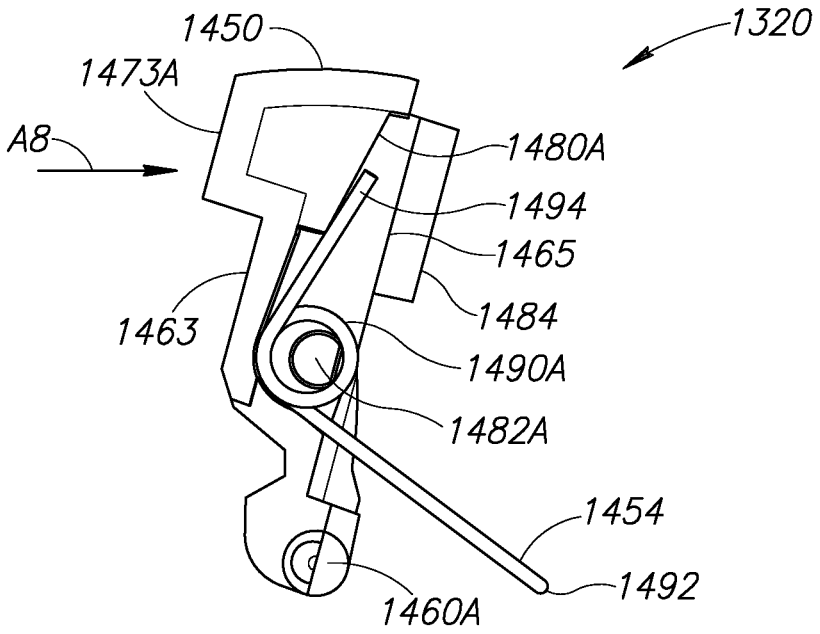
FIG. 32A is a side view of the shutter subassembly of FIG. 31A with the shutter door in a closed position.
Figure 32B:
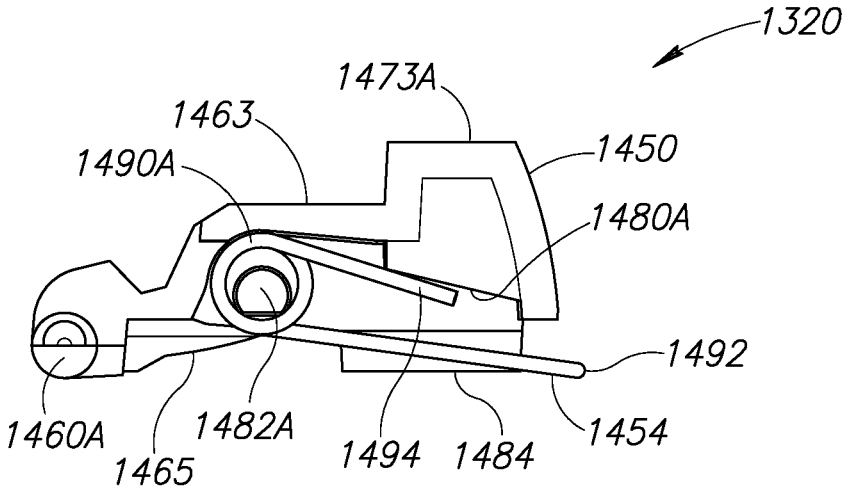
FIG. 32B is a side view of the shutter subassembly of FIG. 31A with the shutter door in an open position.

Referring to FIG. 32B, when the shutter door 1450 is in the open position, the U-shaped portion 1492 continues to press against the inside of the housing 1330 (see FIGS. 29, 30, and 34-36) and the free end portions 1494 of the coil springs 1490A and 1490B continue to press against the first and second tapered portions 1480A and 1480B, respectively. Thus, when insufficient force is applied to the front facing portion 1463 to maintain the shutter door 1450 in the open position, the biasing member 1454 returns the shutter door 1450 to the closed position. As the shutter door 450 closes, the biasing member 1454 is uncompressed. In the embodiment illustrated, as the shutter door 450 closes, the windings of coil springs 1490A and 1490B loosen, and the U-shaped portion 1492 slides forwardly along the inside of the housing 1330 (see FIGS. 29, 30, and 34-36). At the same time, the free end portions 1494 of the coil springs 1490A and 1490B slide (e.g., upwardly) along the first and second tapered portions 1480A and 1480B, respectively.

Referring to FIG. 3, when the plug 100 is inserted into the outlet 1000 (see FIGS. 29, 30, and 34-36), the portion 162 and/or the forward facing portion 154 of the plug 100 presses on the front facing portion 1463 (see FIGS. 31A, 32A, and 32B) of the shutter door 1450 (see FIGS. 29-32B). Referring to FIG. 32B, if the plug 100 (see FIGS. 1, 3, and 4) is inserted into the outlet 1000 with sufficient force to overcome the biasing force exerted by the biasing member 1454 (see FIGS. 31A-32B) on the rearward facing portion 1465 of the shutter door 1450, the shutter door 1450 pivots from the closed position (see FIGS. 29-32A) to the open position depicted in FIG. 32B. Then, the plug 100 may be latched inside the outlet 1000 (see FIGS. 29, 30, and 34-36) by the latch arm 160 (see FIGS. 3 and 4) to maintain the shutter door 1450 in the open position. Thus, when the plug 100 is inserted into the outlet 1000, the plug 100 pushes the shutter door 1450 inwardly allowing the plug contacts P1-P8 (see FIG. 3) to engage the outlet contacts (substantially identical to the outlet contacts 342 illustrated in FIGS. 8-10 and 20) of the contact subassembly 1358. Further, the latch arm 160 (see FIGS. 3 and 4) may be latched to a lip 1314 (see FIG. 30) of the face plate 1310. The lip 1314 is substantially identical to the lip 314 (see FIG. 11). When the latch arm 160 is unlatched from the lip 1314 (see FIG. 30) of the face plate 1310, and the plug 100 is removed from the outlet 1000, the biasing member 1454 (see FIGS. 31A-32B) biases the shutter door 1450 toward the closed position. Thus, when the plug 100 is removed, the shutter door 450 automatically returns to the closed position.

As mentioned above, the shutter subassembly 1320 is configured to permit the plug 100 to enter the outlet 1000, and prevent debris and contaminants from entering the outlet 1000. Thus, the shutter subassembly 1320 may be configured to provide a factory configurable solution that protects the outlet 1000 against contaminants (such as dust).

Guide Sleeve

Figure 33:
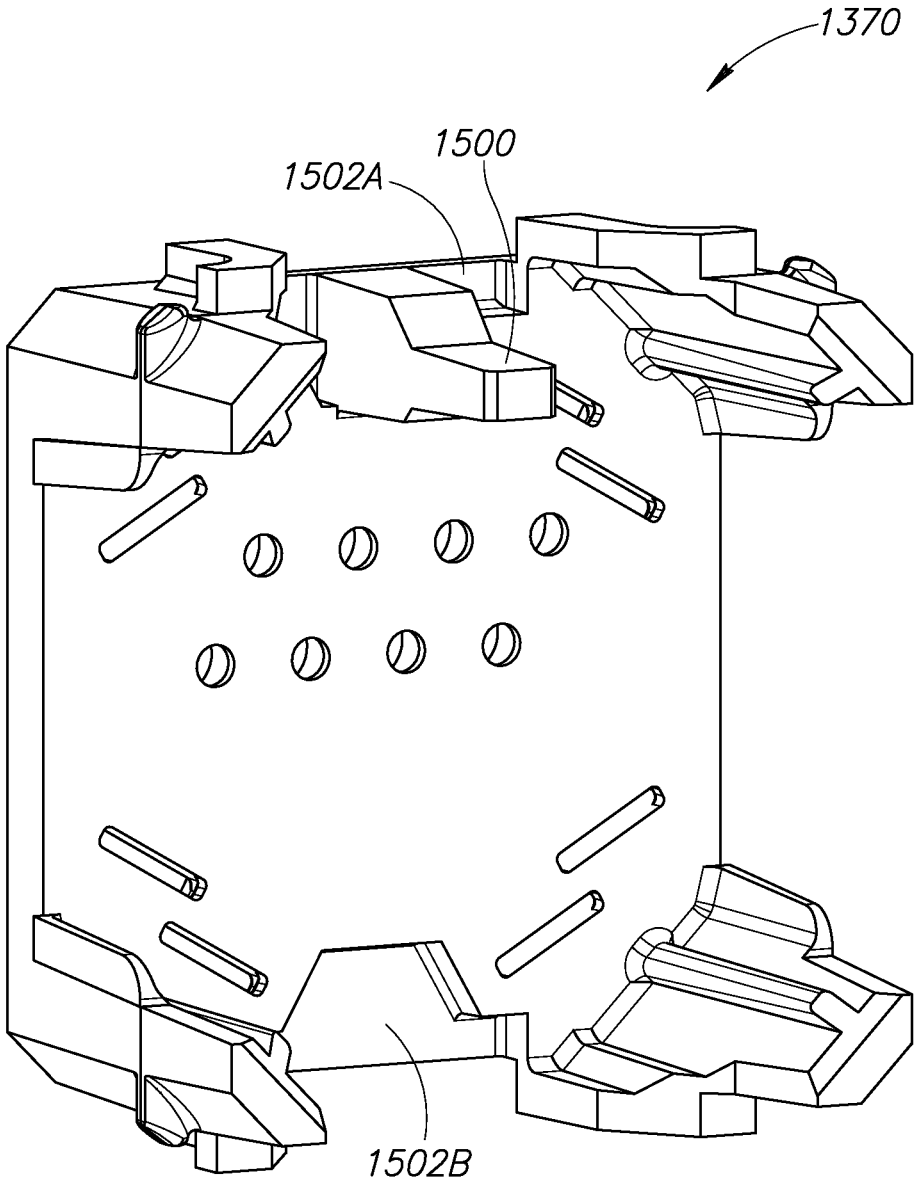
FIG. 33 is a perspective view of a guide sleeve of the outlet of FIG. 29.

Referring to FIG. 33, the guide sleeve 1370 is substantially similar to the guide sleeve 370 (see FIGS. 8-10, 21A-22, and 28A) and provides substantially identical functionality thereto. However, in the embodiment illustrated, the guide sleeve 1370 includes a single key member 1500 instead of the key member 770 (see FIG. 21B) and the key member 772 (see FIG. 21B). The key member 1500 is positioned inside and extends rearwardly from a first recess 1502A. The guide sleeve 1370 also includes a second recess 1502B spaced apart from the first recess 1502A. The first and second recesses 1502A and 1502B may be mirror images of one another. However, this is not a requirement.

Wire Manager

Figure 34:
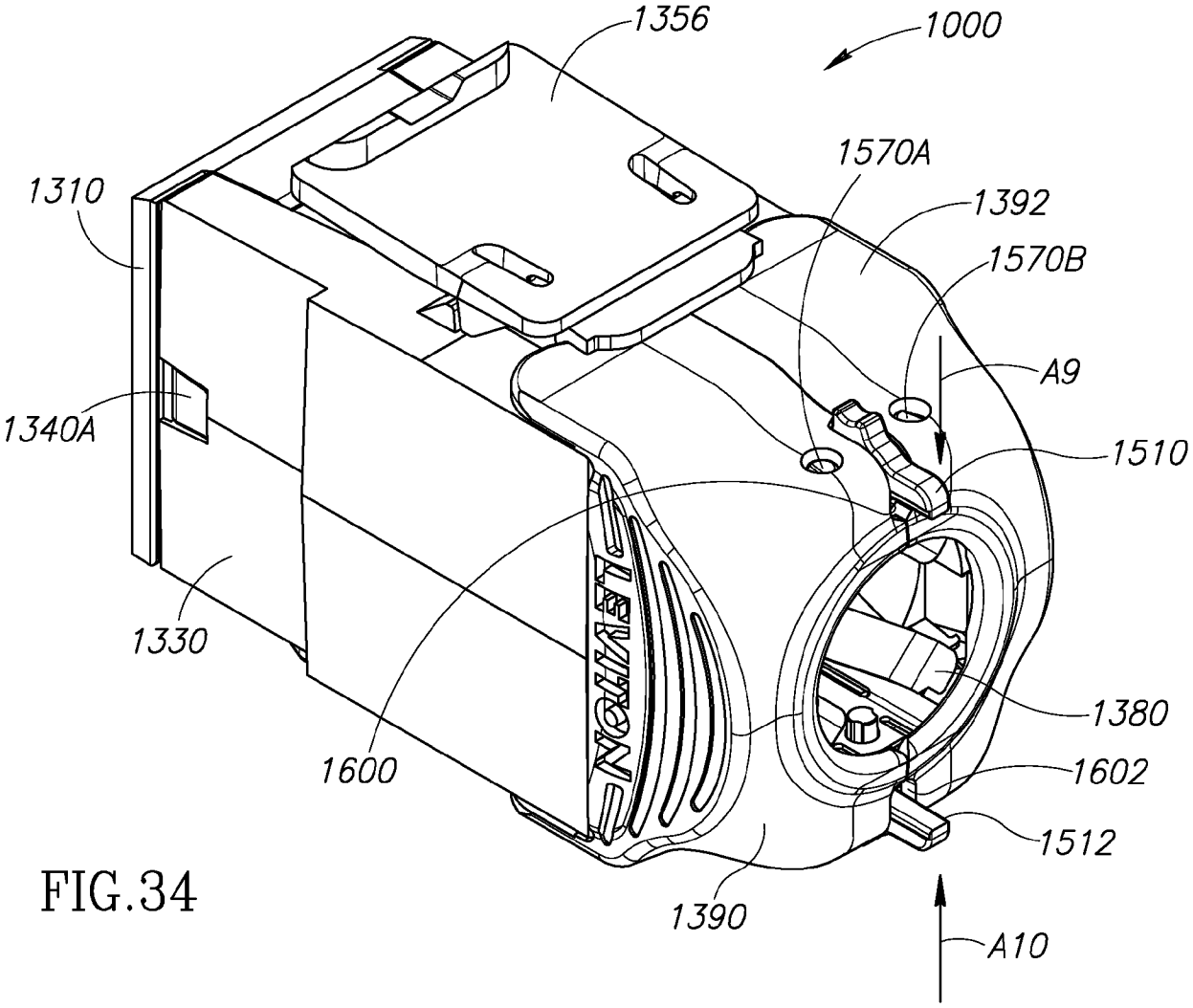
FIG. 34 is a perspective view of a rear of the outlet of FIG. 29 with its housing doors closed and its release levers in locked positions.
Figure 35:
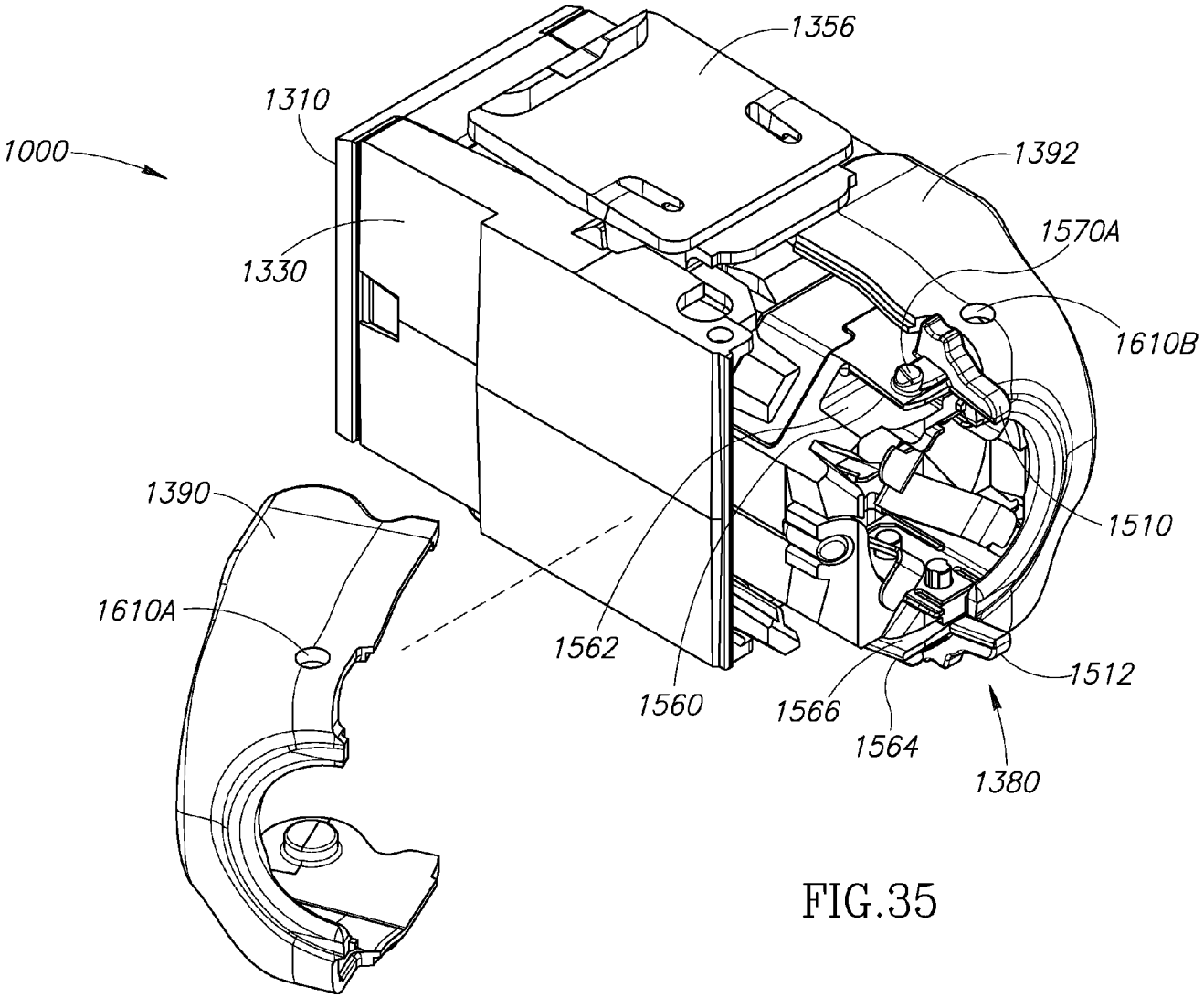
FIG. 35 is a perspective view of the rear of the outlet of FIG. 29 depicted with one of its housing doors removed (or exploded), the other housing door in the closed position, and the release levers in unlocked positions.
Figure 36:
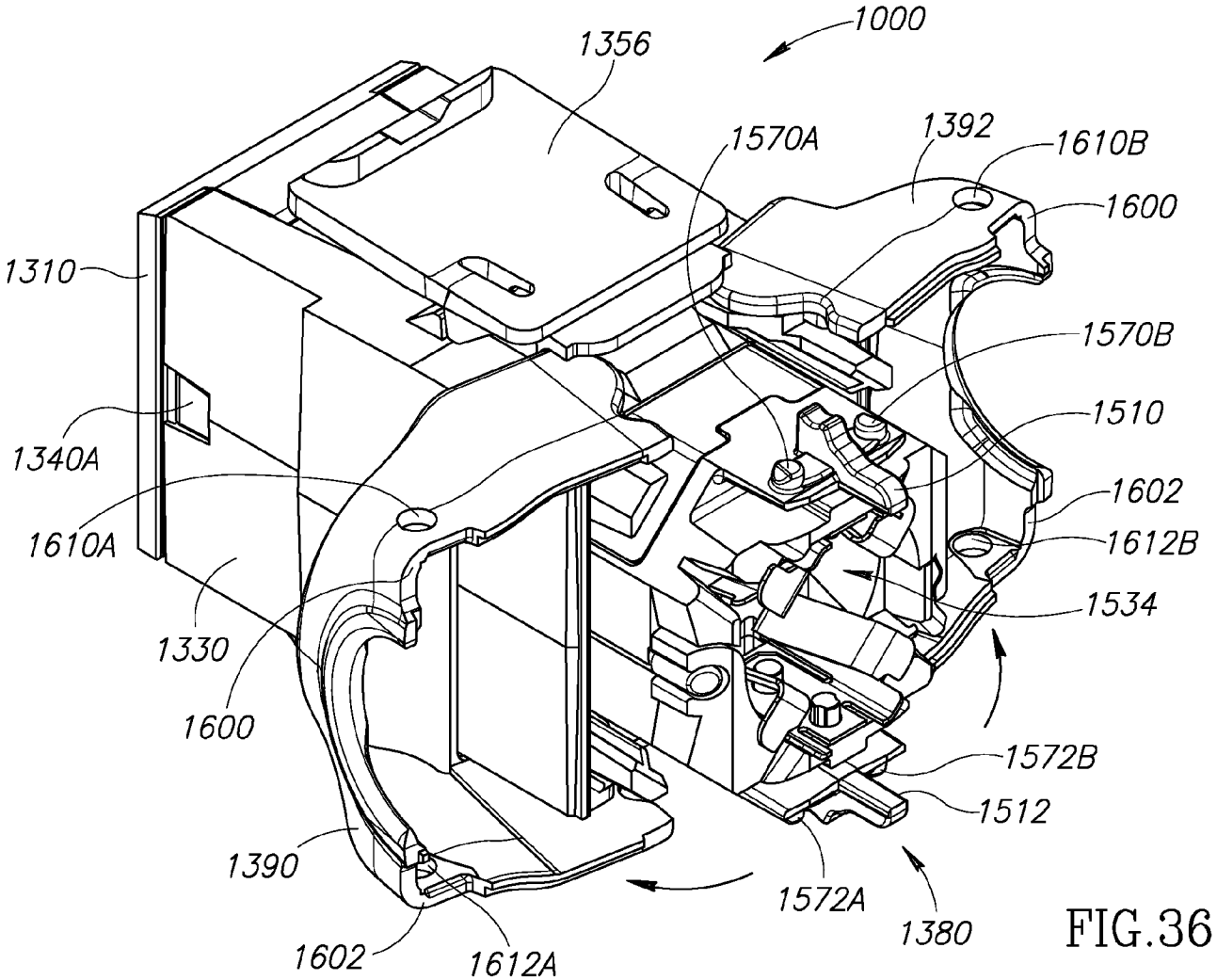
FIG. 36 is a perspective view of the rear of the outlet of FIG. 29 with its housing doors open and its release levers in locked positions.

Referring to FIGS. 34-36, the wire manager 1380 is substantially similar to the wire manager 380 (see FIGS. 7-10, 22-26E, and 28A) and provides substantially identical functionality thereto. Therefore, only differences between the wire manager 1380 and the wire manager 380 will be described in detail.

One difference between the wire manager 380 (see FIGS. 7-10, 22-26E, and 28A) and the wire manager 1380 is that the wire manager 1380 includes release levers 1510 and 1512 instead of the anchor projections 890B and 892B (see FIGS. 7 and 24A), respectively. The release levers 1510 and 1512 extend rearwardly and outwardly through the housing doors 1390 and 1392. As will be described below, the wire manager 1380 is configured to hold or retain the housing doors 1390 and 1392 in closed positions (see FIG. 34) when the release levers 1510 and 1512 are in locked positions (see FIG. 34). Conversely, the wire manager 1380 is configured to release the housing doors 1390 and 1392 so they can be rotated into open positions (see FIG. 36) when the release levers 1510 and 1512 are in unlocked positions (see FIG. 35).

In the embodiment illustrated, the release levers 1510 and 1512 remain in locked positions (see FIG. 34) until they are manually transitioned to unlocked positions (see FIG. 35) by a user. Referring to FIG. 34, the release levers 1510 and 1512 are transitioned to unlocked positions by pressing (or squeezing) them toward one another (in directions identified by arrows A9 and A10). Referring to FIG. 35, the release levers 1510 and 1512 are in unlocked positions when the release levers 1510 and 1512 have been deflected sufficiently toward one another.

Figure 37:
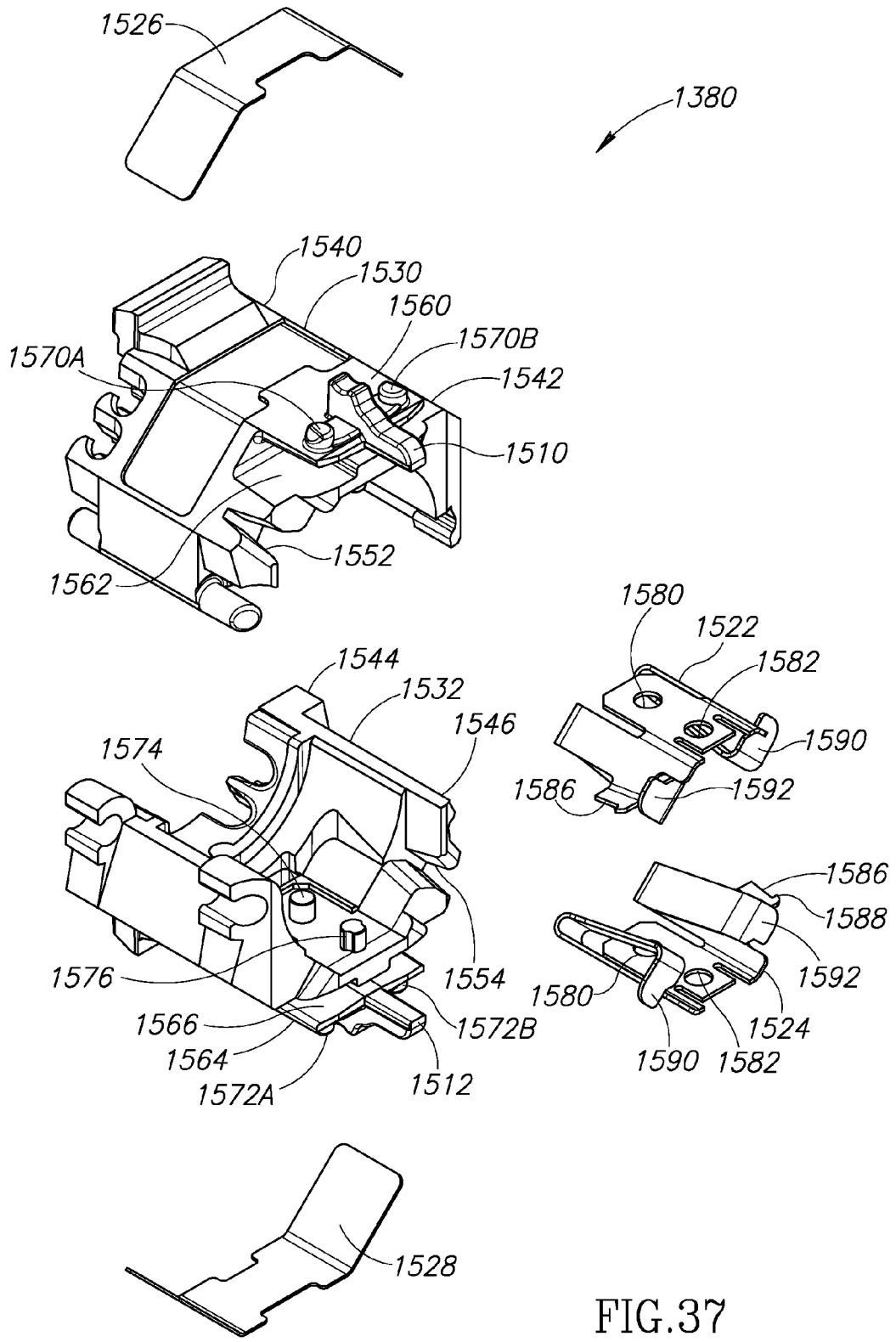
FIG. 37 is a rear exploded perspective view of a wire manager of the outlet of FIG. 29.

Referring to FIG. 37, the wire manager 1380 includes a housing 1520 (see FIGS. 38A and 38B), one or more conductive members 1522 and 1524, and optional labels 1526 and 1528. The housing 1520 includes a first portion 1530 rotatably connected to a second portion 1532. Like the first and second portions 810 and 812 (see FIGS. 23A-26D), the first and second portions 1530 and 1532 are selectively rotatable between open and closed configurations. In the open configuration (not shown), the cable C1 (see FIGS. 1, 4, 26B-26E, 28A, 29, 38A, and 38B) may be positioned inside and coupled to the wire manager 1380 in the same manner the cable C1 may be positioned inside and coupled to the wire manager 380 (see FIGS. 7-10, 22-26E, and 28A). Then, at least one of the first and second portions 1530 and 1532 may be rotated to place the first and second portions 1530 and 1532 in the closed configuration to thereby clamp the cable C1 inside an open-ended central passageway 1534 (see FIG. 36) defined between the first and second portions 1530 and 1532. Both the first and second portions 1530 and 1532 are constructed from a dielectric material. The optional labels 1526 and 1528 may be adhered along outer surfaces of the first and second portions 1530 and 1532, respectively.

Figure 38A:
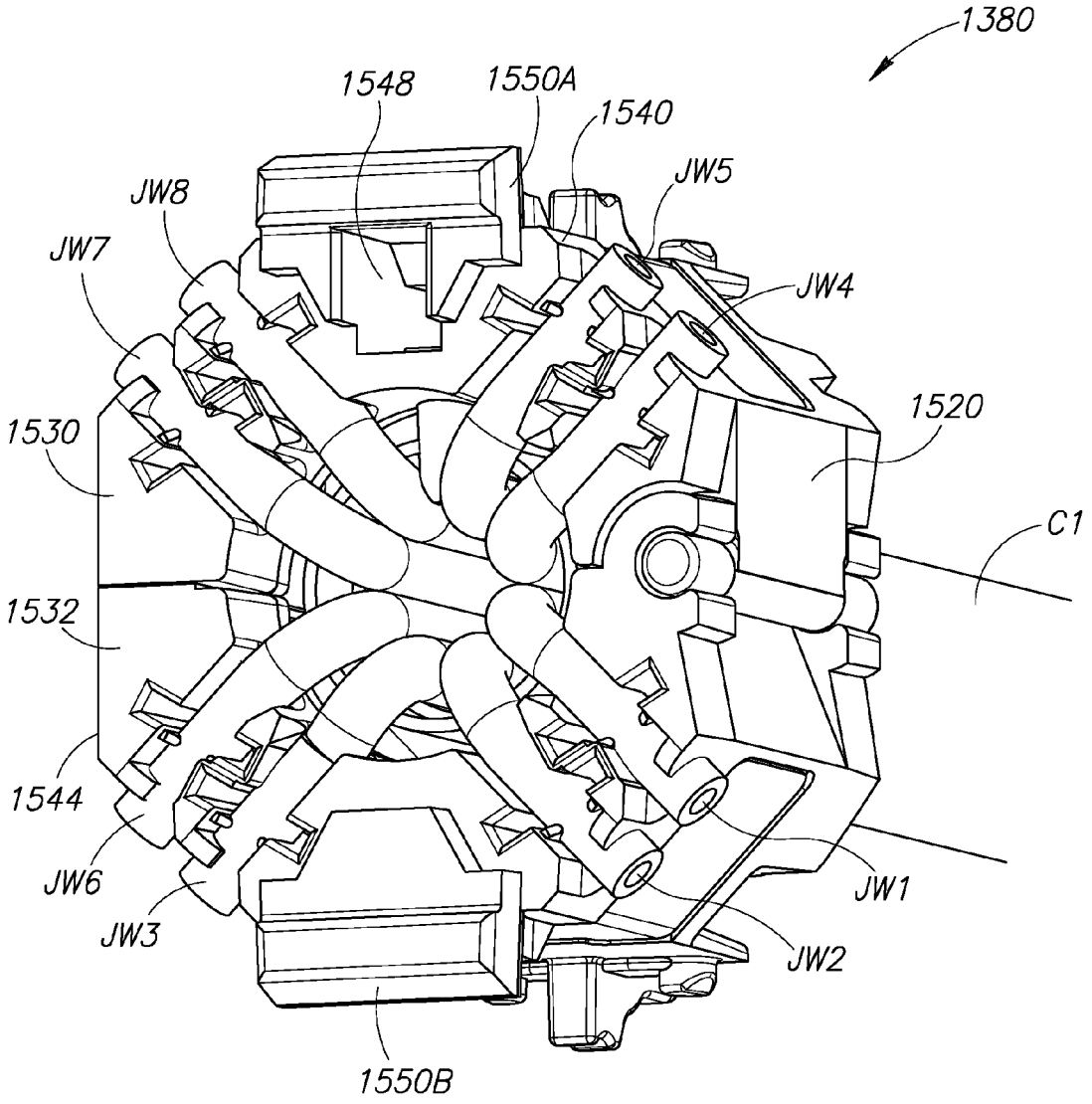
FIG. 38A is a front perspective view of the wire manager of FIG. 37 depicted in a closed configuration with the wires of the cable inserted into wire channels (or recesses) formed in the wire manager.

The first portion 1530 has a forward portion 1540 opposite a rearward portion 1542. Similarly, the second portion 1532 has a forward portion 1544 opposite a rearward portion 1546. As shown in FIG. 38A, the wire manager 1380 has a single keyway 1548 (instead of the upper and lower keyways 854 and 856 depicted in FIG. 21B) formed in the forward portion 1540 of the first portion 1530 of the housing 1520. The keyway 1548 is configured to receive the key member 1500 (see FIG. 33) of the guide sleeve 1370 (see FIGS. 30 and 33). The keyway 1548 is formed in an upper forwardly projecting portion 1550A. A lower forwardly projecting portion 1550B is formed in the forward portion 1544 of the second portion 1532 of the housing 1520. The projecting portions 1550A and 1550B are configured to be at least partially received by the recesses 1502A and 1502B (see FIG. 33), respectively, of the guide sleeve 1370.

The wire manager 1380 is properly aligned with the guide sleeve 1370 (see FIGS. 30 and 33) when the keyway 1548 is positioned to receive the key member 1500. If the wire manager 1380 is not properly aligned with the guide sleeve 1370, the wire manager 1380 cannot be fully inserted inside the guide sleeve 1370 and the housing doors 1390 and 1392 (see FIGS. 29, 30, and 34-36) cannot be closed with the wire manager 1380 inside the housing 1330 (see FIGS. 29, 30, and 34-36). Thus, the keyway 1548 and the key member 1500 help ensure proper orientation of the wire manager 1380 with respect to the guide sleeve 1370.

Figure 38B:
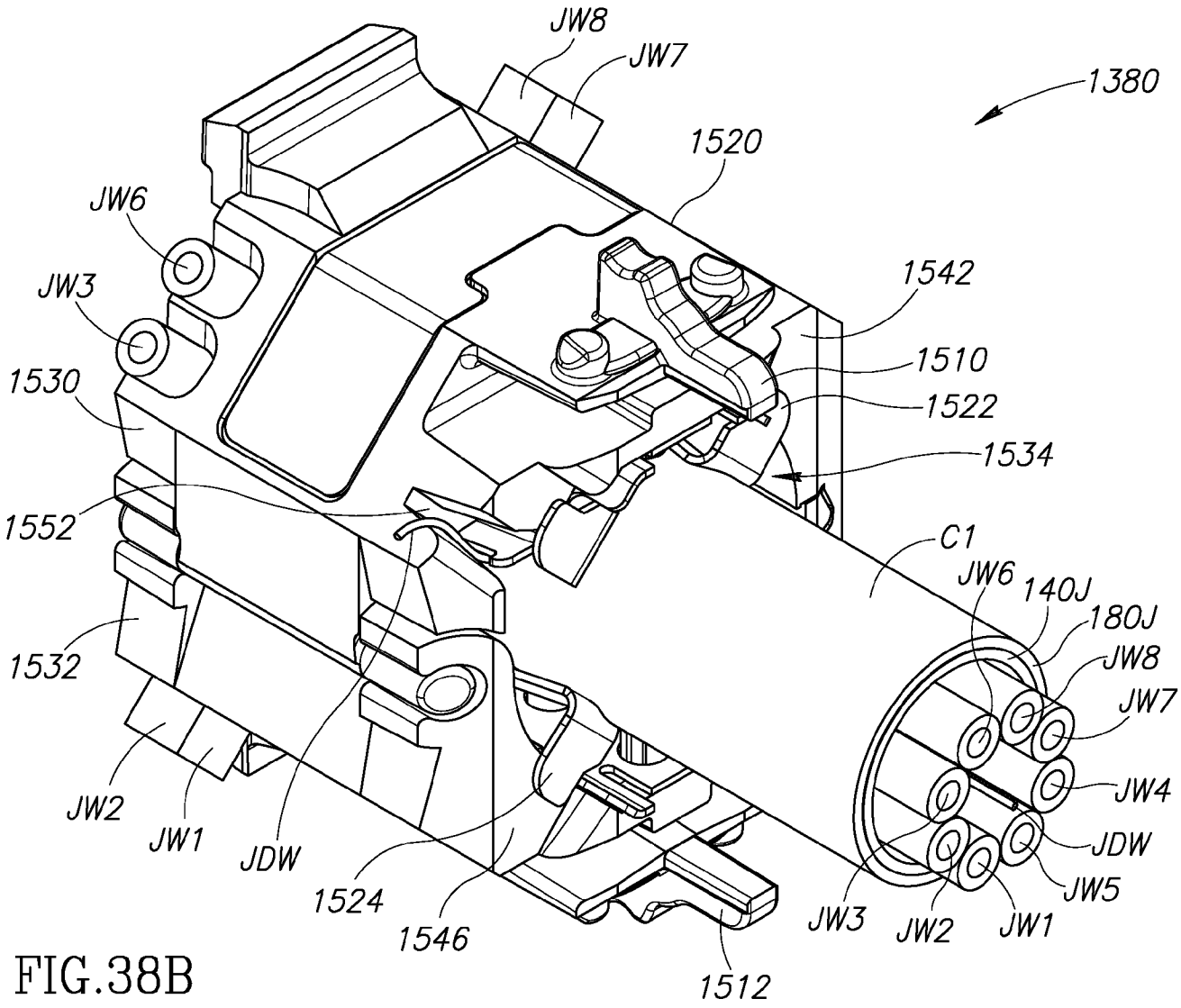
FIG. 38B is a rear perspective view of the wire manager of FIG. 37 depicted in the closed configuration with a drain wire of the cable positioned inside a drain wire channel formed in the wire manager.

As shown in FIGS. 38A and 38B, the wire manager 1380 may be used to position the wires JW1-JW8 of the cable C1 to engage with the wire contacts (substantially identical to the wire contacts 360 illustrated in FIGS. 8-11 and 20) of the contact subassembly 1358 (see FIG. 30). Referring to FIG. 38B, when the cable C1 is inside the wire manager 1380, the drain wire JDW may exit therefrom through either a drain wire channel 1552 formed in the rearward portion 1542 of the first portion 1530 or a drain wire channel 1554 (see FIG. 37) formed in the rearward portion 1546 of the second portion 1532 of the housing 1520.

Referring to FIG. 37, the rearward portion 1542 of the first portion 1530 has a rearwardly extending upper cantilever member 1560 positioned above a recess 1562, and the rearward portion 1546 of the second portion 1532 has a rearwardly extending lower cantilever member 1564 positioned under a recess 1566. The release levers 1510 and 1512 are mounted on the upper and lower cantilever members 1560 and 1564, respectively. The upper and lower cantilever members 1560 and 1564 are configured to deflect into the recesses 1562 and 1566, respectively, when inwardly directed lateral forces (e.g., exerted on the release levers 1510 and 1512 or exerted by the housing doors 1390 and 1392) press upon by the upper and lower cantilever members 1560 and 1564. Thus, when the release levers 1510 and 1512 are pressed upon in the directions identified by the arrows A9 and A10 (see FIG. 34), the upper and lower cantilever members 1560 and 1564 deflect into the recesses 1562 and 1566, respectively.

The upper cantilever member 1560 includes one or more upwardly extending anchor projections 1570A and 1570B substantially identical to the anchor projections 890A and 890C (see FIGS. 5-7 and 24A), respectively. Similarly, the lower cantilever member 1564 includes one or more downwardly extending anchor projections 1572A and 1572B substantially identical to the anchor projections 892A and 892C (see FIGS. 7 and 24A). In the embodiment illustrated, the release lever 1510 is positioned between the upwardly extending anchor projections 1570A and 1570B, and the release lever 1512 is positioned between the downwardly extending anchor projections 1572A and 1572B. When the release lever 1510 is actuated (e.g., pressed upon in the direction identified by the arrow A9 depicted in FIG. 34), the upper cantilever member 1560 deflects into the recess 1562, which moves the anchor projections 1570A and 1570B inwardly therewith. Similarly, when the release lever 1512 is actuated (e.g., pressed upon in the direction identified by the arrow A10 depicted in FIG. 34), the lower cantilever member 1564 deflects into the recess 1566, which moves the anchor projections 1572A and 1572B inwardly therewith.

Referring to FIG. 37, each of the first and second portions 1530 and 1532 includes a pair of tabs 1574 and 1576 that extend inwardly into the passageway 1534 (see FIGS. 36 and 38B).

The conductive members 1522 and 1524 are constructed from an electrically conductive material. The conductive members 1522 and 1524 may be substantially identical to one another and may be characterized as being ground springs. The first conductive member 1522 extends inside the passageway 1534 along at least a portion of the first portion 1530 of the housing 1520, and the second conductive member 1524 extends inside the passageway 1534 along at least a portion of the second portion 1532 of the housing 1520. Referring to FIG. 38B, the conductive members 1522 and 1524 are physically and electrically connected to both the drain wire JDW and the cable shield 140J (see also FIG. 26B) of the cable C1. If the cable C1 includes the optional pair shields JPS1-JPS4 (see FIGS. 1 and 29), they may be physically and electrically connected to the first conductive member 1522 and/or the second conductive member 1524.

Referring to FIG. 38B, the first conductive member 1522 is configured to be attached to the first portion 1530 inside the passageway 1534, and the conductive member 1524 is configured to be attached to the second portion 1532 inside the passageway 1534. Referring to FIG. 37, each of the conductive members 1522 and 1524 has a pair of through-holes 1580 and 1582. The through-holes 1580 and 1582 of the first conductive member 1522 are configured to receive the pair of tabs 1574 and 1576 of the first portion 1530, and the through-holes 1580 and 1582 of the second conductive member 1524 are configured to receive the pair of tabs 1574 and 1576 of the second portion 1532.

Each of the conductive members 1522 and 1524 has a drain wire contact portion 1586 that is substantially similar to the drain wire contact portion 910 (see FIGS. 26E and 27) of each of the conductive members 802 and 804 (see FIGS. 23A-24B, 25B, 26E, and 27). The drain wire contact portion 1586 of the first conductive member 1522 is configured to extend at least partway into the first drain wire channel 1552 so that when the drain wire JDW (see FIG. 38B) is in the first drain wire channel 1552, the drain wire contact portion 1586 contacts and forms an electrical connection with the drain wire JDW. Similarly, the drain wire contact portion 1586 of the second conductive member 1524 is configured to extend at least partway into the second drain wire channel 1554 so that when the drain wire JDW is in the second drain wire channel 1554, the drain wire contact portion 1586 contacts and forms an electrical connection with the drain wire JDW. Optionally, the drain wire contact portion 1586 may include one or more gripping projections or teeth 1588 configured to grip onto the drain wire JDW.

Each of the conductive members 1522 and 1524 has one or more shield engaging portions 1590 and 1592 substantially similar to the shield engaging portions 920 and 922 (see FIG. 27) of each of the conductive members 802 and 804 (see FIGS. 23A-24B, 25B, 26E, and 27). The shield engaging portions 1590 and 1592 of the conductive members 1522 and 1524 are configured to contact the housing doors 1390 and 1392 (see FIGS. 29, 30, and 34-36), respectively, when the housing doors 1390 and 1392 are closed. In this manner, the conductive members 1522 and 1524 contact the housing doors 1390 and 1392, respectively, and form an electrical connections therewith.

Further, the shield engaging portions 1590 and 1592 of the conductive members 1522 and 1524 are configured to contact and form an electrical connection with the folded back portion 146J (see FIG. 26B) of the cable shield 140J (see FIGS. 1, 26B, 26E, 29, and 38B) when the cable C1 is positioned inside the passageway 1534. Thus, the conductive members 1522 and 1524 electrically connect the cable shield 140J and the drain wire JDW with the housing doors 1390 and 1392, which are electrically connected to the housing 1330 (see FIGS. 29, 30, and 34-36).

Optionally, the shield engaging portions 1590 and 1592 may contact the optional pair shields JPS1-JPS4 (see FIGS. 1 and 29) if the pair shields JPS1-JPS4 are folded back over the end portion of the cable jacket 180J (see FIGS. 1, 26B, 26E, and 38B) and positioned alongside the folded back portion 146J (see FIG. 26B) of the cable shield 140J. In such embodiments, the conductive members 1522 and 1524 electrically connect the optional pair shields JPS1-JPS4 with the housing doors 1390 and 1392, which are electrically connected to the housing 1330.

Referring to FIG. 3, the housing 150 of the plug 100 (which may be connected to the drain wire PDW, the cable shield 140P, and/or the optional pair shields PPS1-PPS4 of the cable C2) is also electrically connected to the housing 1330 (see FIGS. 29, 30, and 34-36) by the ground springs 1340A and 1340B (see FIG. 30). Thus, a continuous ground may be maintained across the connection 10 when the outlet 1000 is used.

Housing Doors

Referring to FIGS. 34-36, the housing doors 1390 and 1392 each pivot independently with respect to the housing 1330. Referring to FIG. 36, when the housing doors 1390 and 1392 are both in the open position, the wire manager 1380 may be inserted inside the housing 1330. Similarly, if the wire manager 1380 is already inside the housing 1330 (as illustrated in FIGS. 34-36), the wire manager 1380 may be removed therefrom when the housing doors 1390 and 1392 are both in the open position.

Referring to FIG. 34, the housing doors 1390 and 1392 are substantially similar to the doors 390 and 392 (see FIGS. 1, 4-10, 22, and 28A-28C) of the outlet 120 (see FIGS. 1, 4-10, and 28A-28C). However, unlike the housing doors 390 and 392, the housing doors 1390 and 1392 include openings 1600 and 1602 through which the release levers 1510 and 1512, respectively, may pass. Referring to FIG. 36, a portion of the opening 1600 is formed in each of the housing doors 1390 and 1392, and a portion of the opening 1602 is formed in each of the housing doors 1390 and 1392. Referring to FIG. 34, the openings 1600 and 1602 are configured to allow the release levers 1510 and 1512, respectively, to deflect therein. Thus, the release levers 1510 and 1512 may be transitioned within the openings 1600 and 1602, respectively, between locked positions (see FIG. 34) and unlocked positions (see FIG. 35).

Referring to FIG. 36, the first housing door 1390 includes an aperture 1610A configured to receive the upwardly extending anchor projection 1570A of the wire manger 1380, and an aperture 1612A configured to receive the downwardly extending anchor projection 1572A of the wire manger 1380. Similarly, the second housing door 1392 includes an aperture 1610B configured to receive the upwardly extending anchor projection 15708 of the wire manger 1380, and an aperture 1612B configured to receive the downwardly extending anchor projection 15728 of the wire manger 1380.

As the housing doors 1390 and 1392 are closed, they press downwardly on the upper cantilever member 1560 (see FIG. 37) allowing the upwardly extending anchor projections 1570A and 1570B to slide into the apertures 1610A and 1610B, respectively. At the same time, the housing doors 1390 and 1392 press upwardly on the lower cantilever member 1564 (see FIG. 37) allowing the downwardly extending anchor projections 1572A and 1572B to slide into the apertures 1612A and 1612B, respectively. Engagement between the apertures 1610A and 1612A of the housing door 1390 and the anchor projections 1570A and 1572A of the wire manger 1380 helps maintain the housing door 1390 in the closed position. Similarly, engagement between the apertures 1610B and 1612B of the housing door 1392 and the anchor projections 1570B and 1572B of the wire manger 1380 helps maintain the housing door 1392 in the closed position.

When the release lever 1510 is pressed upon in the direction identified by the arrow A9 (see FIG. 34), the upper cantilever member 1560 deflects into the recess 1562, which moves the anchor projections 1570A and 1570B inwardly therewith. This removes or disengages the upwardly extending anchor projections 1570A and 1570B from the apertures 1610A and 1610B, respectively. Similarly, when the release lever 1512 is pressed upon in the direction identified by the arrow A10 (see FIG. 34), the lower cantilever member 1564 deflects into the recess 1566, which moves the anchor projections 1572A and 1572B inwardly therewith. This removes or disengages the downwardly extending anchor projections 1572A and 1572B from the apertures 1612A and 1612B, respectively. When the upwardly extending anchor projections 1570A and 1570B are disengaged from the apertures 1610A and 1610B, respectively, and the downwardly extending anchor projections 1572A and 1572B are disengaged from the apertures 1612A and 1612B, respectively, the housing doors 1390 and 1392 may be rotated to open positions (see FIG. 36).

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Accordingly, the invention is not limited except as by the appended claims.

The invention claimed is:

1. A communication outlet for use with a communication plug, the outlet comprising:

a plug receiving opening configured to allow at least a portion of the communication plug to pass therethrough;

a shutter door configured to block entry into the communication outlet through the plug receiving opening when in a closed position, the shutter door being rotatable about a first axis from the closed position to an open position to allow the portion of the communication plug to be inserted inside the communication outlet through the plug receiving opening, the shutter door comprising first and second pins extending along a second axis spaced apart from and substantially parallel with the first axis; and a biasing member comprising first and second coil springs mounted on the first and second pins, respectively, the biasing member biasing the shutter door toward the closed position.

2. The communication outlet of claim 1, further comprising:

a housing having a portion adjacent the biasing member, wherein the first coil spring is connected to the second coil spring by a connecting portion, the first coil spring has a first free end portion, the second coil spring has a second free end portion, the first and second free end portions are positioned adjacent to the shutter door and press against the shutter door, and the connecting portion presses against the housing.

3. The communication outlet of claim 1, wherein the insertion of the portion of the communication plug into the plug receiving opening rotates the shutter door from the closed position to the open position.

4. The communication outlet of claim 3, wherein the biasing member is compressed when the shutter door moves from the closed position to the open position, and removal of the communication plug from the plug receiving opening allows the biasing member to become uncompressed and return the shutter door to the closed position.

5. The communication outlet of claim 1 for use with the communication plug comprising an electrically conductive plug housing connected to a first ground, the communication outlet further comprising:

an electrically conductive outlet housing connected to a second ground, and at least one electrically conductive ground spring attached to the outlet housing, wherein the shutter door is housed inside the outlet housing, and the at least one ground spring contacts the plug housing of the communication plug when the portion of the communication plug is inserted into the plug receiving opening thereby connecting the first and second grounds.

6. The communication outlet of claim 1 for use with the communication plug having a forward facing portion with a forward extending portion, the forward extending portion being less than the entire forward facing portion, the communication outlet further comprising:

a door lock having a switch portion that extends forwardly from the shutter door, the door lock allowing the shutter door to be rotated from the closed position to the open position when the switch portion is pressed upon by the forward extending portion of the communication plug, the door lock preventing the shutter door from being rotated from the closed position to the open position when the switch portion is not pressed upon.

7. The communication outlet of claim 1, further comprising:

a shutter lock member adjacent the shutter door, the shutter lock member being transitionable from a locked position to an unlocked position by the insertion of the portion of the communication plug into the plug receiving opening, the shutter lock member preventing the shutter door from transitioning from the closed position to the open position when the shutter lock member is in the locked position.

8. The communication outlet of claim 7, wherein the biasing member is rotatable about the second axis, the biasing member abuts a portion of the shutter door and prevents the shutter door from rotating about the first axis when the shutter lock member is in the locked position, and when the shutter lock member is transitioned from the locked position to the unlocked position, the shutter lock member rotates the biasing member about the second axis and away from the portion of the shutter door thereby allowing the shutter door to be rotated about the first axis.

9. The communication outlet of claim 1 for use with a communication cable comprising a plurality of wires, the communication outlet further comprising:

a plurality of wire contacts; and a wire manager having an open-ended passageway and a plurality of wire channels adjacent one end of the passageway, the passageway being configured to receive the communication cable therein, the plurality of wire channels being configured to receive the plurality of wires and position the plurality of wires to form electrical connections with the plurality of wire contacts.

10. The communication outlet of claim 9 for use with the communication cable comprising a cable shield, the communication outlet further comprising:

an electrically conductive outlet housing, the wire manager being positionable inside the outlet housing and comprising at least one conductive member at least partially positioned inside the passageway, the at least one conductive member electrically connecting the cable shield with the outlet housing when the cable is received inside the passageway.

11. The communication outlet of claim 10 for use with the communication plug comprising an electrically conductive plug housing connected to a first ground, the communication outlet further comprising:

at least one electrically conductive ground spring attached to the outlet housing, wherein the outlet housing is connected to a second ground, and the at least one ground spring contacts the plug housing of the communication plug when the portion of the communication plug is inserted into the plug receiving opening thereby connecting the first and second grounds.

12. A communication outlet for terminating a communication cable comprising a plurality of wires and a cable shield, the outlet comprising:

a plurality of wire contacts;

a wire manager having an open-ended passageway and a plurality of wire channels adjacent one end of the passageway, the passageway being configured to receive the communication cable therein, the plurality of wire channels being configured to receive the plurality of wires and position the plurality of wires to form electrical connections with the plurality of wire contacts; and an electrically conductive housing, the wire manager being positionable inside the housing and comprising at least one conductive member at least partially positioned inside the passageway, the at least one conductive member electrically connecting the cable shield with the housing when the wire manager is positioned inside the housing and the cable is received inside the passageway.

13. The communication outlet of claim 12 for use with the cable further comprising a drain wire, wherein the at least one conductive member electrically connects the drain wire with the housing when the communication cable is received inside the passageway.

14. The communication outlet of claim 12, wherein the housing comprises at least one housing door, the wire manager is positionable inside the housing when the at least one housing door is in an open position, and the at least one housing door presses the wire manager toward the plurality of wire contacts when the wire manager is inside the housing and the at least one housing door is transitioned from the open position to a closed position.

15. The communication outlet of claim 12, wherein the housing comprises at least one housing door, the wire manager is positionable inside the housing when the at least one housing door is in an open position, the wire manager engages with the at least one housing door when the wire manager is inside the housing and the at least one housing door is transitioned from the open position to a closed position, the engagement between the wire manager and the at least one housing door maintaining the at least one housing door in the closed position, and the wire manager comprises a release lever that when actuated disengages the wire manager from the at least one housing door to thereby allow the at least one housing door to be transitioned from the closed position to the open position.

16. The communication outlet of claim 12, wherein the housing comprises a first housing door having a first opening and a second housing door having a second opening, the wire manager is positionable inside the housing when the first and second housing doors are open, the wire manager has first and second anchor projections, the first anchor projection is positioned inside the first opening when the wire manager is inside the housing and the first housing door is closed, engagement between the first anchor projection and the first opening preventing the first housing door from being opened, the second anchor projection is positioned inside the second opening when the wire manager is inside the housing and the second housing door is closed, engagement between the second anchor projection and the second opening preventing the second housing door from being opened, and the wire manager has a release lever that when actuated, disengages the first and second anchor projections from the first and second openings, respectively.

17. The communication outlet of claim 16, wherein the release lever is a first release lever, the first housing door has a third opening, the second housing door has a fourth opening, the wire manager has third and fourth anchor projections, the third anchor projection is positioned inside the third opening when the wire manager is inside the housing and the first housing door is closed, engagement between the third anchor projection and the third opening preventing the first housing door from being opened, the fourth anchor projection is positioned inside the fourth opening when the wire manager is inside the housing and the second housing door is closed, engagement between the fourth anchor projection and the fourth opening preventing the second housing door from being opened, and the wire manager has a second release lever that when actuated, disengages the third and fourth anchor projections from the third and fourth openings, respectively.

18. The communication outlet of claim 12, further comprising:

a guide sleeve configured to determine an orientation of the wire manager with respect to the plurality of wire contacts.

19. The communication outlet of claim 18, wherein the wire manager comprises one of a keyway and a key member, the guide sleeve comprises a different one of the keyway and the key member, the key member is configured to be received by the keyway, and the keyway and the key member determining the orientation of the wire manager with respect to the plurality of wire contacts.

20. The communication outlet of claim 12 for use with a communication plug comprising a plurality of plug contacts, wherein the plurality of wire contacts are positioned inside the housing and the communication outlet further comprises:

a plurality of outlet contacts electrically connected to the plurality of wire contacts;

a plug receiving opening configured to allow at least a portion of the communication plug to pass therethrough into the housing and position the plurality of plug contacts in physical contact with the plurality of outlet contacts; and a shutter assembly positioned adjacent the plug receiving opening, the shutter assembly comprising a shutter door and at least one biasing member that biases the shutter door toward a closed position in which the shutter door substantially obstructs the plug receiving opening, the shutter door being selectively transitionable from the closed position to an open position by insertion of the portion of the communication plug into the housing through the plug receiving opening.

21. A method of terminating a communication cable comprising a cable jacket protecting a plurality of wires and a cable shield, the method comprising:

removing an end portion of the cable jacket to expose the plurality of wires and the cable shield;

folding the exposed cable shield back over the cable jacket to define a folded back shield portion;

positioning the folded back shield portion inside a wire manager with the exposed wires extending outwardly from the wire manager, the folded back shield portion contacting and forming an electrical connection with an electrically conductive member inside the wire manager;

bending each of the exposed wires extending outwardly from the wire manager and positioning each of the bent wires into a different one of a plurality of wire channels formed in the wire manager; and inserting the wire manager into an opening of a communication outlet, the plurality of wire channels positioning the bent wires to engage a plurality of wire contacts inside the communication outlet when the wire manager is inserted into the opening.

22. The method of claim 21, further comprising:

closing the opening of the communication outlet when the wire manager is inside the communication outlet.

23. The method of claim 22, wherein the communication outlet comprises a housing, the opening is formed in the housing, a housing door is pivotably connected to the housing, closing the opening of the communication outlet comprises closing the housing door, the housing door contacts and forms an electrical connection with the electrically conductive member when the housing door is closed, the housing door pushes the wire manager forwardly as the housing door is closed, and the bent wires engage the plurality of wire contacts as the wire manager is pushed forwardly by the housing door.

24. The method of claim 23, wherein removing the end portion of the cable jacket exposes a drain wire; and the method further comprises:

positioning the drain wire in a drain wire channel formed in the wire manager, the drain wire contacting and forming an electrical connection with the electrically conductive member inside the drain wire channel.

25. The method of claim 21, wherein the wire manager comprises a first portion pivotably connected to a second portion, the first portion is selectively pivotable with respect to the second portion to place the wire manager in an open configuration or a closed configuration, a passageway is defined between the first and second portions when the wire manager in the closed configuration, and positioning the folded back shield portion inside the wire manager comprises:

pivoting the first portion with respect to the second portion to place the wire manager in the open configuration;

positioning the folded back shield portion adjacent at least one of the first and second portions when the wire manager is in the open configuration, the folded back shield portion being positioned with respect to the first and second portions such that the folded back shield portion will be inside the passageway when the wire manager is in the closed configuration; and pivoting the first portion with respect to the second portion to place the wire manager in the closed configuration with the folded back shield portion inside the passageway.

26. A wire manager for use with a communication outlet and a communication cable, the communication outlet comprising an electrically conductive outlet housing and a plurality of wire contacts positioned inside the outlet housing, the communication cable comprising a plurality of wires and a cable shield, the wire manager comprising:

a wire manager housing configured to clamp onto an end portion of the communication cable, the wire manager housing comprising a plurality of wire channels positioned to be adjacent to the end portion of the communication cable when the wire manager housing is clamped onto the communication cable, the plurality of wire channels being configured to receive the plurality of wires and position the plurality of wires to contact the plurality of wire contacts and form electrical connections therewith when the wire manager housing is received inside the outlet housing; and at least one conductive member connected to the wire manager housing, the at least one conductive member being positioned to contact and form an electrical connection with the cable shield when the wire manager housing is clamped onto the communication cable, the at least one conductive member being configured to contact and form an electrical connection with the outlet housing when the wire manager housing is received inside the outlet housing.

27. The wire manager of claim 26, wherein the wire manager housing comprises first and second portions pivotably connected to one another and configured to be pivoted to clamp onto the end portion of the communication cable.

28. The wire manager of claim 26 for use with the communication cable further comprising a drain wire, the wire manager housing further comprises a drain wire channel configured to receive the drain wire, and the at least one conductive member contacts and forms an electrical connection with the drain wire when the drain wire is received inside the drain wire channel.

29. The wire manager of claim 26 for use with the outlet housing comprises at least one housing door, wherein the wire manager housing is configured to be received inside the outlet housing when the at least one housing door is in an open position, and the at least one conductive member contacts and forms the electrical connection with the at least one housing door when the wire manager housing is received inside the outlet housing and the at least one housing door is in a closed position.

30. The wire manager of claim 29, wherein the at least one housing door presses the wire manager housing toward the plurality of wire contacts when the wire manager housing is inside the outlet housing and the at least one housing door is transitioned from the open position to the closed position.

31. A communication outlet for use with a communication plug and a communication cable comprising a plurality of wires and a cable shield, the outlet comprising:

a plug receiving opening configured to allow at least a portion of the communication plug to pass therethrough;

a shutter door configured to block entry into the communication outlet through the plug receiving opening when in a closed position, the shutter door being rotatable about a first axis from the closed position to an open position to allow the portion of the communication plug to be inserted inside the communication outlet through the plug receiving opening;

a biasing member comprising at least one biasing portion that extends along a second axis spaced apart from and substantially parallel with the first axis, the biasing member biasing the shutter door toward the closed position;

a plurality of wire contacts;

a wire manager having an open-ended passageway and a plurality of wire channels adjacent one end of the passageway, the passageway being configured to receive the communication cable therein, the plurality of wire channels being configured to receive the plurality of wires and position the plurality of wires to form electrical connections with the plurality of wire contacts; and an electrically conductive outlet housing, the wire manager being positionable inside the outlet housing and comprising at least one conductive member at least partially positioned inside the passageway, the at least one conductive member electrically connecting the cable shield with the outlet housing when the cable is received inside the passageway.

32. The communication outlet of claim 31, further comprising:

a housing having a portion adjacent the biasing member, wherein the at least one biasing portion of the biasing member comprises first and second coil springs, the first coil spring is connected to the second coil spring by a connecting portion, the first coil spring has a first free end portion, the second coil spring has a second free end portion, the first and second free end portions are positioned adjacent to the shutter door and press against the shutter door, and the connecting portion presses against the housing.

33. The communication outlet of claim 32, wherein the shutter door comprises first and second pins extending along the second axis, and the first and second coil springs are mounted on the first and second pins, respectively.

34. The communication outlet of claim 31, wherein the insertion of the portion of the communication plug into the plug receiving opening rotates the shutter door from the closed position to the open position.

35. The communication outlet of claim 34, wherein the biasing member is compressed when the shutter door moves from the closed position to the open position, and removal of the communication plug from the plug receiving opening allows the biasing member to become uncompressed and return the shutter door to the closed position.

36. The communication outlet of claim 31 for use with the communication plug comprising an electrically conductive plug housing connected to a first ground, the communication outlet further comprising:

an electrically conductive outlet housing connected to a second ground, and at least one electrically conductive ground spring attached to the outlet housing, wherein the shutter door is housed inside the outlet housing, and the at least one ground spring contacts the plug housing of the communication plug when the portion of the communication plug is inserted into the plug receiving opening thereby connecting the first and second grounds.

37. The communication outlet of claim 31 for use with the communication plug comprising an electrically conductive plug housing connected to a first ground, the communication outlet further comprising:

at least one electrically conductive ground spring attached to the outlet housing, wherein the outlet housing is connected to a second ground, and the at least one ground spring contacts the plug housing of the communication plug when the portion of the communication plug is inserted into the plug receiving opening thereby connecting the first and second grounds.

38. A communication outlet for terminating a communication cable comprising a plurality of wires, the outlet comprising:

a plurality of wire contacts; and a wire manager having an open-ended passageway and a plurality of wire channels adjacent one end of the passageway, the passageway being configured to receive the communication cable therein, the plurality of wire channels being configured to receive the plurality of wires and position the plurality of wires to form electrical connections with the plurality of wire contacts; and a housing comprising at least one housing door, the wire manager being positionable inside the housing when the at least one housing door is in an open position, the at least one housing door pressing the wire manager toward the plurality of wire contacts when the wire manager is inside the housing and the at least one housing door is transitioned from the open position to a closed position.

39. The communication outlet of claim 38, wherein the housing is electrically conductive, and the wire manager comprises at least one conductive member electrically connected to the housing when the wire manager is positioned inside the housing.

40. The communication outlet of claim 39 for use with the cable further comprising a cable shield and a drain wire, wherein the at least one conductive member electrically connects at least one of the cable shield and the drain wire with the housing when the communication cable is received inside the passageway.

41. The communication outlet of claim 38, wherein the wire manager engages with the at least one housing door when the wire manager is inside the housing and the at least one housing door is transitioned from the open position to a closed position, the engagement between the wire manager and the at least one housing door maintaining the at least one housing door in the closed position, and the wire manager comprises a release lever that when actuated disengages the wire manager from the at least one housing door to thereby allow the at least one housing door to be transitioned from the closed position to the open position.

42. The communication outlet of claim 38, wherein the housing comprises a first housing door having a first opening and a second housing door having a second opening, the wire manager is positionable inside the housing when the first and second housing doors are open, the wire manager has first and second anchor projections, the first anchor projection is positioned inside the first opening when the wire manager is inside the housing and the first housing door is closed, engagement between the first anchor projection and the first opening preventing the first housing door from being opened, the second anchor projection is positioned inside the second opening when the wire manager is inside the housing and the second housing door is closed, engagement between the second anchor projection and the second opening preventing the second housing door from being opened, and the wire manager has a release lever that when actuated, disengages the first and second anchor projections from the first and second openings, respectively.

43. The communication outlet of claim 42, wherein the release lever is a first release lever, the first housing door has a third opening, the second housing door has a fourth opening, the wire manager has third and fourth anchor projections, the third anchor projection is positioned inside the third opening when the wire manager is inside the housing and the first housing door is closed, engagement between the third anchor projection and the third opening preventing the first housing door from being opened, the fourth anchor projection is positioned inside the fourth opening when the wire manager is inside the housing and the second housing door is closed, engagement between the fourth anchor projection and the fourth opening preventing the second housing door from being opened, and the wire manager has a second release lever that when actuated, disengages the third and fourth anchor projections from the third and fourth openings, respectively.

44. The communication outlet of claim 38, further comprising:

a guide sleeve configured to determine an orientation of the wire manager with respect to the plurality of wire contacts.

45. The communication outlet of claim 44, wherein the wire manager comprises one of a keyway and a key member, the guide sleeve comprises a different one of the keyway and the key member, the key member is configured to be received by the keyway, and the keyway and the key member determining the orientation of the wire manager with respect to the plurality of wire contacts.

46. The communication outlet of claim 38 for use with a communication plug comprising a plurality of plug contacts, wherein the plurality of wire contacts are positioned inside the housing and the communication outlet further comprises:

a plurality of outlet contacts electrically connected to the plurality of wire contacts;

a plug receiving opening configured to allow at least a portion of the communication plug to pass therethrough into the housing and position the plurality of plug contacts in physical contact with the plurality of outlet contacts; and a shutter assembly positioned adjacent the plug receiving opening, the shutter assembly comprising a shutter door and at least one biasing member that biases the shutter door toward a closed position in which the shutter door substantially obstructs the plug receiving opening, the shutter door being selectively transitionable from the closed position to an open position by insertion of the portion of the communication plug into the housing through the plug receiving opening.

* * * * *

US009496644C1

(12) EX PARTE REEXAMINATION CERTIFICATE (12727th)

United States Patent
Bragg

(10) Number: US 9,496,644 C1
(45) Certificate Issued: Oct. 3, 2024

(54) COMMUNICATION OUTLET WITH SHUTTER MECHANISM AND WIRE MANAGER

(71) Applicant: Leviton Manufacturing Co., Inc., Melville, NY (US)

(72) Inventor: Charles R. Bragg, Bothell, WA (US)

(73) Assignee: LEVITON MANUFACTURING CO., INC., Melville, NY (US)

Reexamination Request:
No. 90/019,223, Jun. 27, 2023

Reexamination Certificate for:

| | |
|---|---|
| Patent No.: | **9,496,644** |
| Issued: | **Nov. 15, 2016** |
| Appl. No.: | **14/685,379** |
| Filed: | **Apr. 13, 2015** |

(51) Int. Cl.

| | |
|---|---|
| ***H01R 13/627*** | (2006.01) |
| ***H01R 4/2433*** | (2018.01) |
| ***H01R 13/453*** | (2006.01) |
| ***H01R 13/6583*** | (2011.01) |
| ***H01R 24/64*** | (2011.01) |

(52) U.S. Cl.
CPC ..... *H01R 13/627* (2013.01); *H01R 4/2433* (2013.01); *H01R 13/4536* (2013.01); *H01R 13/6583* (2013.01); *H01R 24/64* (2013.01)

(58) Field of Classification Search
None
See application file for complete search history.

(56) References Cited

To view the complete listing of prior art documents cited during the proceeding for Reexamination Control Number 90/019,223, please refer to the USPTO's Patent Electronic System.

*Primary Examiner* — Beverly M Flanagan

(57) ABSTRACT

A communication outlet for use with a communication plug. The outlet includes a shutter door biased by at least one biasing member toward a closed position in which the shutter door substantially obstructs the opening. Insertion of the communication plug into the opening transitions the shutter door from the closed position to an open position. Optionally, the outlet includes a shutter lock member adjacent the shutter door. The shutter lock member prevents the shutter door from transitioning from the closed position to the open position when the shutter lock member is in a locked position. The shutter lock member is transitionable from the locked position to an unlocked position by the insertion of the communication plug into the opening. Optionally, the outlet includes a wire manager configured to position a plurality of wires to engage a plurality of wire contacts inside the outlet.

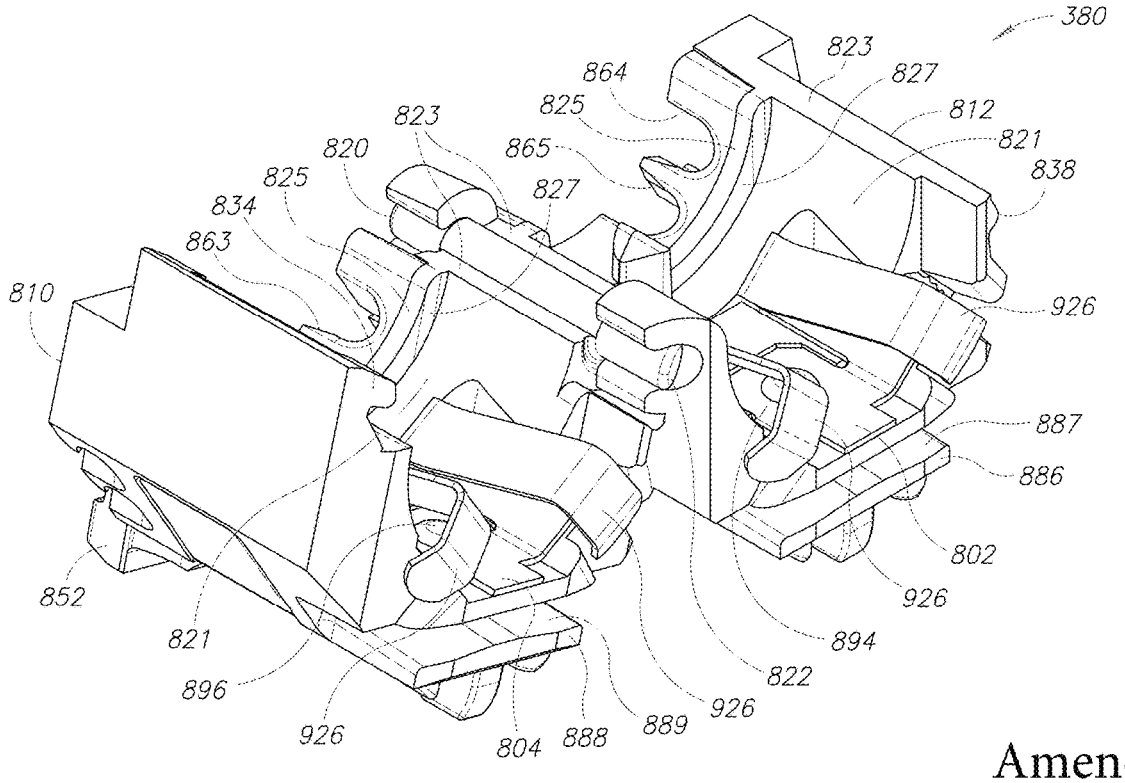

Amended

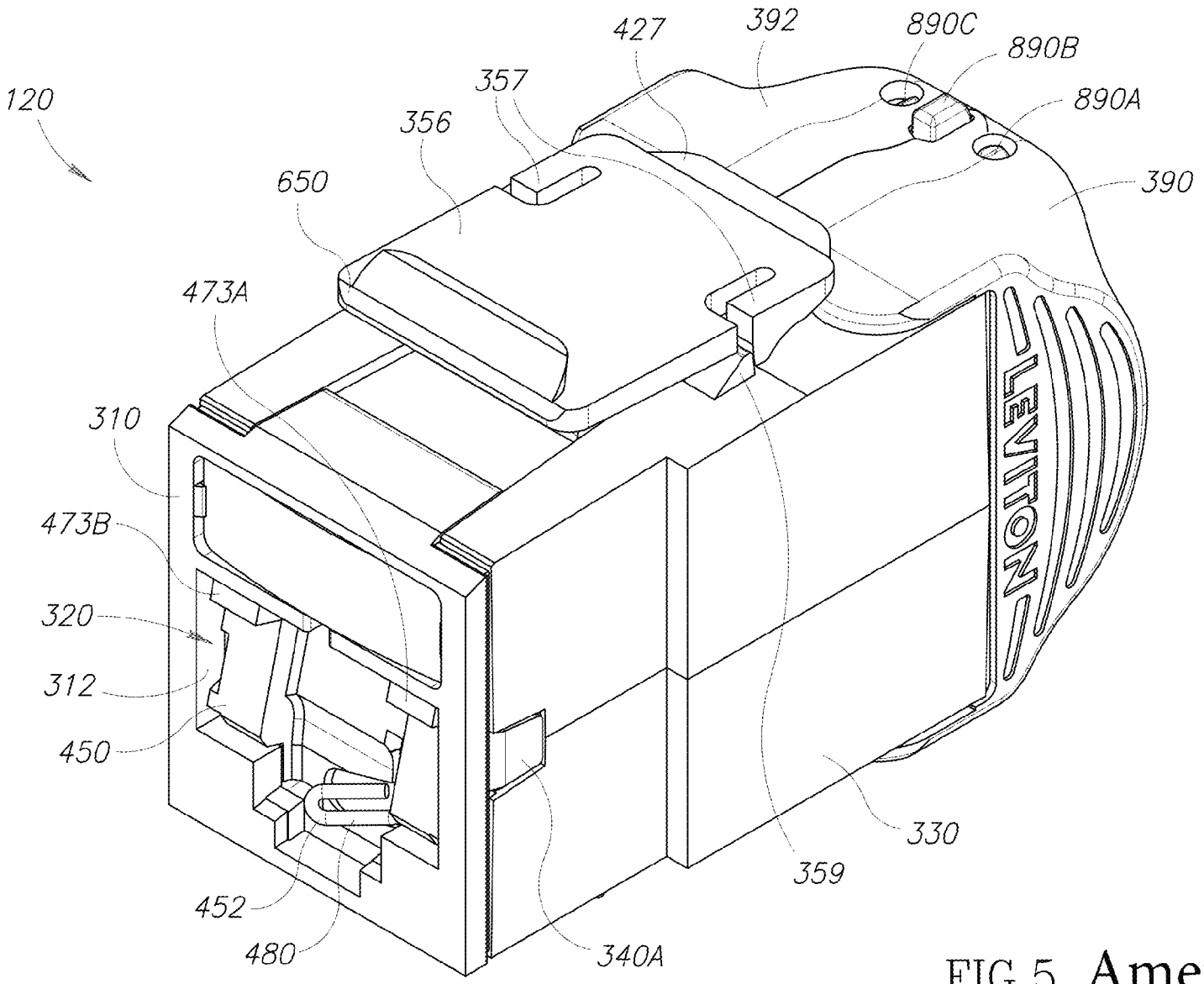
FIG.5 Amended

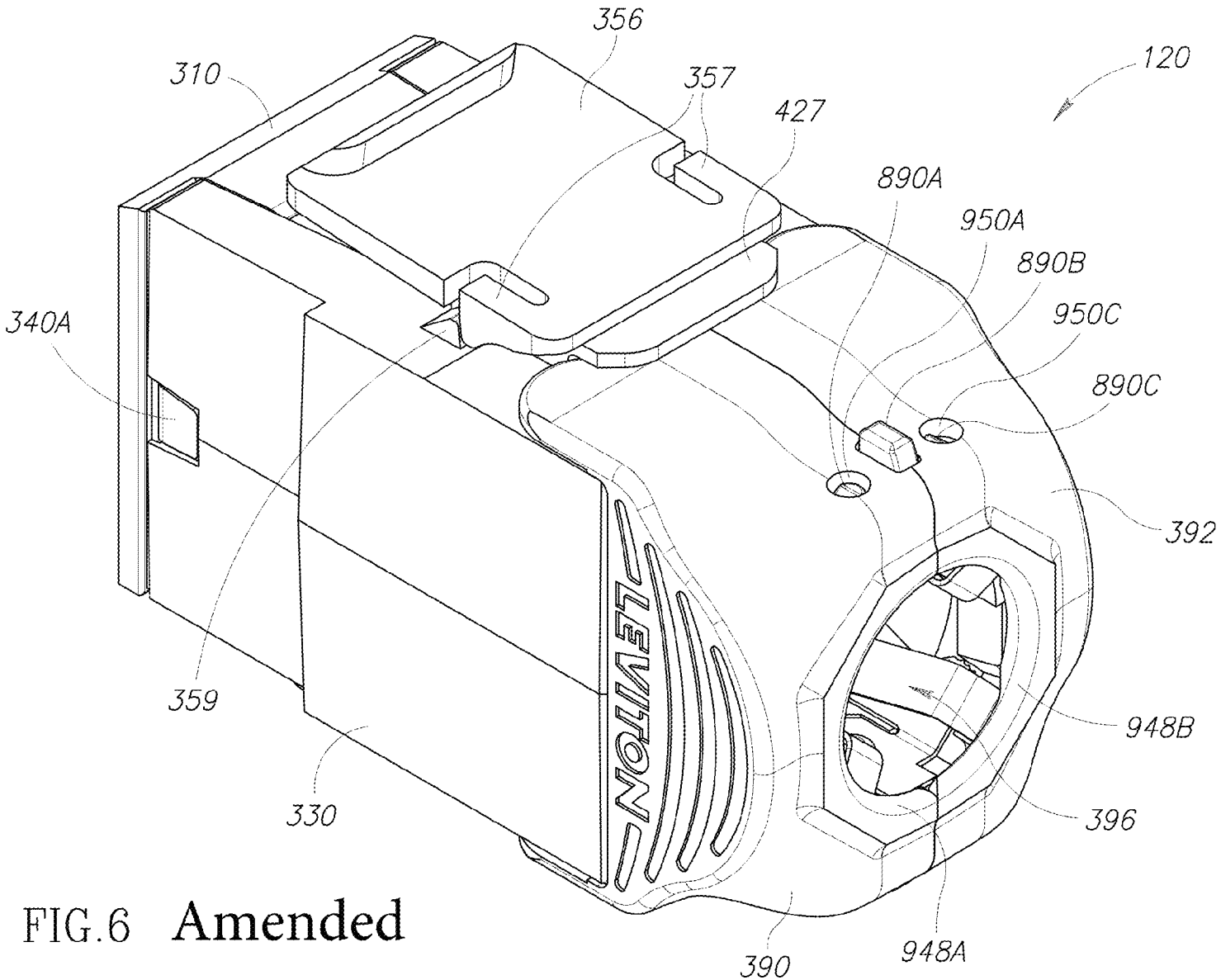
FIG.6 Amended

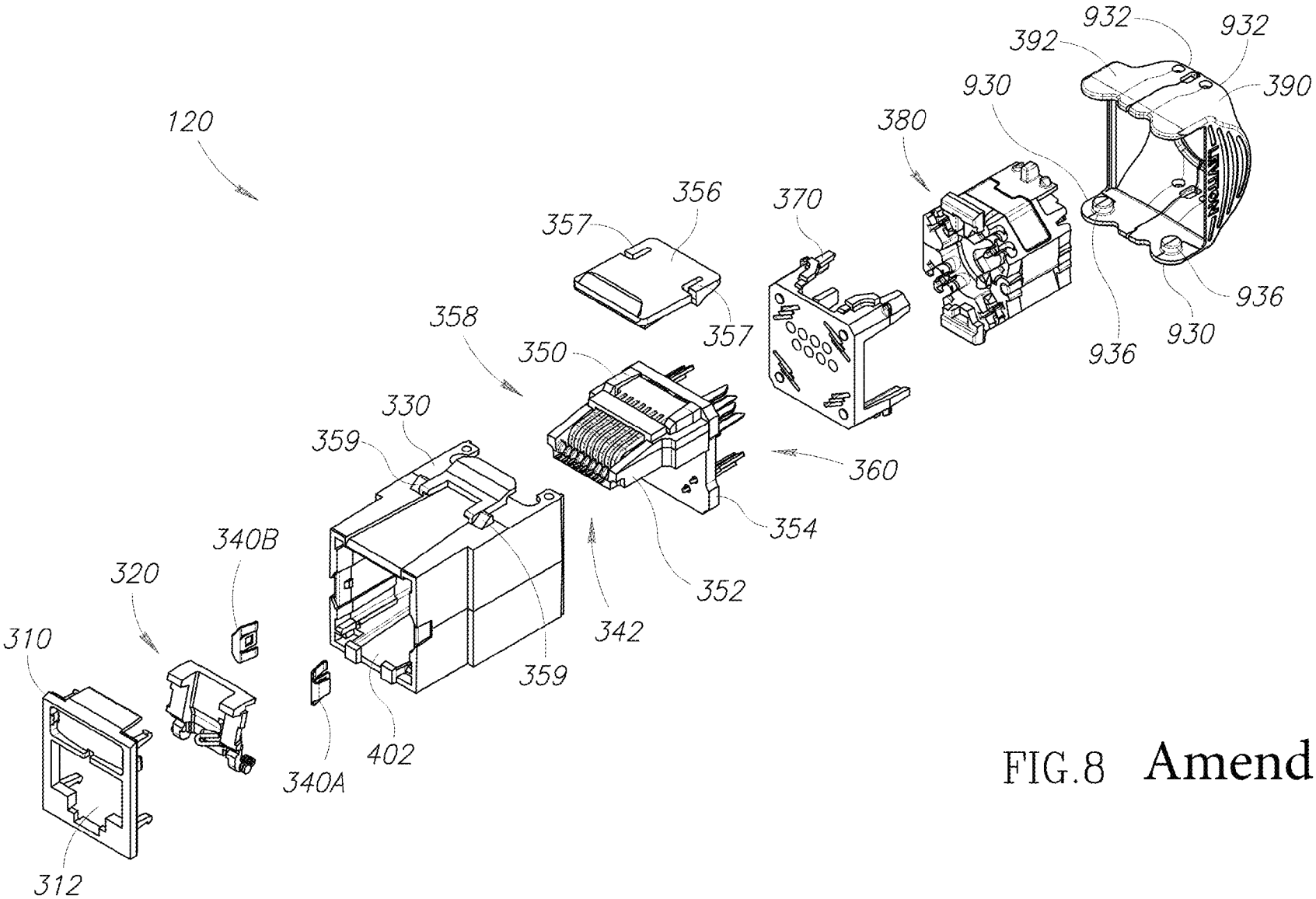
FIG.8 Amended

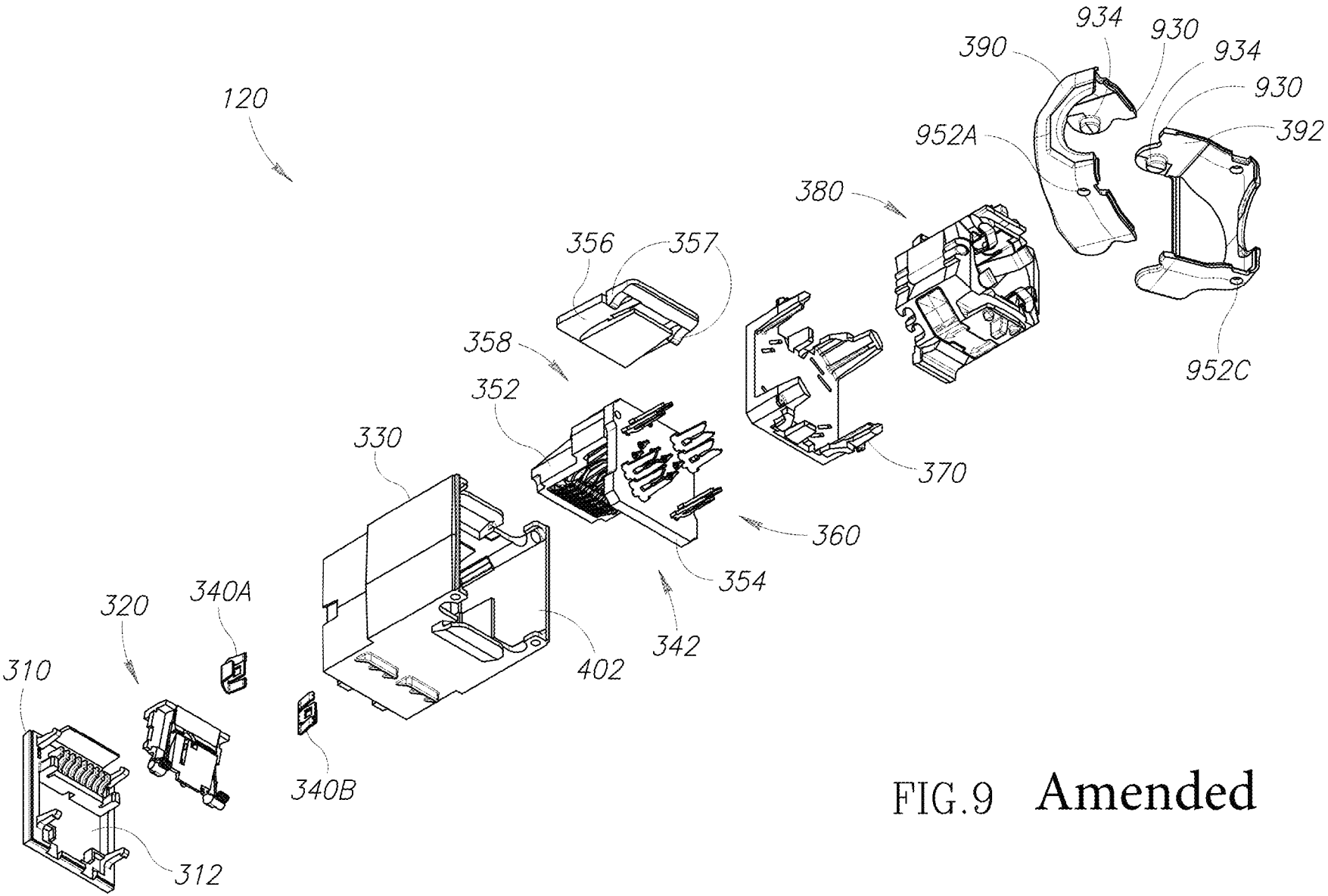
FIG. 9 Amended

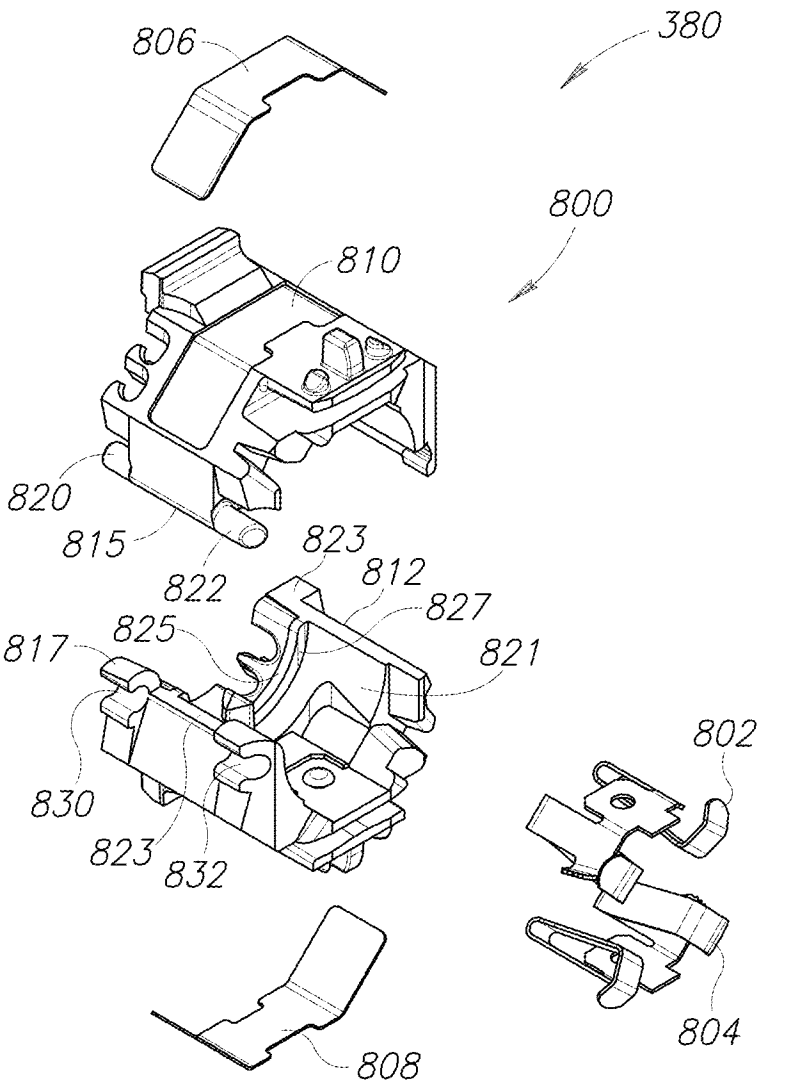
FIG.23B Amended
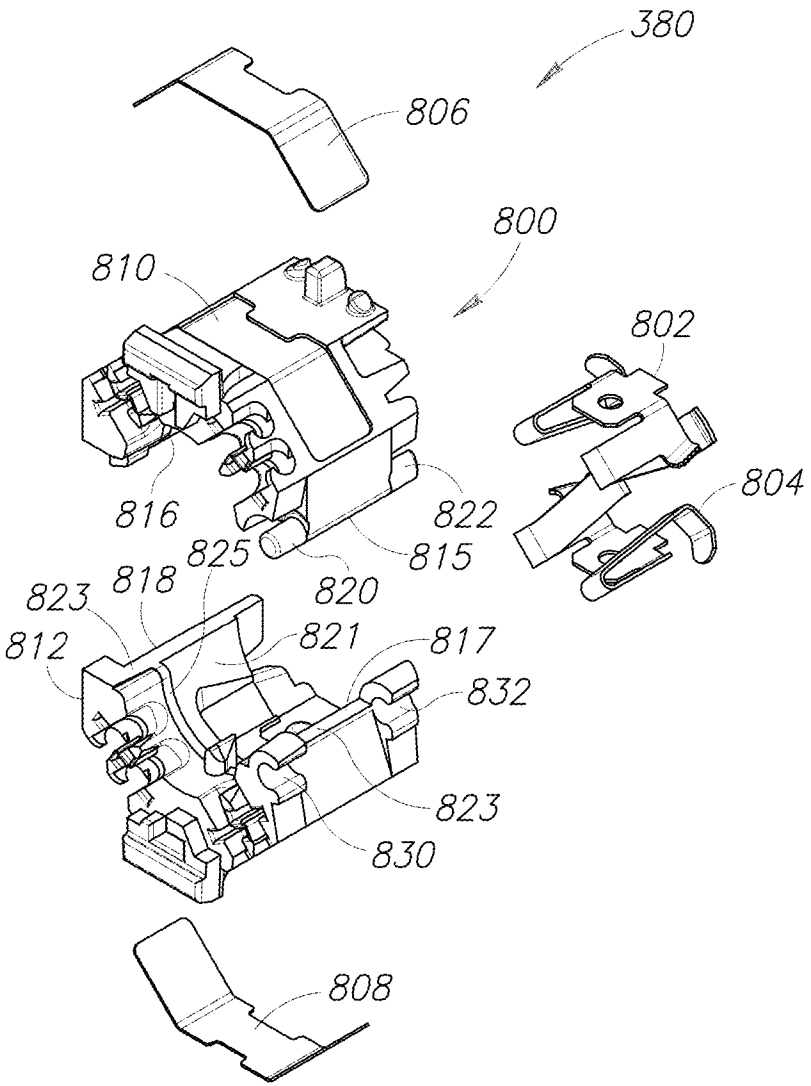
FIG.23A Amended

Figure 24B:
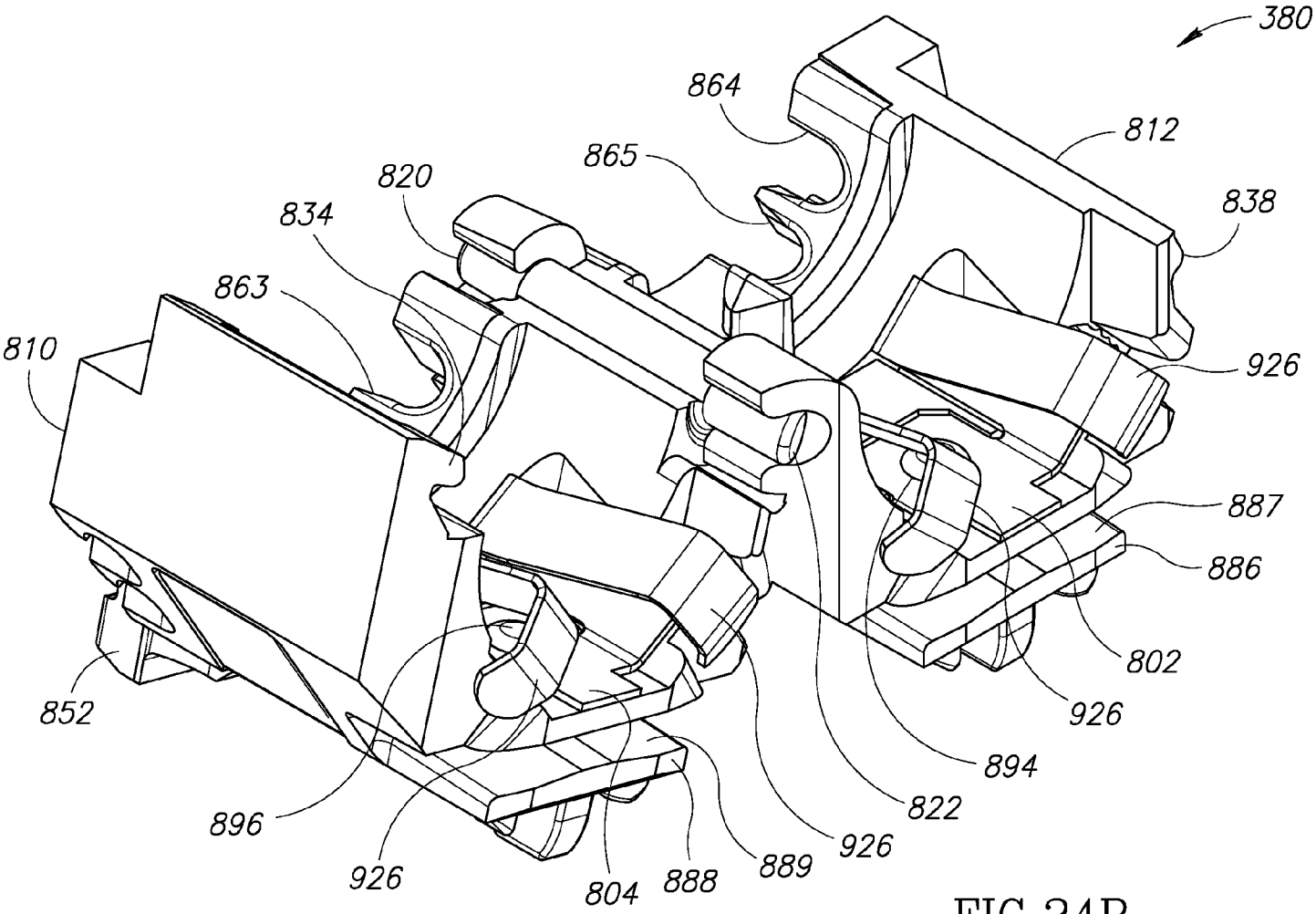
FIG. 24B is a rear perspective view of the wire manager of FIG. 23A depicted in an open configuration.

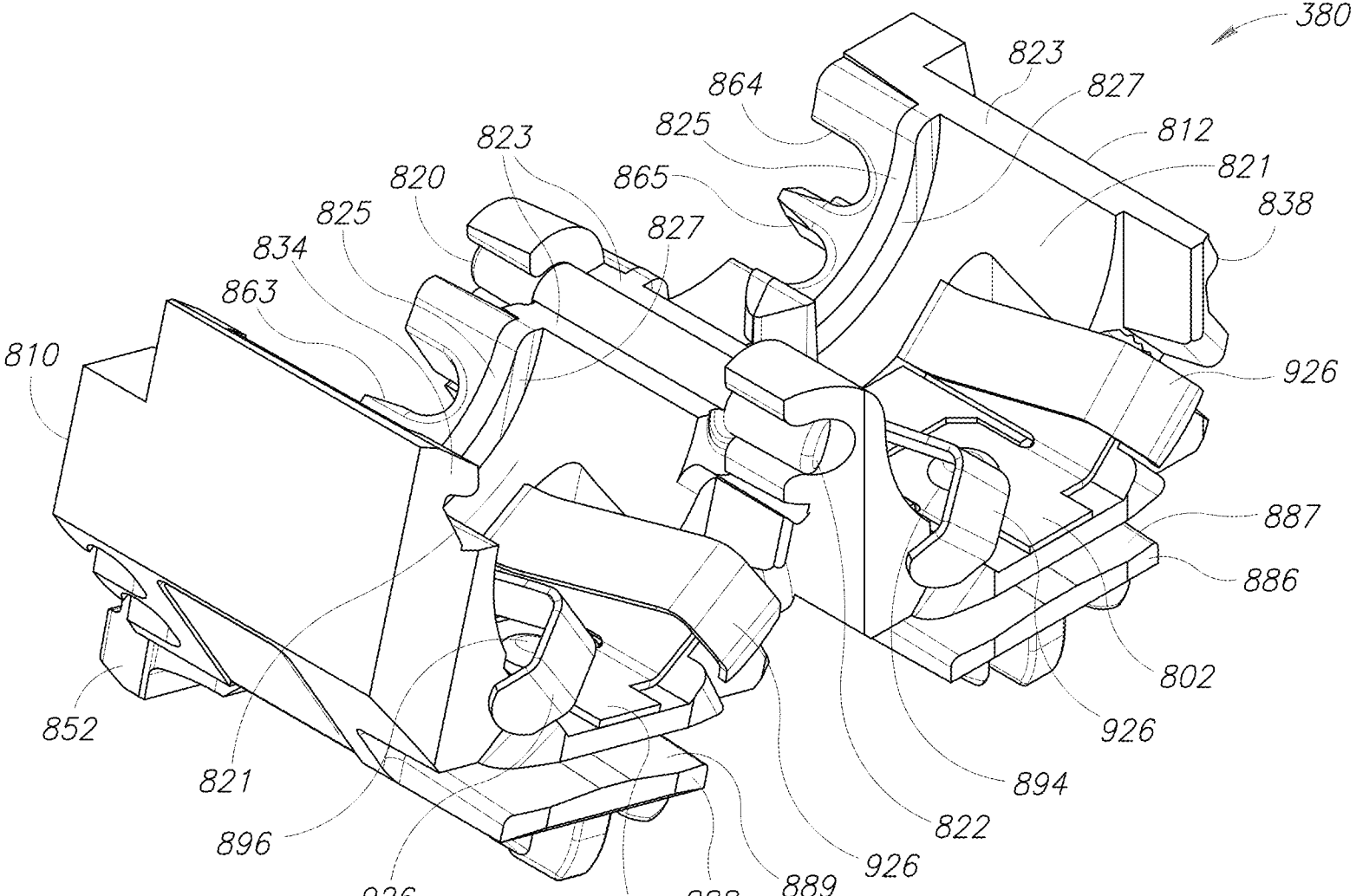
FIG.24B Amended

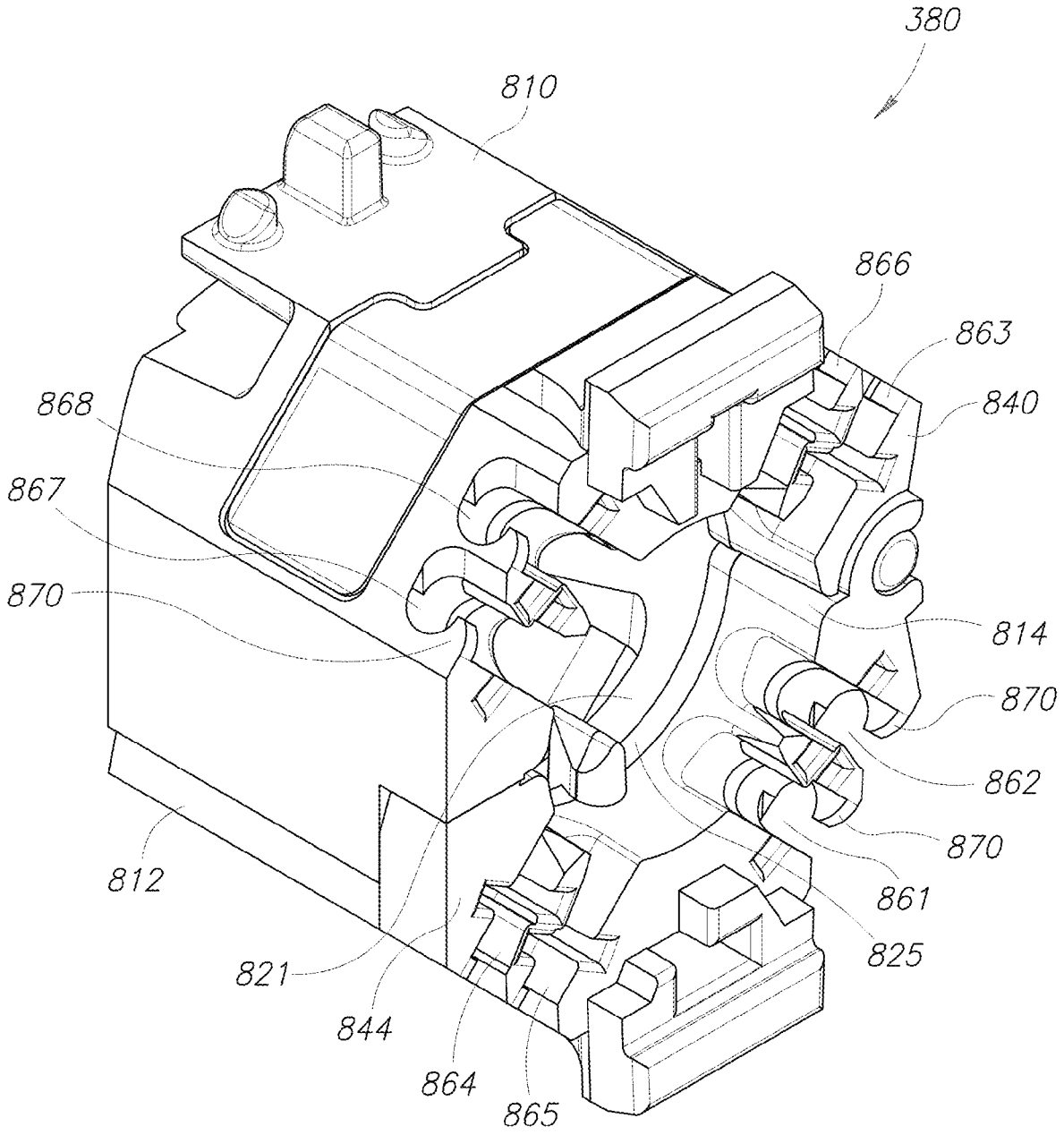
FIG.25A Amended

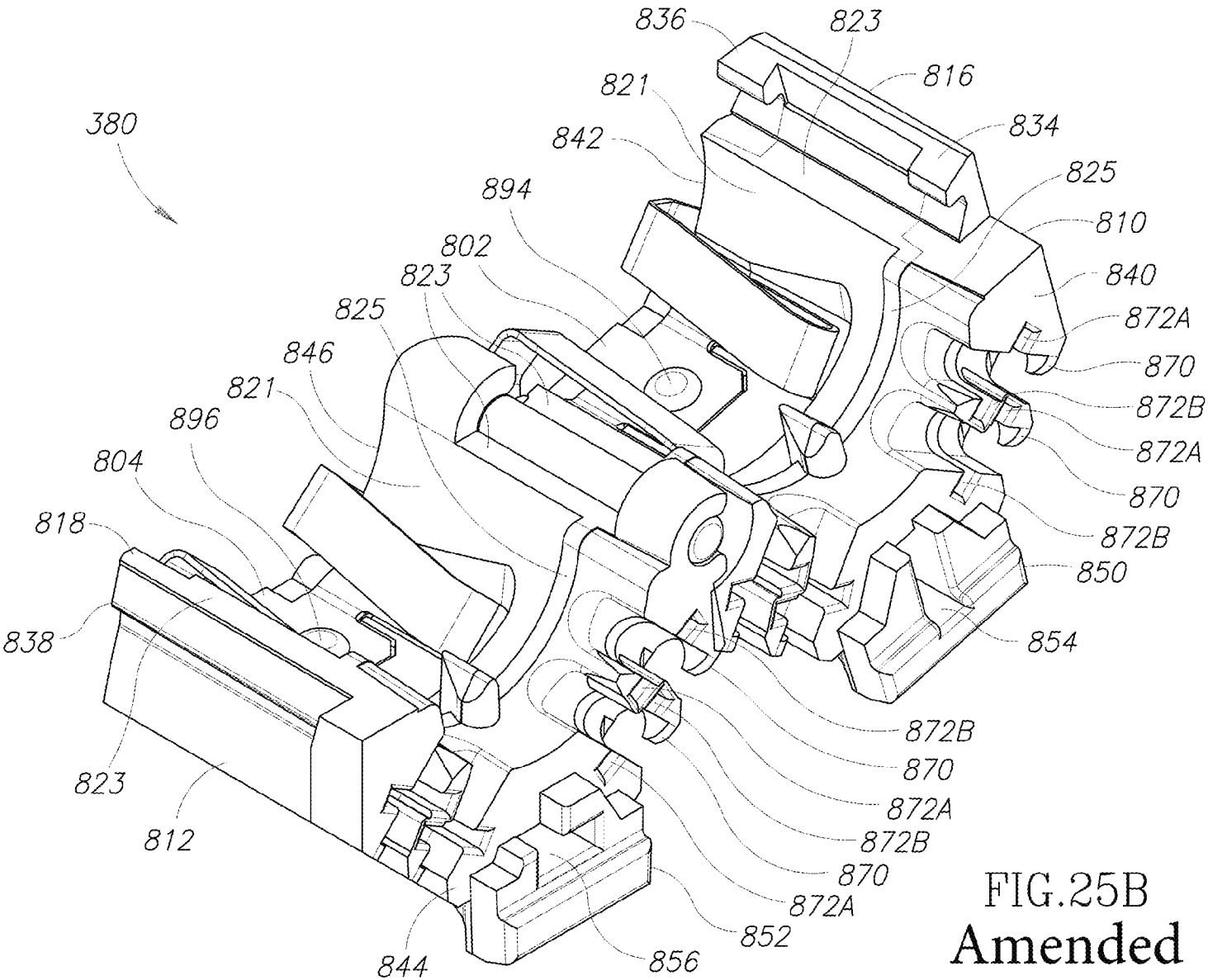
FIG.25B
Amended

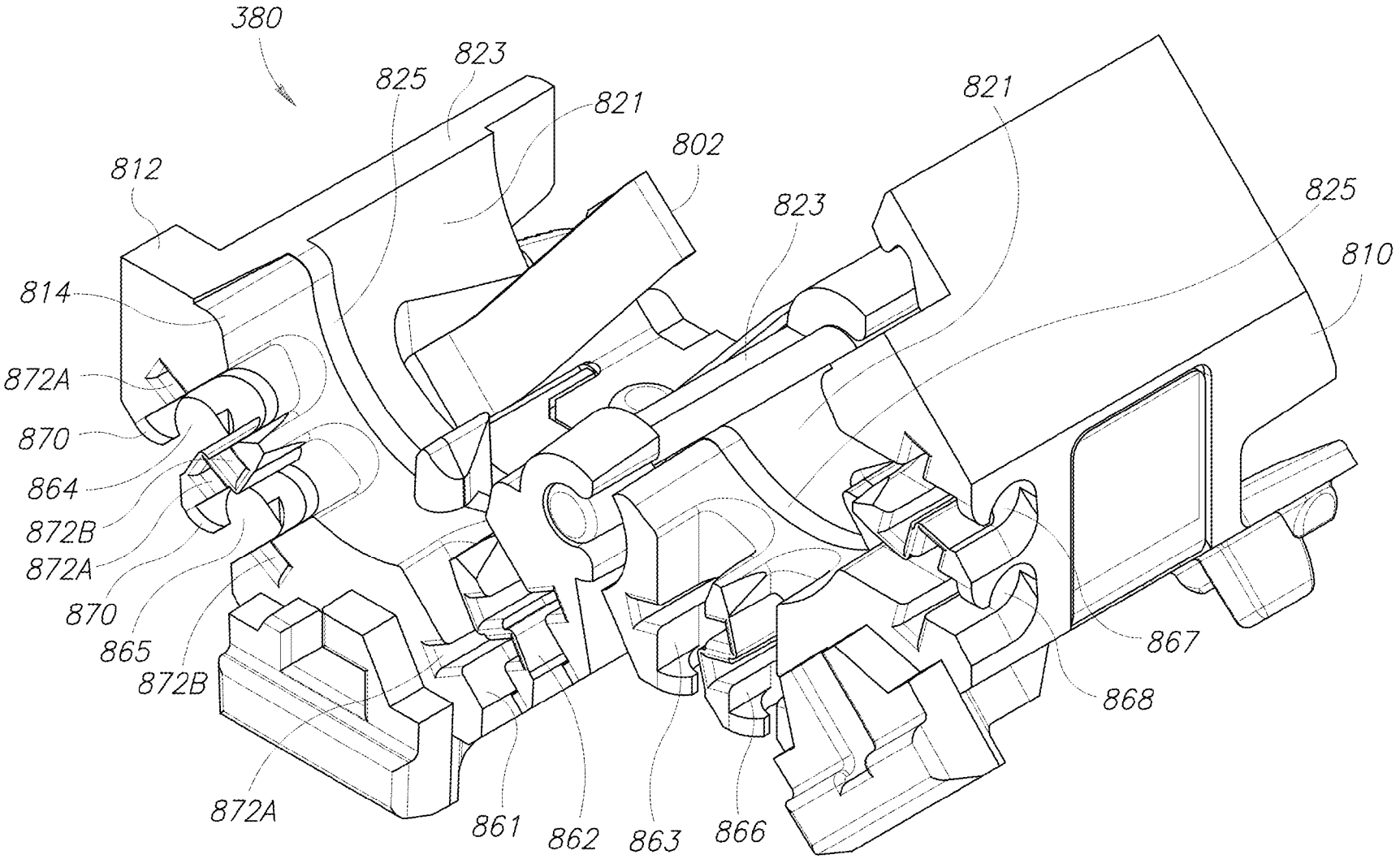
FIG.26A Amended

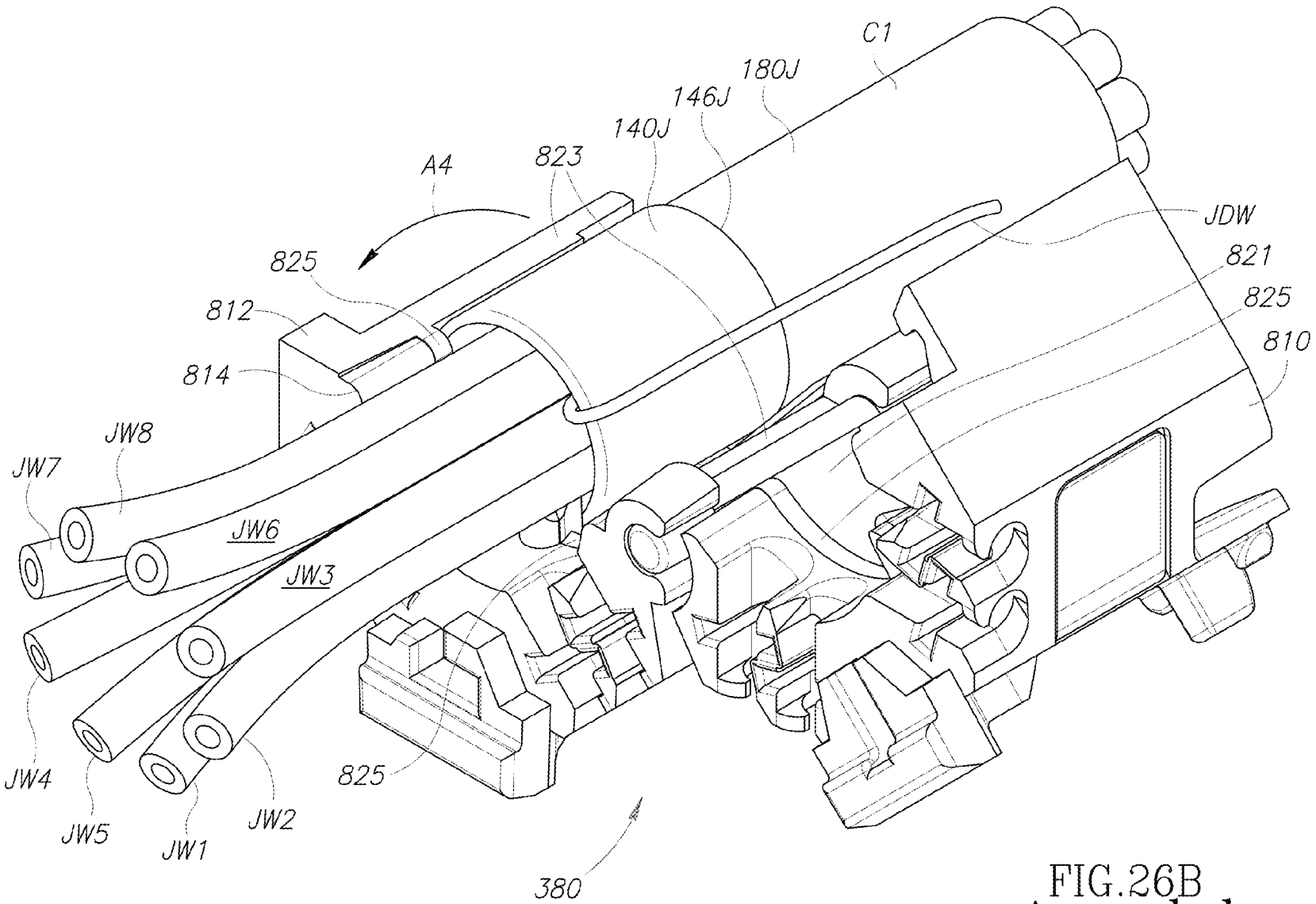
FIG.26B
Amended

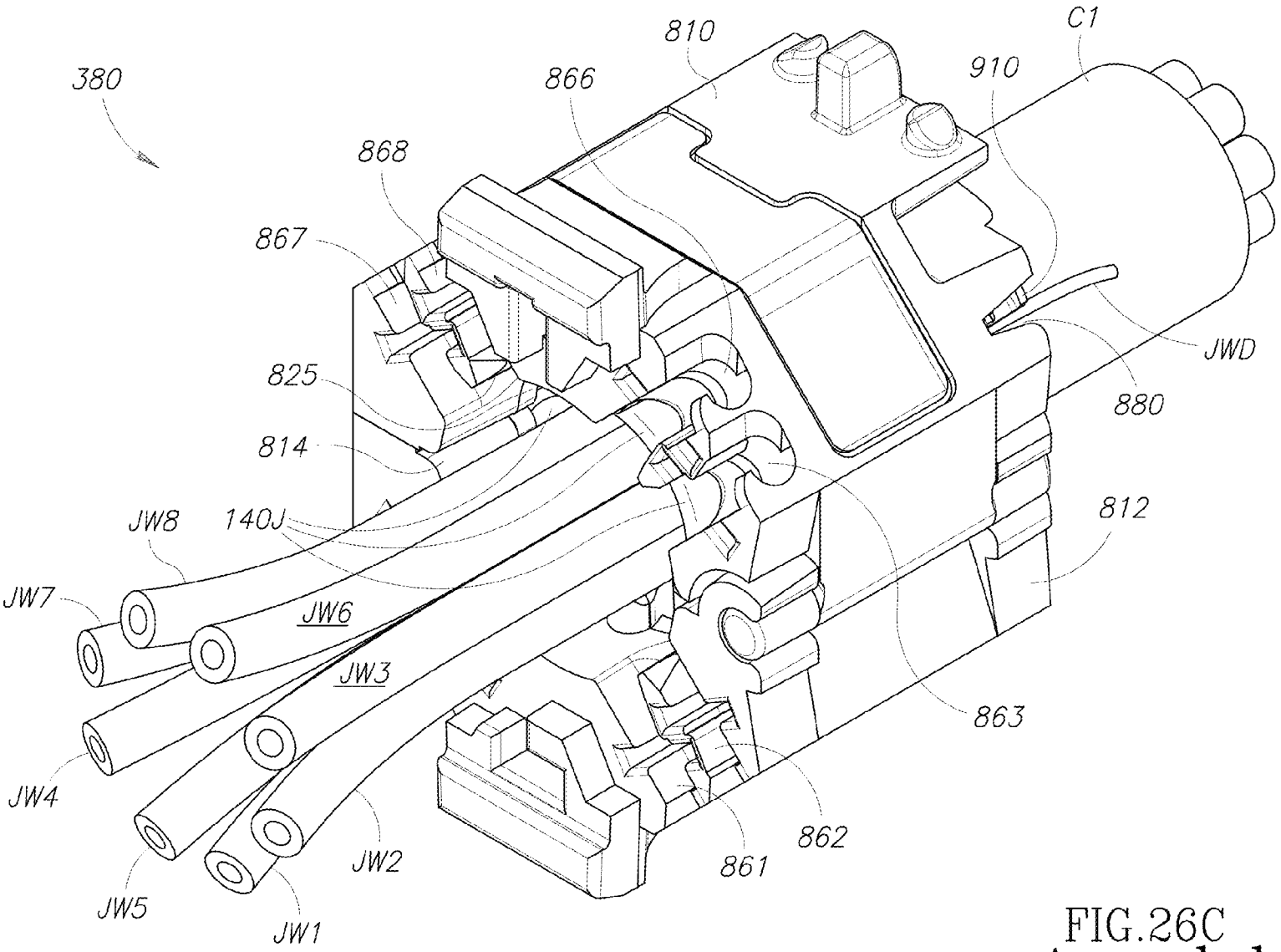
FIG.26C
Amended

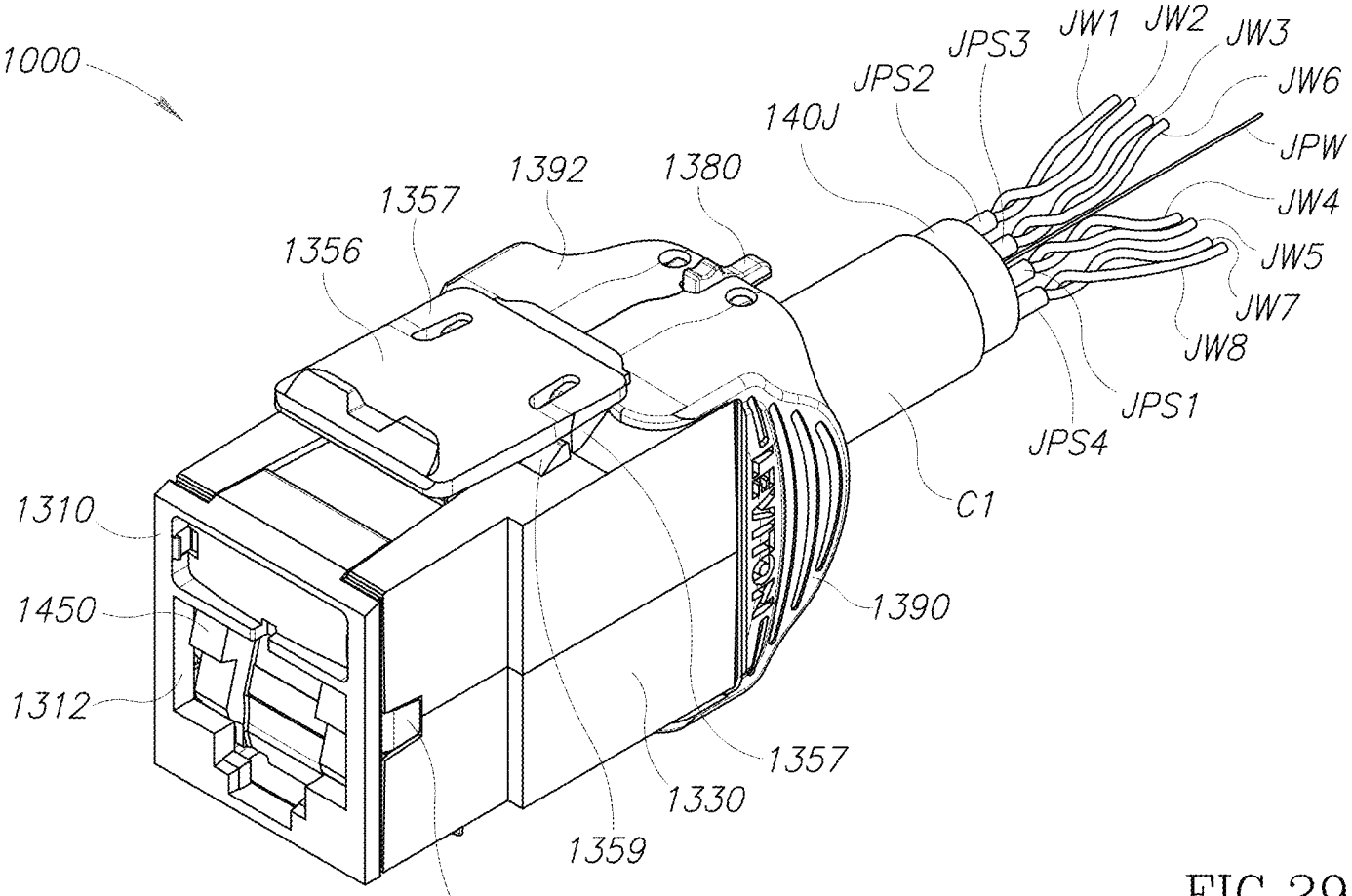
FIG.29
Amended

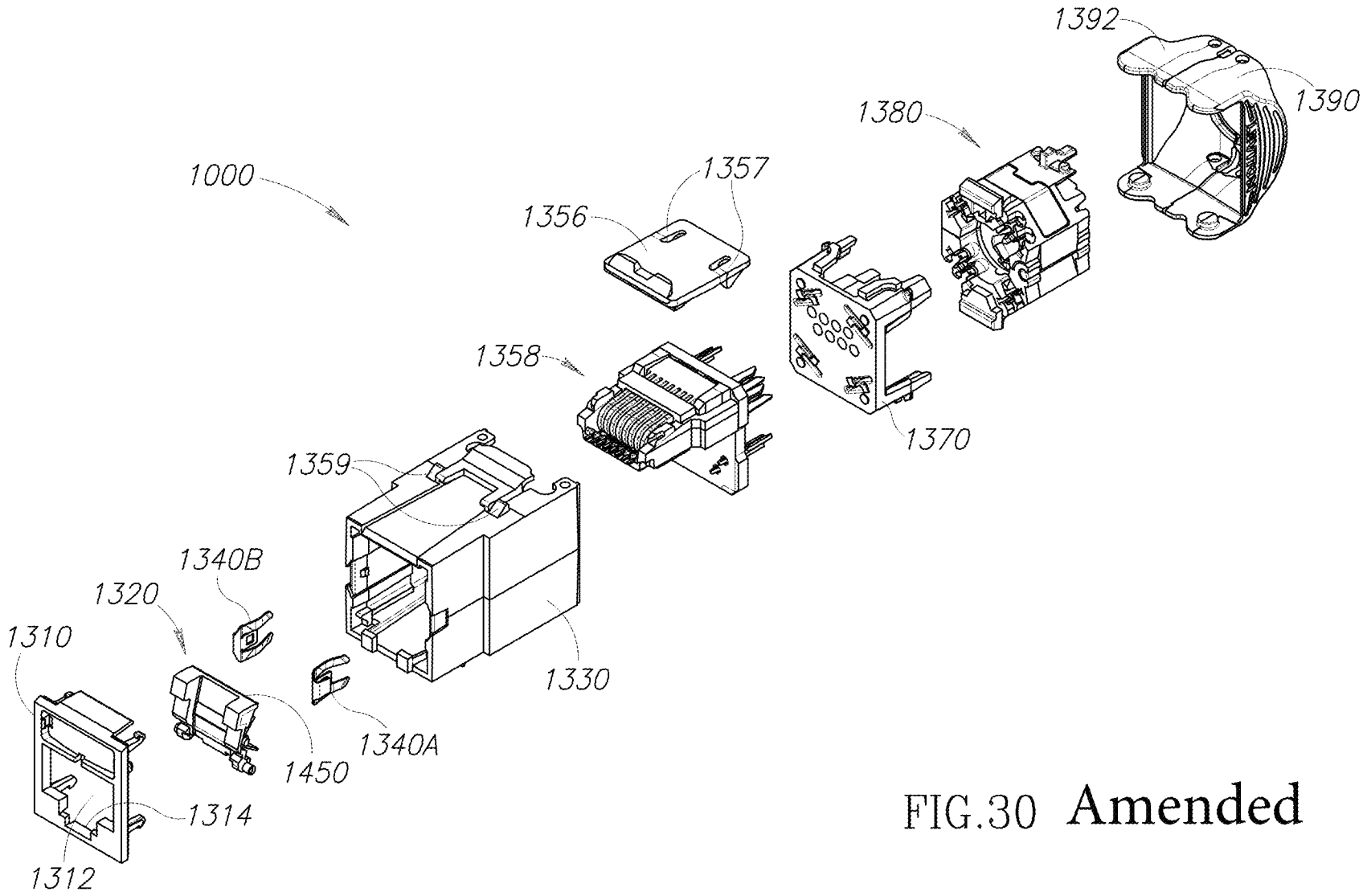
FIG.30 Amended

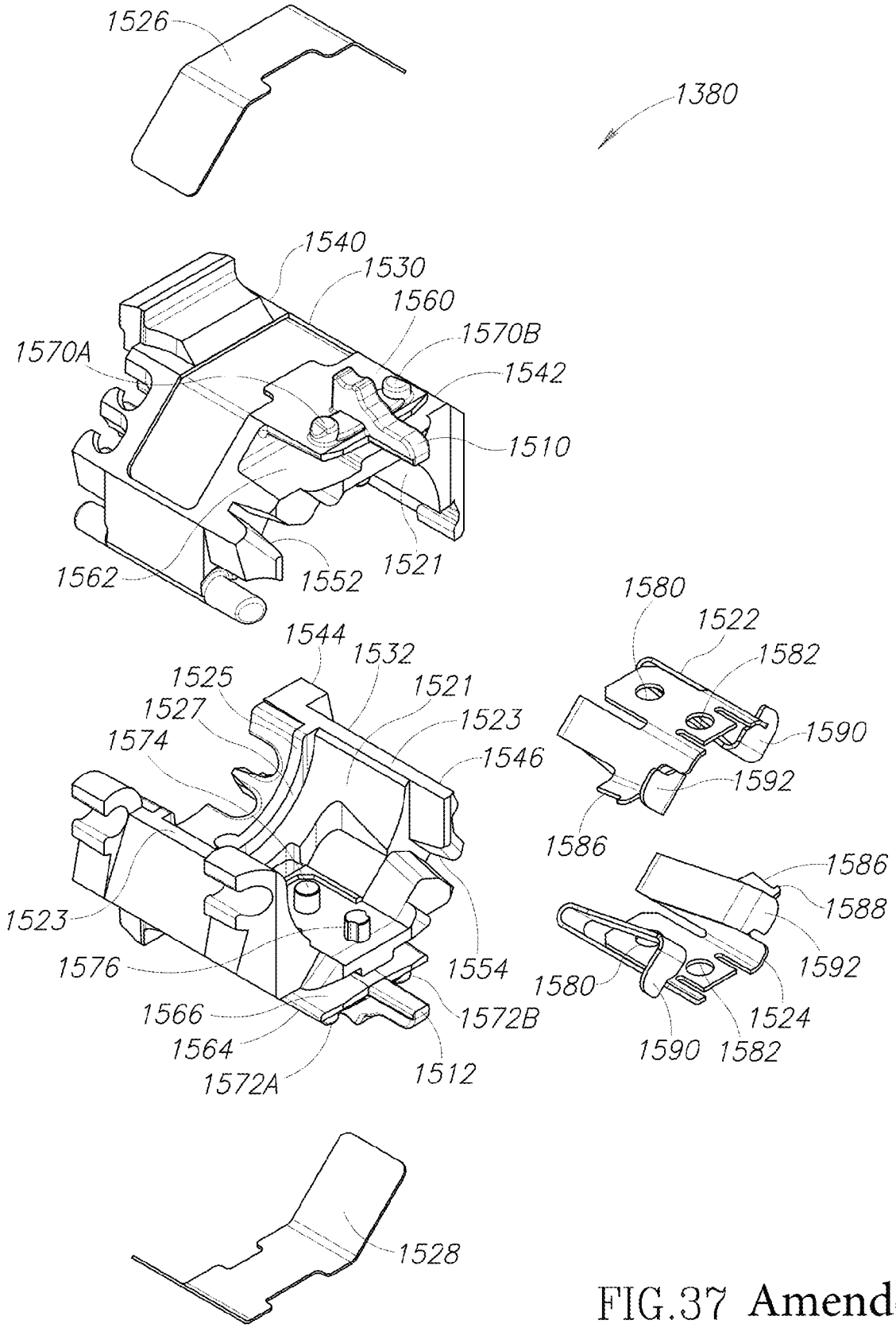
FIG.37 Amended

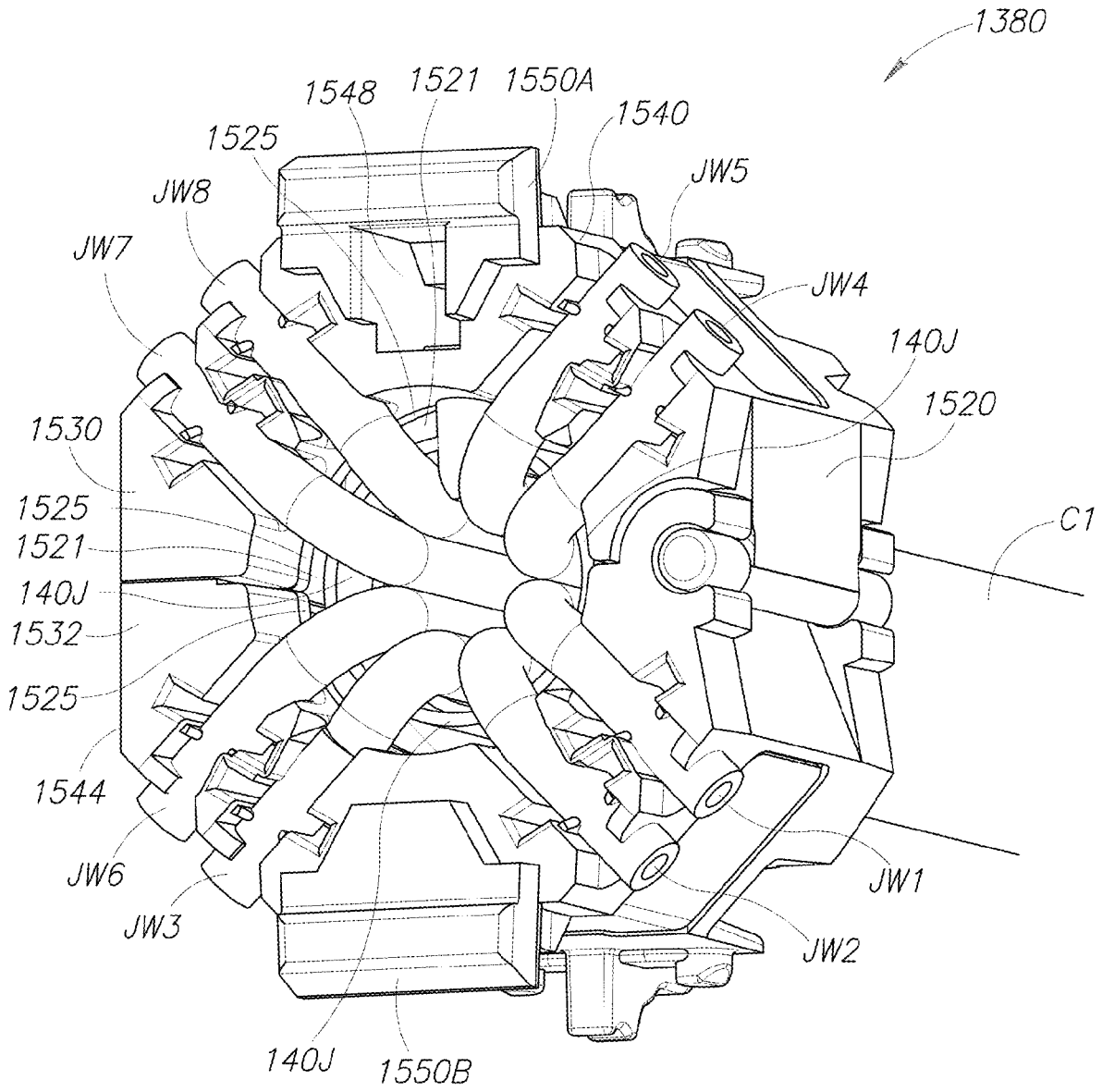
FIG.38A Amended

EX PARTE REEXAMINATION CERTIFICATE

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 19, line 5-14 and 16:

Referring to FIGS. 5, 6, 8, and 9, the latch member 356 may comprise tabs 357 for engagement with tab receiving features 359 of the housing 330.

Column 24, line 66-Column 25, line 8 and 10:

Referring to FIGS. 23A, 23B, 24B, 25A, 25B, 26A, 26B, and 26C, an annular rim having a substantially cylindrical top of rim 825 and an annulus portion 827 may extend from the partially cylindrical walls 821 of first portion 810 and second portion 812 into the passageway 814. The top of rim 825 and annulus portion 827 may extend about more than half of the circumference of passageway 814. The top of rim 825 and annulus portion 827 may extend about substantially all of the circumference of passageway 814. Protrusions from flat portions 823 may extend into the passageway 814 to define the width of top of rim 825 and the depth of the annulus portion 827. The top of rim 825 and annulus portion 827 may be positioned near one end of passageway 814 at approximately a location beyond which a prepared end of cable C1 should not extend. FIGS. 26B and 26C show the cable shield 140J folded back to indicate a prepared end of cable C1 adjacent to the annulus portion 827, while the wires JW1-JW8 extend beyond the top of rim 825.

Column 29, line 53-Column 29, line 62 and Column 30, line 4:

Referring to FIGS. 29 and 30, the latch member 1356 may comprise tabs 1357 for engagement with tab receiving features 1359 of the housing 1330.

Column 35, line 62-Column 36, line 4-12:

Referring to FIGS. 37 and 38A, an annular rim having a substantially cylindrical top of rim 1525 and an annulus portion 1527 may extend from the partially cylindrical walls 1521 of first portion 1530 and second portion 1532 into the passageway 1534. The top of rim 1525 and annulus portion 1527 may extend about more than half of the circumference of passageway 1534. The top of rim 1525 and annulus portion 1527 may extend about substantially all of the circumference of passageway 1534. Protrusions from flat portions 1523 may extend into the passageway 1534 to define the width of top of rim 1525 and the depth of the annulus portion 1527. The top of rim 1525 and annulus portion 1527 may be positioned near one end of passageway 1534 at approximately a location beyond which a prepared end of cable C1 should not extend. FIG. 38A shows the cable shield 140J folded back to indicate a prepared end of cable C1 adjacent to the annulus portion 1527, while the wires JW1-JW8 extend beyond the top of rim 1525.

THE DRAWING FIGURES HAVE BEEN CHANGED AS FOLLOWS:

FIGS. Nos. 5, 6, 8, 9, 23A, 23B, 24B, 25A, 25B, 26A, 26C, 29, 30, 37, 38A.

Reference numerals 357, 359, 812, 821, 823, 825, 140J, 1357, 1359, 1521, 1523, 1525 and 1527 have been added to the Figures.

AS A RESULT OF REEXAMINATION, IT HAS BEEN DETERMINED THAT:

Claims 12, 21 and 26 are determined to be patentable as amended.

Claims 13, 18 and 19, dependent on an amended claim, are determined to be patentable.

New claims 47-77 are added and determined to be patentable.

Claims 1-11, 14-17, 20, 22-25 and 27-46 were not reexamined.

12. A communication outlet for terminating a communication cable comprising a plurality of wires and a cable shield, the outlet comprising:

a plurality of wire contacts;

a wire manager having an open-ended passageway and a plurality of wire channels adjacent one end of the passageway, the passageway being configured to receive the communication cable therein, the plurality of wire channels being configured to receive the plurality of wires and position the plurality of wires to form electrical connections with the plurality of wire contacts; and an electrically conductive housing, *the housing having been constructed as a first conductive piece and positioned at the rearmost portion of the outlet, the housing comprising a throughway opening through which an end of the communication cable may pass*, the wire manager being positionable inside the housing and comprising [at least one] *a plurality of* conductive [member] *members* at least partially positioned inside the passageway, [the] *the plurality of conductive members having been constructed as a second conductive piece, each of the plurality of conductive members biased toward the passageway, the first conductive piece and second conductive piece having been positioned to be in electrical connection with one another,* at least one *of the plurality of* conductive [member] *members* electrically connecting the cable shield with the housing when the wire manager is positioned inside the housing and the cable is received inside the passageway.

21. A method of terminating a communication cable comprising a cable jacket protecting a plurality of wires and a cable shield, the method comprising:

removing an end portion of the cable jacket to expose the plurality of wires and the cable shield;

folding the exposed cable shield back over the cable jacket to define a folded back shield portion;

positioning the folded back shield portion inside a wire manager with the exposed wires extending outwardly from the wire manager, the folded back shield portion contacting and forming an electrical connection with [an] *at least one* electrically conductive member *of a plurality of electrically conductive members* inside the wire manager, *wherein each of the plurality of electrically conductive members is biased toward an axis substantially parallel with the center of the cable, the plurality of conductive members having been constructed as a second conductive piece;* bending each of the exposed wires extending outwardly from the wire manager and positioning each of the bent wires into a different one of a plurality of wire channels formed in the wire manager; [and]

inserting the wire manager into an opening of a communication outlet, the plurality of wire channels positioning the bent wires to engage a plurality of wire contacts inside the communication outlet when the wire manager is inserted into the opening*; and bringing an electrically conductive housing that was constructed as a first conductive piece, into contact with the second conductive piece such that the first conductive piece and second conductive piece are positioned to be in electrical connection with one another and the housing is positioned at the rearmost portion of the outlet, the housing comprising a throughway opening through which an end of the communication cable may pass.*

26. A wire manager for use with a communication outlet and a communication cable, the communication outlet comprising an electrically conductive outlet housing, *the outlet housing comprising a first portion having been constructed as a first conductive piece positioned at the rearmost portion of the outlet, the first portion comprising a throughway opening through which an end of the communication cable may pass*, and a plurality of wire contacts positioned inside the outlet housing, the communication cable comprising a plurality of wires and a cable shield, the wire manager comprising:

a wire manager housing configured to clamp onto an end portion of the communication cable, the wire manager housing comprising a plurality of wire channels positioned to be adjacent to the end portion of the communication cable when the wire manager housing is clamped onto the communication cable, the plurality of wire channels being configured to receive the plurality of wires and position the plurality of wires to contact the plurality of wire contacts and form electrical connections therewith when the wire manager housing is received inside the outlet housing; and [at least one conductive member] *a plurality of conductive members* connected to the wire manager housing[the], *each of the plurality of conductive members biased toward the communication cable when the wire manager housing is clamped onto the communication cable, the plurality of conductive members having been constructed as a second conductive piece, the first conductive piece and second conductive piece having been positioned to be in electrical connection with one another*, at least one *of the plurality of* conductive [member] *members* being positioned to contact and form an electrical connection with the cable shield when the wire manager housing is clamped onto the communication cable, the at least one *of the plurality of* conductive [member] *members* being configured to contact and form an electrical connection with the outlet housing when the wire manager housing is received inside the outlet housing.

*47. The outlet of claim 12, wherein:*

*each of the plurality of conductive members comprises a bent portion and a free distal portion.*

*48. The outlet of claim 47, wherein:*

*the first conductive piece was constructed by a molding process.*

*49. The outlet of claim 12, further comprising:*

*an annular rim extending into the passageway from a wall of the passageway, the annular rim positioned near the one end of the passageway at approximately a location beyond which a prepared end of the communication cable should not extend, the annular rim extending around at least approximately half of the circumference of the passageway.*

*50. The outlet of claim 49, wherein:*

*the annular rim extends around substantially all of the circumference of the passageway.*

*51. The outlet of claim 12, further comprising:*

*a removable latch member attached to an outer surface of the communication outlet;*

*a plurality of tab receiving features formed on the outer surface of the communication outlet;*

*the latch member comprising a plurality of tabs formed so as to securely attach to a corresponding plurality of tab receiving features; and*

*the latch member having a connector portion configured to attach the outlet inside an aperture formed in an external structure.*

*52. The outlet of claim 12, wherein the first conductive piece is formed of substantially all metal and the second conductive piece is formed of substantially all metal.*

*53. A communication outlet for terminating a communication cable comprising a plurality of wires and a cable shield, the outlet comprising: a plurality of wire contacts; a wire manager having an open-ended passageway and a plurality of wire channels adjacent one end of the passageway, the passageway being configured to receive the communication cable therein; an annular rim extending into the passageway from a wall of the passageway, the annular rim positioned near the one end of the passageway at approximately a location beyond which a prepared end of the communication cable should not extend, the annular rim extending around at least approximately half of the circumference of the passageway; the plurality of wire channels being configured to receive the plurality of wires and position the plurality of wires to form electrical connections with the plurality of wire contacts; and an electrically conductive housing positioned at the rearmost portion of the outlet, the housing comprising a throughway opening through an end of the communication cable may pass, the wire manager being positionable inside the housing and comprising a plurality of conductive members at least partially positioned inside the passageway, each of the plurality of conductive members biased toward the passageway, at least one of the plurality of conductive members electrically connecting the cable shield with the housing when the wire manager is positioned inside the housing and the cable is received inside the passageway.*

*54. The communication outlet of claim 53 wherein the annular rim extends around substantially all of the circumference of the passageway.*

*55. The outlet of claim 26, wherein:*

*each of the plurality of conductive members comprises a bent portion and a free distal portion.*

*56. The outlet of claim 55, wherein:*

*the electrically conductive housing was constructed by a molding process.*

*57. The outlet of claim 55, further comprising:*

*a removable latch member attached to an outer surface of the communication outlet;*

*a plurality of tab receiving features formed on the outer surface of the communication outlet;*

*the latch member comprising a plurality of tabs formed so as to securely attach to a corresponding plurality of tab receiving features; and*

*the latch member having a connector portion configured to attach the outlet inside an aperture formed in an external structure.*

*58. The outlet of claim 53, wherein the electrically conductive housing is formed of substantially all metal and the plurality of conductive members is formed of substantially all metal.*

*59. A communication outlet for terminating a communication cable comprising a plurality of wires and a cable shield, the outlet comprising: a plurality of wire contacts; a wire manager having an open-ended passageway and a plurality of wire channels adjacent one end of the passageway, the passageway being configured to receive the communication cable therein; an annular rim extending into the passageway from a wall of the passageway, the annular rim positioned near the one end of the passageway at approximately a location beyond which a prepared end of the communication cable should not extend, the annular rim extending around at least approximately half of the circumference of the passageway; the plurality of wire channels being configured to receive the plurality of wires and position the plurality of wires to form electrical connections with the plurality of wire contacts; and an electrically conductive housing positioned at the rearmost portion of the outlet, the housing comprising a throughway opening through which an end of the communication cable may pass, the housing having been constructed as a first conductive piece, the wire manager being positionable inside the housing and comprising at least one conductive member at least partially positioned inside the passageway, the at least one conductive member having been constructed as a second conductive piece, the first conductive piece and second conductive piece having been positioned to be in electrical connection with one another, the at least one conductive member electrically connecting the cable shield with the housing when the wire manager is positioned inside the housing and the cable is received inside the passageway.*

*60. The outlet of claim 59 wherein the annular rim extends around substantially all of the circumference of the passageway.*

*61. The outlet of claim 59, wherein:*

*the at least one conductive member comprises a bent portion and a free distal portion.*

*62. The outlet of claim 59, wherein:*

*the first conductive piece was constructed by a molding process.*

*63. The outlet of claim 59, further comprising:*

*a removable latch member attached to an outer surface of the communication outlet;*

*a plurality of tab receiving features formed on the outer surface of the communication outlet;*

*the latch member comprising a plurality of tabs formed so as to securely attach to a corresponding plurality of tab receiving features; and*

*the latch member having a connector portion configured to attach the outlet inside an aperture formed in an external structure.*

*64. The outlet of claim 59, wherein the first conductive piece is formed of substantially all metal and the second conductive piece is formed of substantially all metal.*

*65. The method of claim 21, wherein*

*the folded back shield portion has a first end adjacent to the exposed wires and a second end distal from the exposed wires,*

*wherein the positioning results in placement of the first end near, but not beyond, an annular rim extending into the passageway from a wall of the passageway, the annular rim positioned near one end of the passageway and at or near a location beyond which a prepared end of the communication cable should not extend, the annular rim extending around at least approximately half of the circumference of the passageway.*

*66. The method of claim 65, wherein*

*the annular rim extends around substantially all of the circumference of the passageway.*

*67. The method of claim 21, wherein each of the plurality of conductive members comprises a bent portion and a free distal portion.*

*68. The method of claim 67, wherein the first conductive piece was constructed by a molding process.*

*69. The method of claim 21, wherein the communication outlet further comprises:*

*a removable latch member attached to an outer surface of the communication outlet;*

*the latch member comprising a plurality of tabs formed so as to securely attach to a corresponding plurality of tab receiving features, the plurality of tab receiving features formed on the outer surface of the communication outlet; and*

*the latch member having a connector portion configured to attach the outlet inside an aperture formed in an external structure.*

*70. The wire manager of claim 26 further comprising:*

*an annular rim positioned to be near the plurality of wire channels and near the end portion of the communication cable when the wire manager housing is clamped onto the communication cable, the annular rim having an axis at the centerpoint of a plurality of circles defining the annular rim and perpendicular to the circles, the axis of the annular rim substantially parallel with and substantially aligned with an axis of the end portion of the communication cable when the wire manager housing is clamped onto the communication cable, the annular rim affixed to the wire manager housing at approximately a location beyond which the end portion of the communication cable should not extend, the annular rim extending around at least approximately half of the circumference of the plurality of circles defining the annular rim.*

*71. The wire manager of claim 70 wherein the annular rim extends around substantially all of the circumference of the circles defining the annular rim.*

*72. The wire manager of claim 26 wherein each of the plurality of conductive members comprises a bent portion and a free distal portion.*

*73. The wire manager of claim 26 wherein the first conductive piece was constructed by a molding process.*

*74. The wire manager of claim 26 further comprising:*

*a removable latch member attached to an outer surface of the communication outlet;*

*the latch member comprising a plurality of tabs formed so as to securely attach to a corresponding plurality of tab*

*receiving features, the plurality of tab receiving features formed on the outer surface of the communication outlet; and*

*the latch member having a connector portion configured to attach the outlet inside an aperture formed in an external structure.*

*75. A communication outlet for terminating a communication cable comprising a plurality of wires and a cable shield, the outlet comprising: a plurality of wire contacts; a wire manager having an open-ended passageway and a plurality of wire channels adjacent one end of the passageway, the passageway being configured to receive the communication cable therein, the plurality of wire channels being configured to receive the plurality of wires and position the plurality of wires to form electrical connections with the plurality of wire contacts; and an electrically conductive housing positioned at the rearmost portion of the outlet, the housing comprising a throughway opening through which an end of the communication cable may pass, the wire manager being positionable inside the housing and comprising a plurality of conductive members at least partially positioned inside the passageway, each of the plurality of conductive members comprises a bent portion and a free distal portion, each of the plurality of conductive members biased toward the passageway, at least one of the plurality of conductive members electrically connecting the cable shield with the housing when the wire manager is positioned inside the housing and the cable is received inside the passageway.*

76. *The outlet of claim 75, wherein:*

*at least a portion of the electrically conductive housing was constructed by a molding process.*

77. *The outlet of claim 75, further comprising:*

*a removable latch member attached to an outer surface of the communication outlet;*

*a plurality of tab receiving features formed on the outer surface of the communication outlet;*

*the latch member comprising a plurality of tabs formed so as to securely attach to a corresponding plurality of tab receiving features; and*

*the latch member having a connector portion configured to attach the outlet inside an aperture formed in an external structure.*

* * * * *